US011959352B2

(12) United States Patent
Mitchell

(10) Patent No.: US 11,959,352 B2
(45) Date of Patent: Apr. 16, 2024

(54) RETRIEVABLE HIGH EXPANSION BRIDGE PLUG AND PACKER WITH RETRACTABLE ANTI-EXTRUSION BACKUP SYSTEM

(71) Applicant: Weatherford Technology Holdings, LLC, Houston, TX (US)

(72) Inventor: Michael Wilbert Mitchell, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 293 days.

(21) Appl. No.: 17/492,290

(22) Filed: Oct. 1, 2021

(65) Prior Publication Data

US 2022/0136358 A1 May 5, 2022

Related U.S. Application Data

(63) Continuation-in-part of application No. 17/085,910, filed on Oct. 30, 2020, now Pat. No. 11,713,643, and (Continued)

(51) Int. Cl.
*E21B 33/12* (2006.01)
*E21B 23/06* (2006.01)

(52) U.S. Cl.
CPC ..... *E21B 33/12* (2013.01); *E21B 23/06* (2013.01)

(58) Field of Classification Search
CPC .. E21B 33/12; E21B 33/1204; E21B 33/1208; E21B 33/1216; E21B 33/122; E21B 33/128; E21B 23/06
See application file for complete search history.

(56) References Cited

U.S. PATENT DOCUMENTS 2,725,941 A 12/1955 Henshaw
3,044,553 A 7/1962 Bradley
(Continued)

FOREIGN PATENT DOCUMENTS

GB 2275951 A 9/1994
WO 2003054349 A1 7/2003
(Continued)

OTHER PUBLICATIONS

International Search Report and Written Opinion dated Jan. 10, 2022 for Application No. PCT/US2021/054161.
(Continued)

*Primary Examiner* — D. Andrews
*Assistant Examiner* — Ronald R Runyan
(74) *Attorney, Agent, or Firm* — Peter V. Schroeder; Booth Albanesi Schroeder PLLC

(57) ABSTRACT

A packer assembly includes a packer mandrel and a packing element disposed about the packer mandrel. An upper recovery sleeve is disposed about the packer mandrel and extending between the packer mandrel and an upper end of the packing element, and a lower recovery sleeve is disposed about the packer mandrel and extending between the packer mandrel and a lower end of the packing element. An upper backup assembly is movably disposed about the upper recovery sleeve and adjacent to the upper end of the packing element. A lower backup assembly is movably disposed about the lower recovery sleeve. The lower backup assembly has a lower backup ring assembly configured to enclose an outer surface of the lower end of the packing element. A retrieval sleeve is selectively movable relative to the lower backup ring assembly and configured to at least partially retract the lower backup ring assembly.

20 Claims, 45 Drawing Sheets

Related U.S. Application Data a continuation-in-part of application No. 17/085,859, filed on Oct. 30, 2020, now Pat. No. 11,555,364.

(56) References Cited

U.S. PATENT DOCUMENTS

| | | | |
|---|---|---|---|
| 3,083,769 | A | 4/1963 | Brown |
| 4,524,981 | A | 6/1985 | Hertz, Jr. |
| 4,903,777 | A | 2/1990 | Jordan, Jr. et al. |
| 5,333,692 | A | 8/1994 | Baugh et al. |
| 5,566,762 | A | 10/1996 | Braddick et al. |
| 5,595,247 | A | 1/1997 | Braddick |
| 5,678,635 | A | 10/1997 | Dunlap et al. |
| 5,857,520 | A | 1/1999 | Mullen et al. |
| 5,941,313 | A | 8/1999 | Arizmendi |
| 5,961,123 | A | 10/1999 | Ingram et al. |
| 6,253,856 | B1 | 7/2001 | Ingram et al. |
| 6,257,339 | B1 | 7/2001 | Haugen et al. |
| 6,695,050 | B2 | 2/2004 | Winslow et al. |
| 6,827,150 | B2 | 12/2004 | Luke |
| 6,935,431 | B2 | 8/2005 | Dewey et al. |
| 7,077,212 | B2 | 7/2006 | Roesner et al. |
| 7,363,970 | B2 | 4/2008 | Corre et al. |
| 7,591,321 | B2 | 9/2009 | Whitsitt et al. |
| 7,654,334 | B2 | 2/2010 | Manson |
| 7,836,962 | B2 | 11/2010 | Fagley, IV et al. |
| 8,186,446 | B2 | 5/2012 | Ingram et al. |
| 8,205,671 | B1 | 6/2012 | Branton |
| 8,307,891 | B2 | 11/2012 | Bishop et al. |
| 8,393,388 | B2 | 3/2013 | Bishop et al. |
| 8,479,809 | B2 | 7/2013 | Farquhar |
| 8,602,116 | B2 | 12/2013 | Crabb |
| 8,881,836 | B2 | 11/2014 | Ingram |
| 9,145,755 | B2 | 9/2015 | Farquhar |
| 9,194,204 | B2 | 11/2015 | Hiorth et al. |
| 9,267,348 | B2 | 2/2016 | Ingram et al. |
| 9,291,044 | B2 | 3/2016 | Murphy et al. |
| 9,376,884 | B2 | 6/2016 | Clarke |
| 9,506,316 | B2 | 11/2016 | Carr et al. |
| 9,534,462 | B2 | 1/2017 | Hayter |
| 9,562,413 | B2 | 2/2017 | Hiorth |
| 9,739,106 | B2 | 8/2017 | Tse |
| 10,024,126 | B2 | 7/2018 | Davies et al. |
| 10,024,132 | B2 | 7/2018 | Clemens et al. |
| 10,036,221 | B2 | 7/2018 | Davies et al. |
| 10,094,198 | B2 | 10/2018 | Nguyen et al. |
| 10,138,704 | B2 | 11/2018 | Mitchell et al. |
| 10,214,981 | B2 | 2/2019 | Davies et al. |
| 10,316,617 | B2 | 6/2019 | Davies et al. |
| 10,358,890 | B2 | 7/2019 | Zhong et al. |
| 10,364,639 | B2 | 7/2019 | Svartvatn et al. |
| 10,370,933 | B2 | 8/2019 | Hiorth |
| 10,443,339 | B2 | 10/2019 | Yun et al. |
| 10,443,343 | B2 | 10/2019 | Doane et al. |
| 10,472,920 | B2 | 11/2019 | Farquhar et al. |
| 10,590,732 | B2 | 3/2020 | Ingram |
| 10,605,020 | B2 | 3/2020 | Davies et al. |
| 10,626,696 | B1 | 4/2020 | Branton |
| 10,760,372 | B2 | 9/2020 | Scruggs et al. |
| 10,907,441 | B2 | 2/2021 | Hou et al. |
| 11,066,896 | B2 | 7/2021 | Heiman et al. |
| 2003/0188860 | A1 | 10/2003 | Zimmerman et al. |
| 2003/0226668 | A1* | 12/2003 | Zimmerman ..... E21B 33/1204 166/134 |
| 2004/0007366 | A1* | 1/2004 | McKee ..... E21B 33/1216 166/387 |
| 2009/0283279 | A1 | 11/2009 | Patel et al. |
| 2011/0259610 | A1* | 10/2011 | Shkurti ..... E21B 33/12 166/318 |
| 2012/0217025 | A1 | 8/2012 | Shkurti et al. |
| 2013/0068448 | A1 | 3/2013 | Hiorth et al. |
| 2013/0186646 | A1 | 7/2013 | Xu |
| 2014/0076539 | A1 | 3/2014 | Hiorth |
| 2015/0068729 | A1 | 3/2015 | Carr et al. |
| 2015/0275619 | A1 | 10/2015 | Slup |
| 2016/0369588 | A1 | 12/2016 | Davies et al. |
| 2017/0370175 | A1 | 12/2017 | Hiorth |
| 2018/0209241 | A1 | 7/2018 | Farquhar et al. |
| 2019/0162032 | A1 | 5/2019 | Davies et al. |
| 2019/0186229 | A1 | 6/2019 | Hrupp |
| 2019/0338605 | A1 | 11/2019 | Anderson et al. |
| 2019/0352997 | A1 | 11/2019 | Brown |
| 2020/0040692 | A1 | 2/2020 | Yun et al. |
| 2020/0165893 | A1 | 5/2020 | Varhaug et al. |

FOREIGN PATENT DOCUMENTS

| | | | | |
|---|---|---|---|---|
| WO | WO-2007107773 | A2 * | 9/2007 | ..... E21B 23/06 |
| WO | 2008062177 | A1 | 5/2008 | |
| WO | 2016094502 | A1 | 6/2016 | |
| WO | 2017034584 | A1 | 3/2017 | |
| WO | 2019209336 | A1 | 10/2019 | |
| WO | 2020163301 | A1 | 8/2020 | |

OTHER PUBLICATIONS

International Invitation to Pay Additional Fees and, Where Applicable, Protest Fee dated Jan. 3, 2022 for Application No. PCT/US2021/054162.

International Search Report and Written Opinion dated Feb. 28, 2022 for Application No. PCT/US2021/054162.

International Search Report and Written Opinion, PCT/US2022/041865, Weatherford Technology Holdings, LLC, dated Nov. 18, 2022, 12 pages.

* cited by examiner

RETRIEVABLE HIGH EXPANSION BRIDGE PLUG AND PACKER WITH RETRACTABLE ANTI-EXTRUSION BACKUP SYSTEM

CROSS-REFERENCE TO RELATED APPLICATIONS

This application is a continuation-in-part of U.S. patent application Ser. No. 17/085,859, filed Oct. 30, 2020. Also, This application is a continuation-in-part of U.S. patent application Ser. No. 17/085,910, filed Oct. 30, 2020. Both of the aforementioned patent applications are incorporated by reference herein in their entirety.

BACKGROUND

Field

Embodiments of the present disclosure generally relate to a packer assembly including a packing element. The packer assembly may be used in bores, such as wellbores, pipelines, and the like.

Description of the Related Art

Packer assemblies are used in bores, such as wellbores or pipelines, to create temporary or permanent seals within the bores. A packer assembly may include one or more packing element. Typically, a packing element may be made out of a deformable material, such as an elastomer, to a prescribed initial length and initial outer diameter. The packing element may be set in a bore by the application of axial compression, thereby reducing the length of the packing element, and causing the packing element to deform radially outward into sealing contact with the surrounding bore.

For ease of installation in a bore, it may be desirable to run a packing element having an initial outer diameter significantly smaller than the inner diameter of the bore. In some instances, the packing element may have to fit through a restriction in the bore while being installed to the desired location in the bore. Such a situation may compromise the eventual utility of the packing element because generally, the greater the ratio of bore diameter to the initial outer diameter of the packing element, the lower the pressure sealing capability of the packing element when set in the bore. Hysteresis of deformable materials, such as elastomers, may adversely affect retrieval of a packing element from a bore, especially if retrieval involves passing the used packing element through a restriction.

Many operations conducted within a bore, such as a wellbore or a pipeline, require an anchor to be established within the bore, for example to secure tubing and equipment within a wellbore and to establish a force reaction point for other wellbore operations, such as setting packers, bridge plugs, anchoring other tools, and the like. Many anchors include slip systems that typically include a number of slip members having gripping teeth. Setting such an anchor involves moving the slip members radially outward into engagement with a bore wall. Cone based slip systems may include a cone that is moved axially relative to one or more slip members to radially move and support the slips in engagement with a bore wall. Conventional slip systems are limited in how far the slip members can move between the retracted and extended positions. Other slip systems have poor load ratings when the slip members are fully extended from a relatively small diameter to a relatively large diameter.

There is a need for some tools, such as packers and bridge plugs, to have packing elements and slip systems to be capable of undergoing transitions from a relatively small diameter to a relatively large diameter without compromising sealing or anchoring capabilities.

SUMMARY

In one embodiment, a packer assembly includes a packer mandrel and a packing element disposed about the packer mandrel. An upper recovery sleeve is disposed about the packer mandrel and extending between the packer mandrel and an upper end of the packing element, and a lower recovery sleeve is disposed about the packer mandrel and extending between the packer mandrel and a lower end of the packing element. An upper backup assembly is movably disposed about the upper recovery sleeve and adjacent to the upper end of the packing element. A lower backup assembly is movably disposed about the lower recovery sleeve. The lower backup assembly has a lower backup ring assembly configured to enclose an outer surface of the lower end of the packing element. A retrieval sleeve is selectively movable relative to the lower backup ring assembly and configured to at least partially retract the lower backup ring assembly.

In one embodiment, a method of manipulating a packing element in a bore includes providing an upper recovery sleeve having an upper recovery profile embedded within the packing element and providing a lower recovery sleeve having a lower recovery profile embedded within the packing element. The method also includes moving an upper backup assembly with respect to the upper recovery sleeve toward an upper end of the packing element; and moving a lower backup assembly with respect to the lower recovery sleeve toward a lower end of the packing element. The lower backup assembly has a lower backup ring enclosing an outer surface of the lower end of the packing element. An axial distance between the upper recovery sleeve and the lower recovery sleeve is reduced, thereby axially compressing the packing element. The packing element is deformed into contact with a surrounding wall of the bore and causing the lower backup ring to splay outward along an outer surface of a lower end of the packing element. The packing element is released from the surrounding wall. A retrieval sleeve is moved relative to the lower backup ring to retract the lower backup ring assembly.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns packer assemblies and slip assemblies that may be incorporated into tools for use in a bore, such as a wellbore, a pipeline, and the like. Tools incorporating the packer and/or slip assemblies of the present disclosure may include wellbore packers, hangers, whipstock anchors, and the like. Another example tool is a bridge plug.

Figure 1:
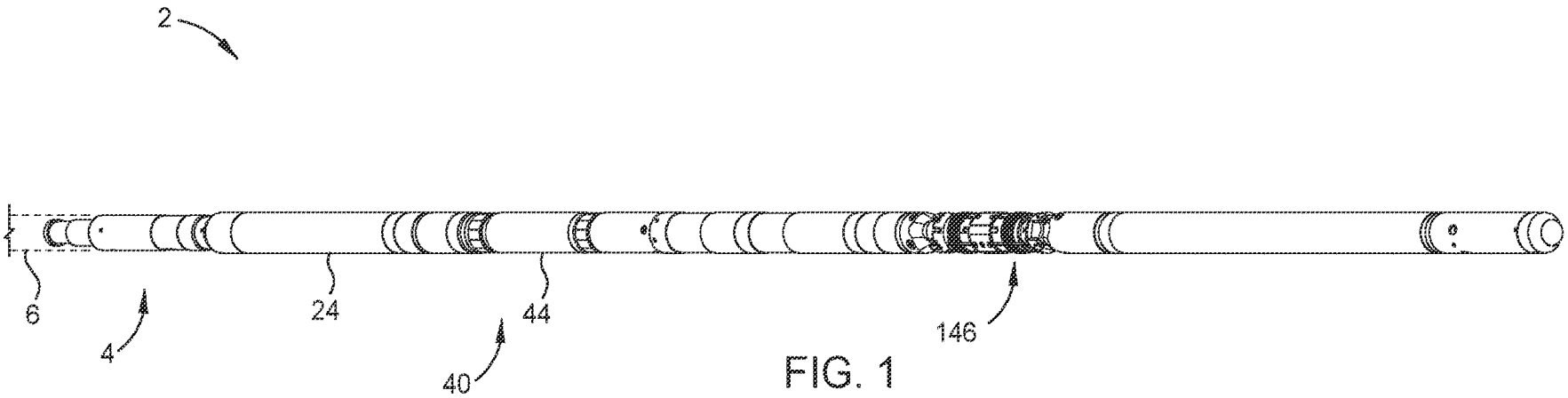
FIG. 1 is an external view of an exemplary bridge plug incorporating packer and slip assemblies according to an embodiment of the present disclosure.
Figure 1A:
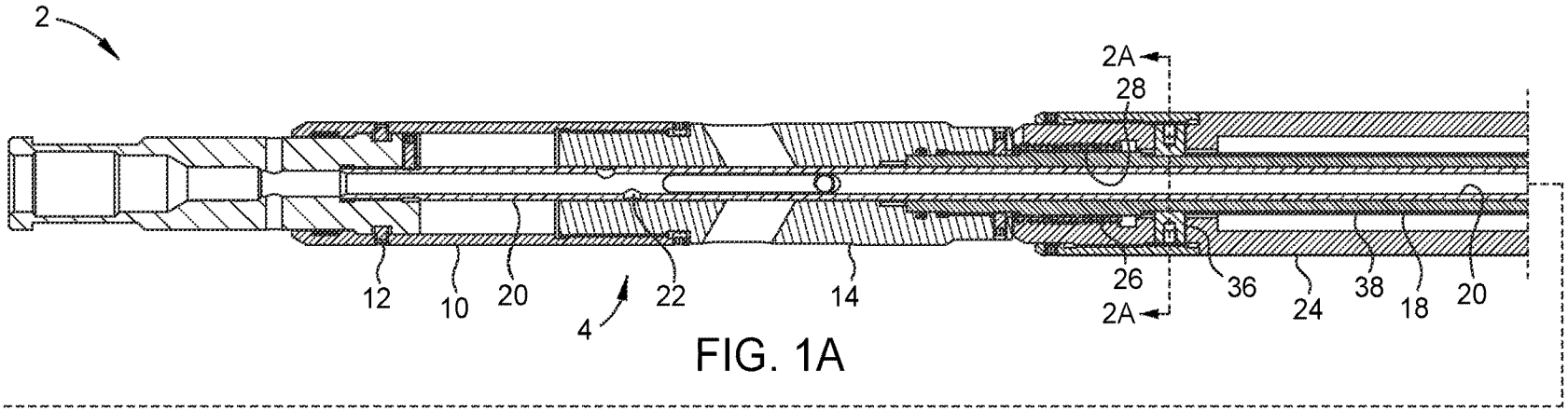
FIGS. 1A to 1F shows an exemplary bridge plug of FIG. 1 in a running configuration, according to one embodiment of the present disclosure.

FIG. 1 is a general external view of a bridge plug incorporating a packer assembly and a slip assembly of the present disclosure. The bridge plug 2 may be configured to transition from a running configuration, in which the bridge plug 2 may be installed in a bore, to a set configuration, in which the bridge plug 2 may be fixed in place within the bore. In some embodiments, the bridge plug 2 may be configured to transition from the set configuration to a released configuration, in which the bridge plug 2 may be freed from the location in the bore in which the bridge plug 2 had been fixed. The bridge plug 2 may be in a configuration suitable for retrieval from the bore when in the running and in the released configurations.

The bridge plug 2 may have a setting tool adaptor 4. The setting tool adaptor 4 may be sized such that a sleeve 6 (shown as dashed lines) of a setting tool may fit around the setting tool adaptor 4 and may bear against an upper end of a setting sleeve 24.

The bridge plug 2 may have a packer assembly 40. The packer assembly 40 may have a packing element 44 that may create a seal in the bore. The packing element 44 may create the seal when the packer assembly 40 is transitioned from a running configuration, in which the packing element 44 is not in 360 degree circumferential contact with an inner wall of the bore, to a set configuration in which the packing element 44 is at least substantially in 360 degree circumferential contact with the inner wall of the bore. In some embodiments, the packer assembly 40 may be transitioned from the set configuration to a released configuration, in which the packing element 44 is not in 360 degree circumferential contact with the inner wall of the bore. In some embodiments, the packing element 44 may have a first maximum outer diameter when in the running configuration, a second larger maximum outer diameter when in the set configuration, and a third maximum outer diameter when in the released configuration. In some embodiments, the third maximum outer diameter is substantially the same as the first maximum outer diameter. The packer assembly 40 may be incorporated into a tool such as a wellbore packer or a bridge plug 2.

The bridge plug 2 may have a slip assembly 146. The slip assembly 146 may be configured to transition from a running configuration, in which the slip assembly 146 may be installed in the bore, to a set configuration, in which the slip assembly 146 may be fixed in place within the bore. The slip assembly 146 may be configured to transition from the set configuration to a released configuration, in which the slip assembly 146 may be freed from the location in the bore in which the slip assembly 146 had been fixed. The slip assembly 146 may be in a configuration suitable for retrieval from the bore when in the running and in the released configurations.

FIGS. 1A to 1F show the bridge plug 2 of FIG. 1 in further detail when the bridge plug 2 is in the running configuration. The bridge plug 2 is shown having a setting tool adaptor 4 that may be configured to couple to, and to be manipulated by, a setting tool. The setting tool adaptor 4 may have a fishing neck 8 that is sized and shaped to facilitate attachment of a fishing tool, retrieval tool, or the like. The fishing neck 8 may be coupled to a release sleeve 10 by one or more fastener 12, such as a latch, locking dog, collet, snap ring, shear ring, shear screw, shear pin, or the like. In some embodiments, the fastener 12 may temporarily inhibit relative axial movement between the fishing neck 8 and the release sleeve 10. The release sleeve 10 may be coupled to an adaptor body 14 that has one or more side port 16. The adaptor body 14 may be coupled to a central mandrel 18 that may extend through the bridge plug 2. The fishing neck 8 may be coupled to an equalization mandrel 20 that may extend through the central mandrel 18. The equalization mandrel 20 may have one or more side port 22.

Below the setting tool adaptor 4, the central mandrel 18 may extend through a setting sleeve 24, and be coupled to the setting sleeve 24 by a lock ring 26. The lock ring 26 may include ratchet teeth 28 that are configured to engage with corresponding ratchet teeth 30 on the central mandrel 18. The lock ring 26 may be configured to permit the setting sleeve 24 to move downwards with respect to the central mandrel 18, but prevent the setting sleeve 24 from moving upwards with respect to the central mandrel 18. Additionally, the central mandrel 18 may be coupled to the setting sleeve 24 by one or more fastener 32, such as a latch, locking dog, collet, snap ring, shear ring, shear screw, shear pin, or the like. In some embodiments, the fastener 32 may temporarily inhibit relative axial movement between the central mandrel 18 and the setting sleeve 24. In some embodiments, the fastener 32 may be engaged with a stop ring 34 on the central mandrel 18.

One or more key 36 may couple the setting sleeve 24 and the central mandrel 18. Each key 36 may protrude into a corresponding slot 38 on the central mandrel 18. The interaction between each key 36 and corresponding slot 38 may inhibit relative rotation between the setting sleeve 24 and the central mandrel 18. Thus, a remedial milling operation to disintegrate the lock ring 26 may be facilitated, if required, without incurring relative rotation between the setting sleeve 24 and the central mandrel 18.

Packer Assembly

Figure 1B:
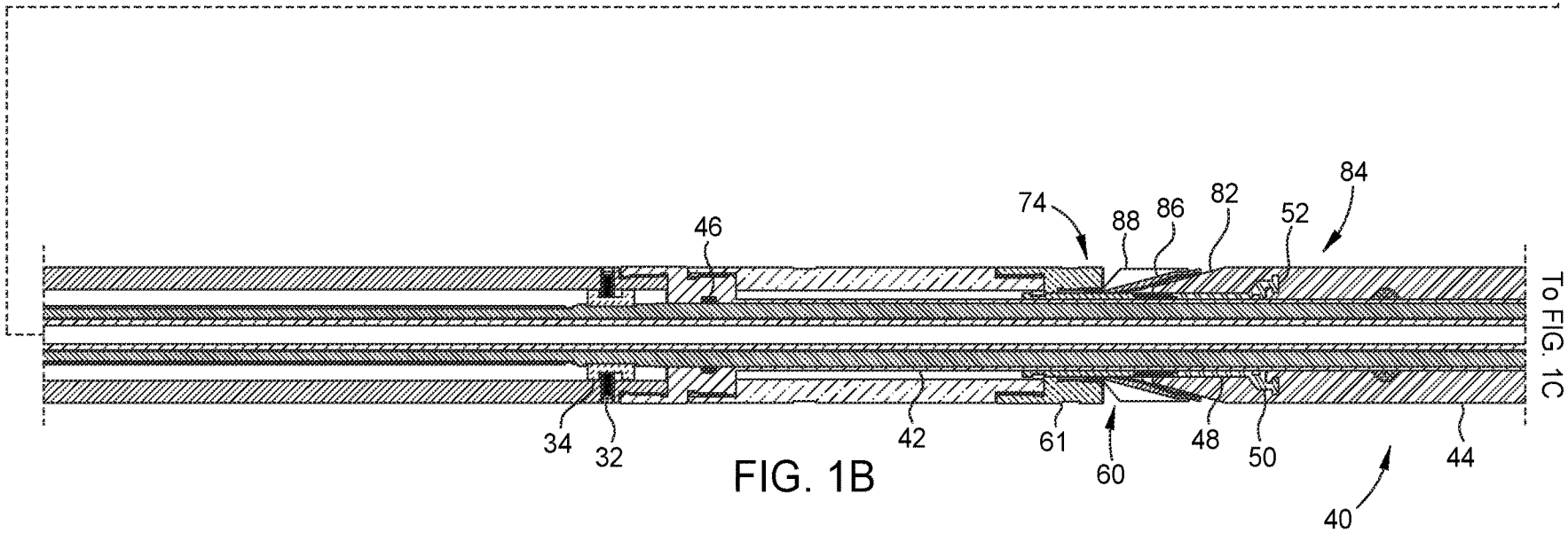
Figure 1C:
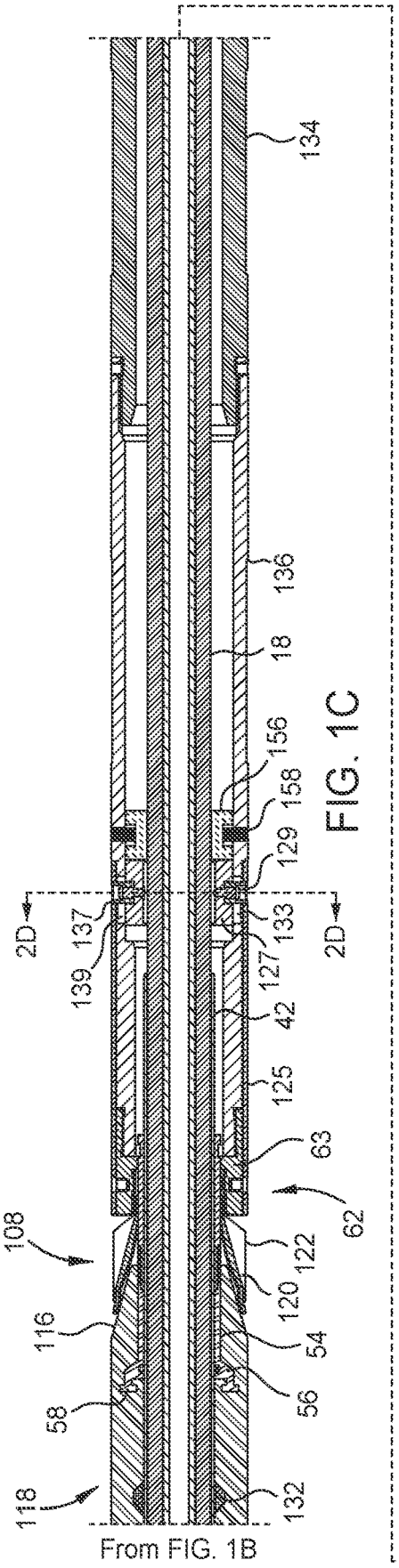

The bridge plug 2 may include a packer assembly 40, such as that shown in FIGS. 1B-1C. The setting sleeve 24 may be coupled to the packer assembly 40. The packer assembly 40 may include a packer mandrel 42 and a packing element 44 disposed about the packer mandrel 42. The setting sleeve 24 may be coupled to the packer mandrel 42. The packer mandrel 42 may be disposed about the central mandrel 18. A seal member 46 may provide a seal between the central mandrel 18 and the packer mandrel 42. The packer assembly 40 may include an upper recovery sleeve 48 disposed about the packer mandrel 42 and extending between the packer mandrel 42 and an upper end 84 of the packing element 44. The upper recovery sleeve 48 may have an upper recovery profile 50 embedded within the packing element 44. The upper recovery profile 50 may include an annular projection 52 within the packing element 44. The annular projection 52 may be bonded to the packing element 44.

The packer assembly 40 may include a lower recovery sleeve 54 disposed about the packer mandrel 42 and extending between the packer mandrel 42 and a lower end 118 of the packing element 44. The lower recovery sleeve 54 may have a lower recovery profile 56 embedded within the packing element 44. The lower recovery profile 56 may include an annular projection 58 within the packing element 44. The annular projection 58 may be bonded to the packing element 44.

The packer assembly 40 may include an upper backup assembly 60 and a lower backup assembly 62. The upper backup assembly may be disposed about the upper recovery sleeve 48. The upper backup assembly may be configured to limit upward axial extension of the packing element 44. The lower backup assembly may be disposed about the lower recovery sleeve 54. The lower backup assembly may be configured to limit downward axial extension of the packing element 44.

The upper backup assembly 60 may include an upper backup ring assembly 74 and an upper backup sleeve 61. The upper backup sleeve 61 may be disposed about the upper recovery sleeve 48 and coupled to the setting sleeve 24. The upper backup ring assembly 74 is coupled to and axially movable with the upper backup sleeve 61. The upper backup ring assembly 74 may be configured to enclose an outer surface 82 of the upper end 84 of the packing element 44. The upper backup ring assembly 74 may include an inner backup ring 86 and an outer backup ring 88 adjacent the inner backup ring 86. The inner backup ring 86 has fingers separated by slots, and the fingers are disposed adjacent the outer surface 82 of the upper end 84 of the packing element 44. The outer backup ring 88 has fingers separated by slots, and the fingers are disposed such that each finger of the outer backup ring overlaps with a corresponding slot of the inner backup ring 86.

The lower backup assembly 62 may include a lower backup ring assembly 108 and a lower backup sleeve 63. The lower backup sleeve 63 may be disposed about the lower recovery sleeve 54 and coupled to the boost housing extension 136. The lower backup ring assembly 108 is coupled to and axially movable with the lower backup sleeve 63. The lower backup ring assembly 108 may be configured to enclose an outer surface 116 of the lower end 118 of the packing element 44. The lower backup ring assembly 108 may include an inner backup ring 120 and an outer backup ring 122 adjacent the inner backup ring 120. The inner backup ring 120 has fingers separated by slots, and the fingers are disposed adjacent the outer surface 116 of the lower end 118 of the packing element 44. The outer backup ring 122 has fingers separated by slots, and the fingers are disposed such that each finger of the outer backup ring 122 overlaps with a corresponding slot of the inner backup ring 120.

Figure 2A:
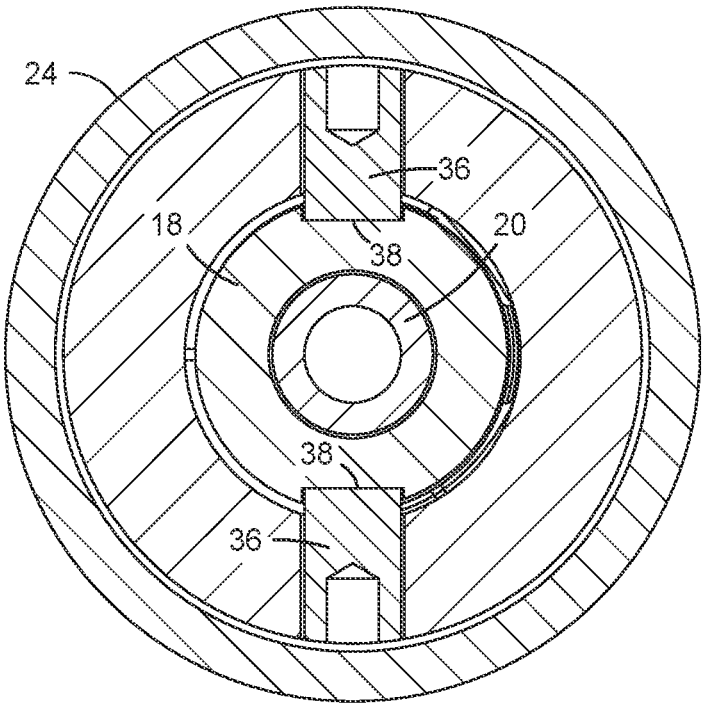
FIGS. 2A to 2D are lateral cross-sectional views of the bridge plug of FIG. 1 in the running configuration.
Figure 2B:
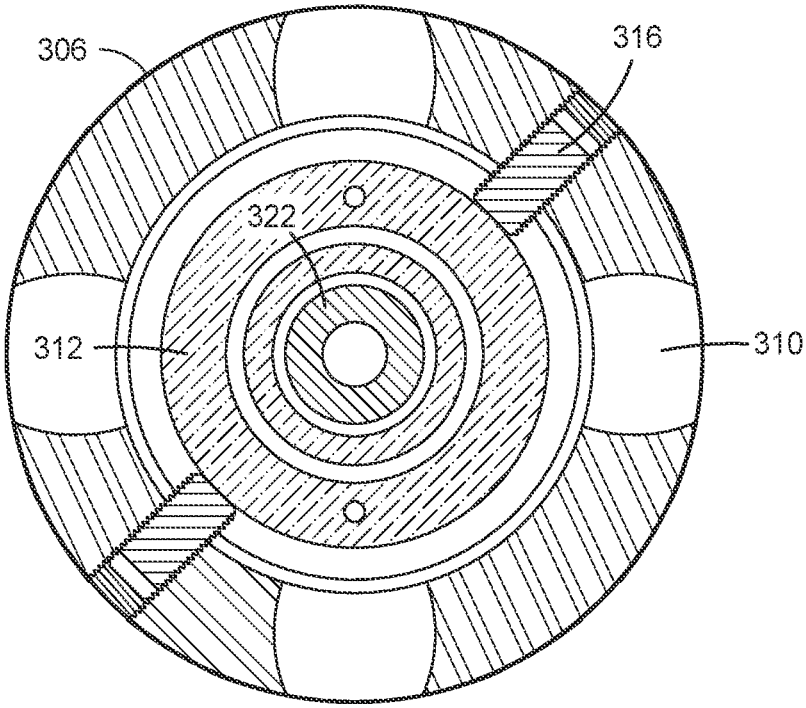
Figure 2C:
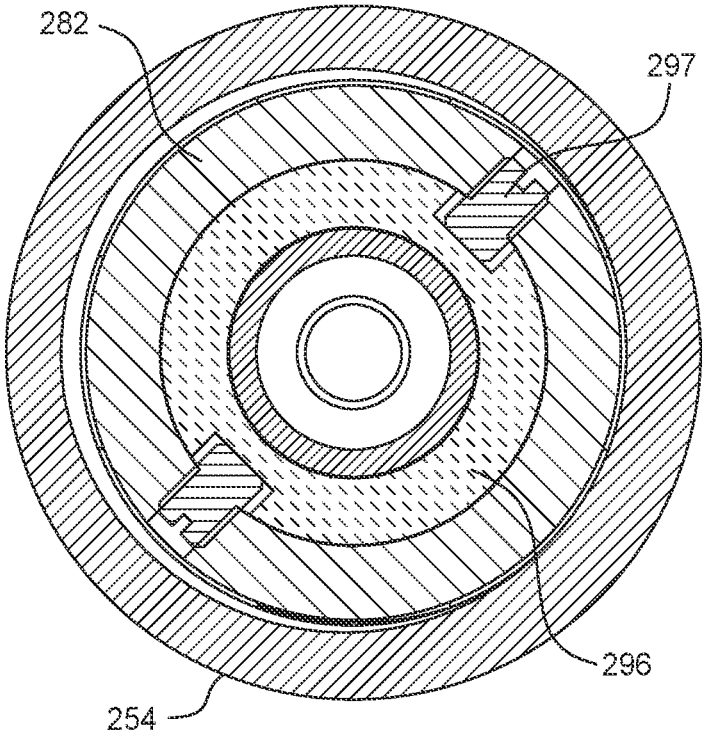
Figure 2D:
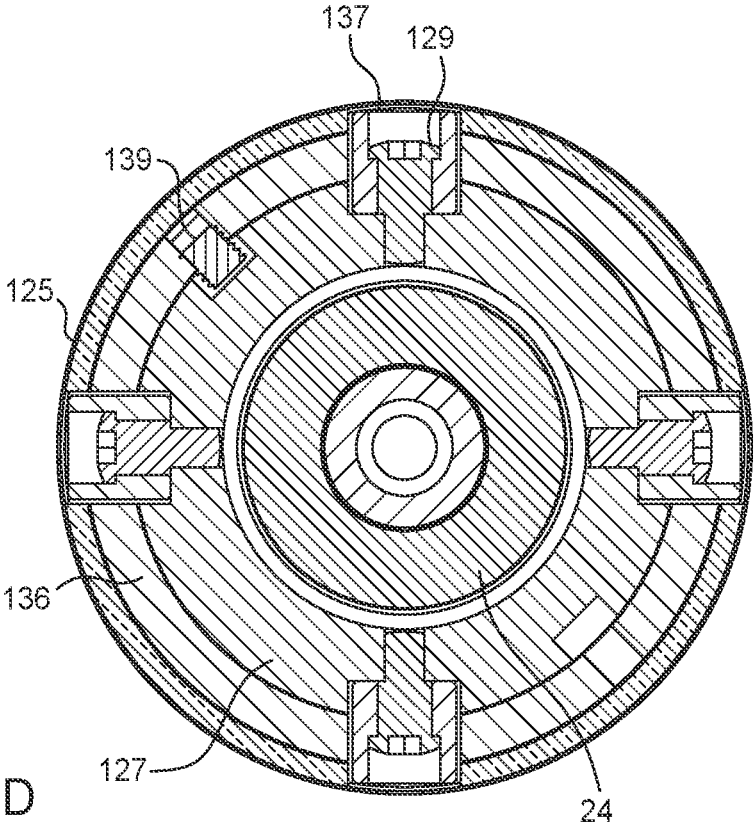

In one embodiment, the packer assembly 40 includes a retrieval sleeve 125 for collapsing the lower backup ring assembly 108. The retrieval sleeve 125 is disposed about the lower backup sleeve 63 and the boost housing extension 136. The lower end of the retrieval sleeve 125 is attached to a retrieval ring 127 via a key 137 and a fastener 129, such as a bolt or screw. The retrieval ring 127 is disposed between the boost housing extension 136 and the setting sleeve 24. Referring to FIG. 2D, the retrieval ring 127 is temporarily coupled to the boost housing extension 136 by one or more fastener 139, such as a latch, locking dog, collet, snap ring, shear ring, shear screw, shear pin, or the like. Upon release, the key 137 is movable in a slot 133 of the boost housing extension 136.

As shown in FIGS. 1B-1C, the packing element 44 may be manufactured as a single piece of packing material, such as an elastomer. The single piece may be referred to as a unitary structure. During manufacture, the elastomer may be built up in layers, such as by wrapping one or more sheet around a form, and then cured to form the unitary structure. In some embodiments, the packing element 44 may incorporate more than one grade of elastomeric material in the unitary structure. For example, the packing element may include elastomeric material of 70 durometer and elastomeric material of 90 durometer. In some embodiments, the packing element 44 may incorporate non-elastomeric materials in the unitary structure. For example, the unitary structure of the packing element 44 may include resilient fibers, such as aramid fibers. In some embodiments, the packing element 44 may include one or more garter spring embedded in the unitary structure. Thus, in embodiments in which the packing element 44 is a unitary structure, the unitary structure need not be homogenous. Furthermore, the unitary structure may include different types of materials, as described above.

In some embodiments, one or more filler ring 132 may be disposed around the packer mandrel 42, between the packer mandrel 42 and the packing element 44. The one or more filler ring 132 may be bonded to the packing element 44. The one or more filler ring 132 may be movable on the packer mandrel 42. In some embodiments, the one or more filler ring 132 may be made out of a rigid material, such as steel.

Lower Boost Mechanism

The packer assembly 40 may have a lower boost mechanism. The lower boost mechanism may be configured to act on the lower backup assembly 62 after the packing element 44 has been set in a bore. The lower boost mechanism may apply an upwardly-directed force on the lower backup assembly 62 when a pressure in the bore below the packing element 44 exceeds a pressure in the bore above the packing element 44.

Figure 1D:
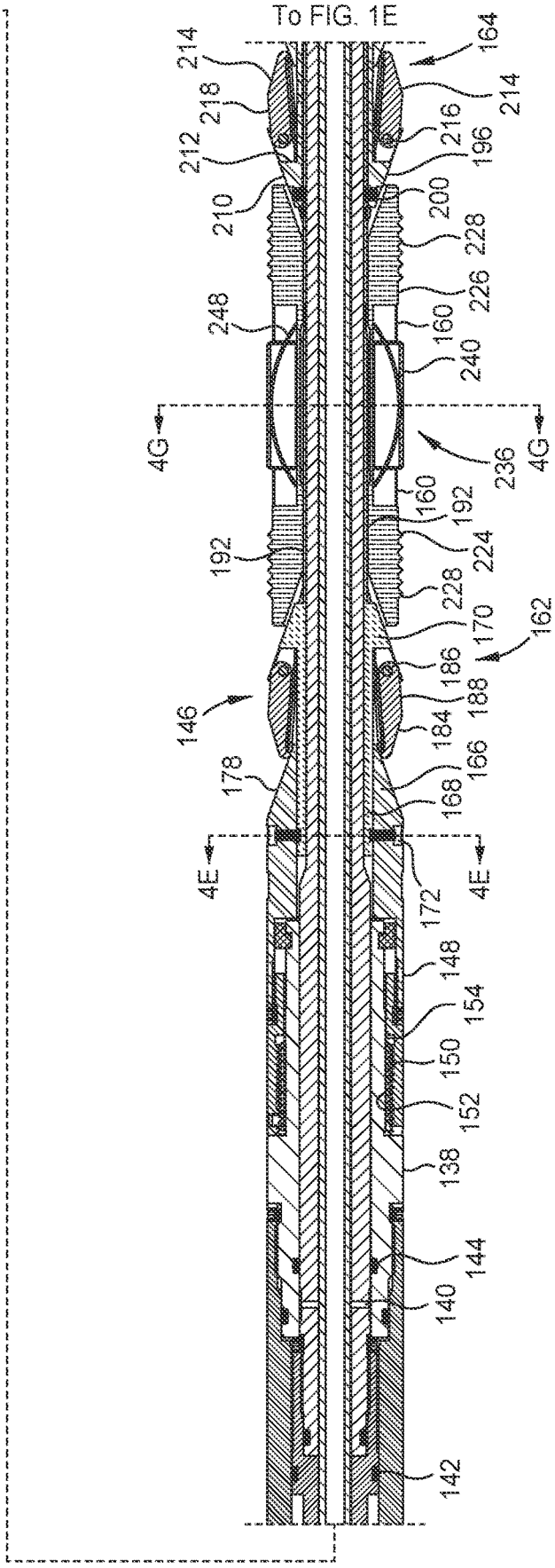
Figure 1E:
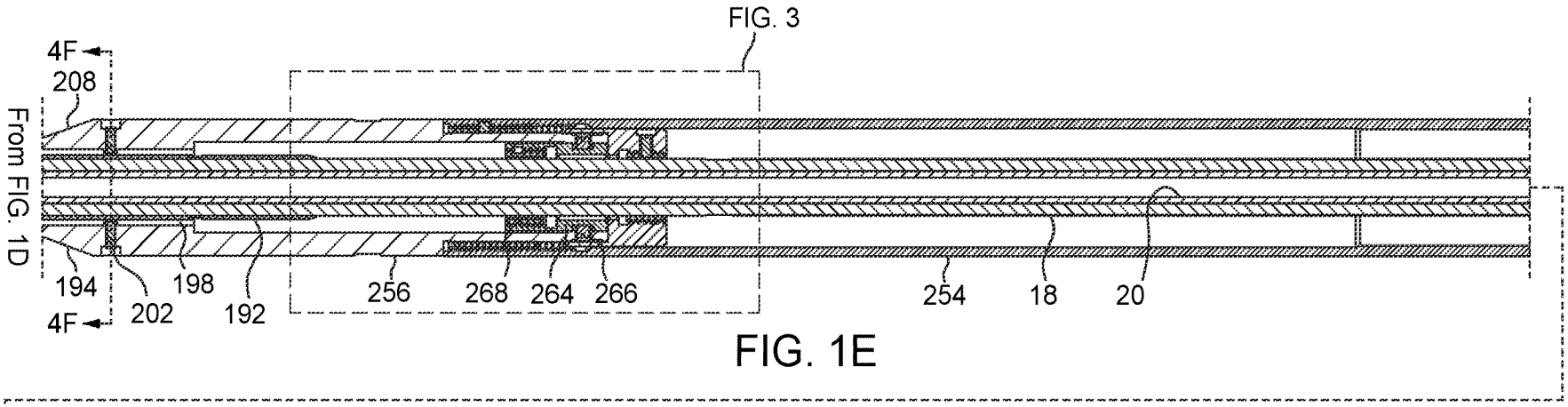

The lower boost mechanism may include a boost housing 134 coupled to a boost housing extension 136. One end of the boost housing extension 136 may be coupled to the lower inner backup sleeve 98. The other end of the boost housing 134 may be coupled to a boost mandrel 138, which may also be coupled to another component of the bridge plug 2, such as a slip assembly 146. As illustrated in FIGS. 1D-1E, and for the benefit of further description, in some embodiments, the boost mandrel 138 may be coupled to a slip assembly skirt 148. The coupling between the boost mandrel 138 and the slip assembly skirt 148 may include a lock ring 150. The lock ring 150 may include ratchet teeth 152 that are configured to engage with corresponding ratchet teeth 154 on the boost mandrel 138. The lock ring 150 may be configured to permit the boost mandrel 138 to move upwards with respect to the slip assembly skirt 148, but prevent the boost mandrel 138 from moving downwards with respect to the slip assembly skirt 148.

The central mandrel 18 may extend through the lower boost mechanism, and may have one or more side port 140 that fluidically couples an interior of the central mandrel 18 with an exterior of the central mandrel 18. Seal members 142, 144 either side of the port may provide a seal between the central mandrel 18 and the boost housing 134 and the boost mandrel 138, respectively. Pressure in the bore above the packing element 44 when the packing element 44 is set in the bore may be communicated through the one or more side port 16 in the adaptor body 14, between the equalization mandrel 20 and the central mandrel 18, and through the one or more side port 140 of the central mandrel 18 into the interior of the boost housing 134. Pressure in the bore below the packing element 44 may be communicated around the lock ring 150 between the boost mandrel 138 and the slip assembly skirt 148 and into the interior of the boost mandrel 138.

Thus, a pressure differential may exist across the seal member 144 between the central mandrel 18 and the boost mandrel 138. If the pressure in the bore below the packing element 44 is greater than the pressure in the bore above the packing element 44, the pressure differential across the seal member 144 will result in a net upward force on the boost mandrel 138. The net upward force may be transmitted through the boost housing 134 and boost housing extension 136 to the lower backup sleeve 63, and may result in the lower backup sleeve 63 applying an upward boost force on the packing element 44 that is additional to the force applied during an initial setting of the packing element 44. A corresponding upward movement of the lower backup sleeve 63, boost housing extension 136, boost housing 134, and boost mandrel 138 may be accommodated by the ratchet teeth 152 of the lock ring 150 and the ratchet teeth 154 of the boost mandrel 138, and hence the boost mandrel 138 may move upward with respect to the slip assembly 146. Since the ratchet teeth 152 of the lock ring 150 and the ratchet teeth 154 of the boost mandrel 138 inhibit the boost mandrel 138 from moving downwards with respect to the slip assembly 146, the boost force applied to the packing element 44 may be sustained even if the pressure differential that caused the exertion of the boost force is subsequently reduced, or eliminated, or reversed.

Upper Boost Mechanism

The packer assembly 40 may have an upper boost mechanism. The upper boost mechanism may be configured to act on the upper backup assembly 60 after the packing element 44 has been set in a bore. The upper boost mechanism may apply a downwardly-directed force on the upper backup assembly 60 when a pressure in the bore above the packing element 44 exceeds a pressure in the bore below the packing element 44.

The upper boost mechanism may include the packer mandrel 42, setting sleeve 24, and the lock ring 26 coupling the setting sleeve 24 to the central mandrel 18. Pressure in the bore above the packing element 44 when the packing element 44 is set in the bore may be communicated around the lock ring 26 coupling the setting sleeve 24 to the central mandrel 18, and into the interior of the setting sleeve 24 and against the seal member 46 that provides a seal between the packer mandrel 42 and the central mandrel 18. Pressure in the bore below the packing element 44 may be communicated around the lower backup sleeve 63, into the interior of the boost housing extension 136, and between the central mandrel 18 and the packer mandrel 42 up to the seal member 46 that provides a seal between the packer mandrel 42 and the central mandrel 18.

Thus, a pressure differential may exist across the seal member 46 between the central mandrel 18 and the packer mandrel 42. If the pressure in the bore above the packing element 44 is greater than the pressure in the bore below the packing element 44, the pressure differential across the seal member 46 will result in a net downward force on the packer mandrel 42. The net downward force may be transmitted through the upper backup sleeve 61, and may result in the upper backup sleeve 61 applying a downward boost force on the packing element 44 that is additional to the force applied during an initial setting of the packing element 44. A corresponding downward movement of the upper backup sleeve 61, packer mandrel 42, and setting sleeve 24 may be accommodated by the ratchet teeth 28 of the lock ring 26 and the ratchet teeth 30 of the central mandrel 18, and hence the setting sleeve 24 may move downward with respect to the central mandrel 18. Since the ratchet teeth 28 of the lock ring 26 and the ratchet teeth 30 of the central mandrel 18 inhibit the setting sleeve 24 from moving upwards with respect to the central mandrel 18, the boost force applied to the packing element 44 may be sustained even if the pressure differential that caused the exertion of the boost force is subsequently reduced, or eliminated, or reversed.

Slip Assembly

The bridge plug 2 may include a slip assembly 146, such as that shown in FIGS. 1D-1E and in FIGS. 4A-4G. A slip setting ring 156 may be disposed around the central mandrel 18 within the boost housing extension 136. The slip setting ring 156 may be movable on the central mandrel 18, but temporarily coupled to the boost housing extension 136 by one or more fastener 158, such as a latch, locking dog, collet, snap ring, shear ring, shear screw, shear pin, or the like. As described below, the slip setting ring 156 and the one or more fastener 158 may enable an axial force from the packer mandrel 42 to be transmitted through the boost housing extension 136 and boost mandrel 138 in order to set slip member(s) 160 of the slip assembly 146. The slip member(s) 160 may be actuated into contact with a surrounding bore by interaction with an upper cone assembly 162 and a lower cone assembly 164.

As described above, FIGS. 1D-1E show the boost mandrel 138 coupled to a slip assembly skirt 148 of the upper cone assembly 162. The slip assembly skirt 148 may be coupled to an upper support cone 166. In some embodiments, the slip assembly skirt 148 may be formed as part of the upper support cone 166. The upper support cone 166 may be disposed around an upper cone sleeve 168. The upper cone sleeve 168 may be coupled to an upper base cone 170. In some embodiments, the upper cone sleeve 168 may be formed as part of the upper base cone 170. The upper support cone 166 may be coupled to the upper cone sleeve 168 by a fastener 172, such as a latch, locking dog, collet, snap ring, shear ring, shear screw, shear pin, or the like. One or more key 174 may couple the upper support cone 166 with the upper cone sleeve 168. Each key 174 may protrude into a corresponding slot 176 in the upper cone sleeve 168.

Figure 4A:
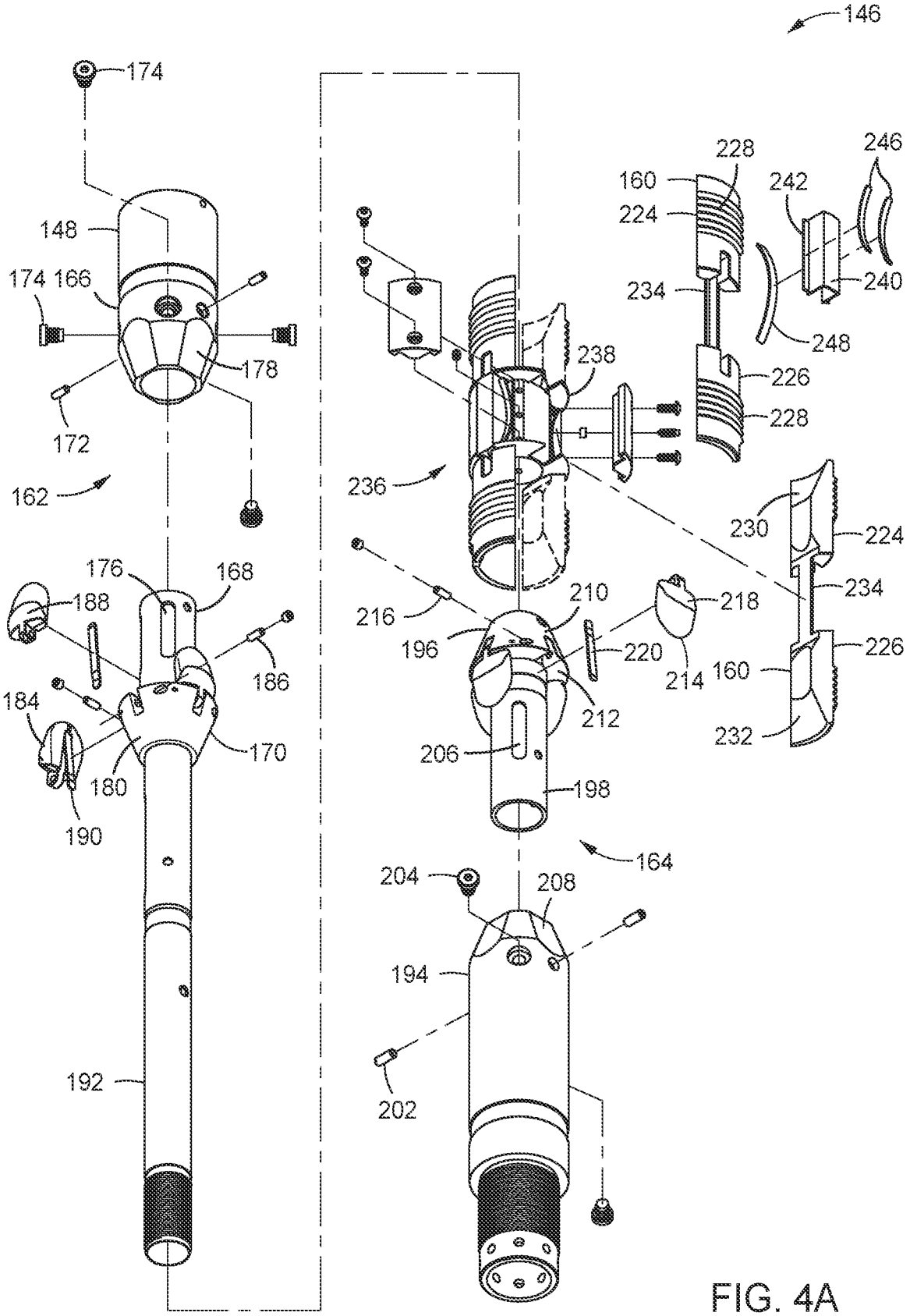
FIG. 4A is an exploded view of an exemplary slip assembly that is incorporated into the bridge plug of FIG. 1.

The upper support cone 166 may have a cone face 178. The upper base cone 170 may have a cone face 180 and a cone rear 182. One or more upper extension ramp 184 may be disposed between the cone face 178 of the upper support cone 166 and cone rear 182 of the upper base cone 170. As shown in FIG. 4A, the sloped outer surface of the cone face 178 of the upper support cone 166 may include a concave portion at an interface with each extension ramp 184. The upper extension ramp 184 may be pivotably coupled to the upper base cone 170 by a pin or hinge 186, and movable between a retracted position (as shown in FIGS. 1D-1E) and an extended position (as shown and described hereinafter). When in the extended position, the upper extension ramp 184 may have a ramp surface 188 substantially aligned with the cone face 180 of the upper base cone 170. The upper extension ramp 184 may be biased toward the retracted position by a biasing member 190, such as a spring or a mass of resilient deformable material, such as an elastomer. The biasing member 190 may be disposed in a slot in an underside of the upper extension ramp 184.

In some embodiments, a maximum outer diameter of the upper support cone 166 and a maximum outer diameter of the upper base cone 170 do not change when the slip assembly 146 transitions between the running, set, and released configurations.

The upper base cone 170 may be coupled to a slip mandrel 192. In some embodiments, the slip mandrel 192 and upper base cone 170 may be formed as a single piece. The slip mandrel 192 may extend through the slip assembly 146. The central mandrel 18 may extend through the slip mandrel 192 and through the slip assembly 146.

A lower cone assembly 164 may be disposed on the slip mandrel 192. The lower cone assembly 164 may include a lower support cone 194 and a lower base cone 196. A lower cone sleeve 198 may be coupled to the lower base cone 196. In some embodiments, the lower cone sleeve 198 may be formed as part of the lower base cone 196. The lower base cone 196 may be coupled to the slip mandrel 192 by a fastener 200, such as a latch, locking dog, collet, snap ring, shear ring, shear screw, shear pin, or the like. The lower support cone 194 may be disposed around the lower cone sleeve 198. The lower support cone 194 may be coupled to the lower cone sleeve 198 by a fastener 202, such as a latch, locking dog, collet, snap ring, shear ring, shear screw, shear pin, or the like. One or more key 204 may couple the lower support cone 194 with the lower cone sleeve 198. Each key 204 may protrude into a corresponding slot 206 in the lower cone sleeve 198.

The lower support cone 194 may have a cone face 208. The lower base cone 196 may have a cone face 210 and a cone rear 212. One or more lower extension ramp 214 may be disposed between the cone face 208 of the lower support cone 194 and cone rear 212 of the lower base cone 196. As shown in FIG. 4A, the sloped outer surface of the cone face 208 of the lower support cone 194 may include a concave portion at an interface with each extension ramp 214. The lower extension ramp 214 may be pivotably coupled to the lower base cone 196 by a pin or hinge 216, and movable between a retracted position (as shown in FIGS. 1D-1E) and an extended position (as shown and described hereinafter). When in the extended position, the lower extension ramp 214 may have a ramp surface 218 substantially aligned with the cone face 210 of the lower base cone 196. The lower extension ramp 214 may be biased toward the retracted position by a biasing member 220, such as a spring or a mass of resilient deformable material, such as an elastomer. The biasing member 220 may be disposed in a slot in an underside of the lower extension ramp 214.

In some embodiments, a maximum outer diameter of the lower support cone 194 and a maximum outer diameter of the lower base cone 196 do not change when the slip assembly 146 transitions between the running, set, and released configurations.

The slip assembly 146 may also include one or more slip member 160 disposed between the upper cone assembly 162 and the lower cone assembly 164. Each slip member 160 may be movable between retracted and extended positions. Each slip member 160 may have an upper gripper 224 and a lower gripper 226. The upper and lower grippers 224, 226 may have outwardly projecting teeth 228. The teeth 228 may be configured to penetrate an inner surface of a bore, such as an inner surface of a tubular. Each upper and lower gripper 224, 226 may have a sloped inner surface 230, 232. The sloped inner surface 230 of the upper gripper 224 may be configured to engage and slide against the cone face 180 of the upper base cone 170. The sloped inner surface 230 of the upper gripper 224 may be configured to engage and slide against the ramp surface 188 of the upper extension ramp 184 when the upper extension ramp 184 is in the extended position. The sloped inner surface 232 of the lower gripper 226 may be configured to engage and slide against the cone face 210 of the lower base cone 196. The sloped inner surface 232 of the lower gripper 226 may be configured to engage and slide against the ramp surface 218 of the lower extension ramp 214 when the lower extension ramp 214 is in the extended position.

Figure 4B:
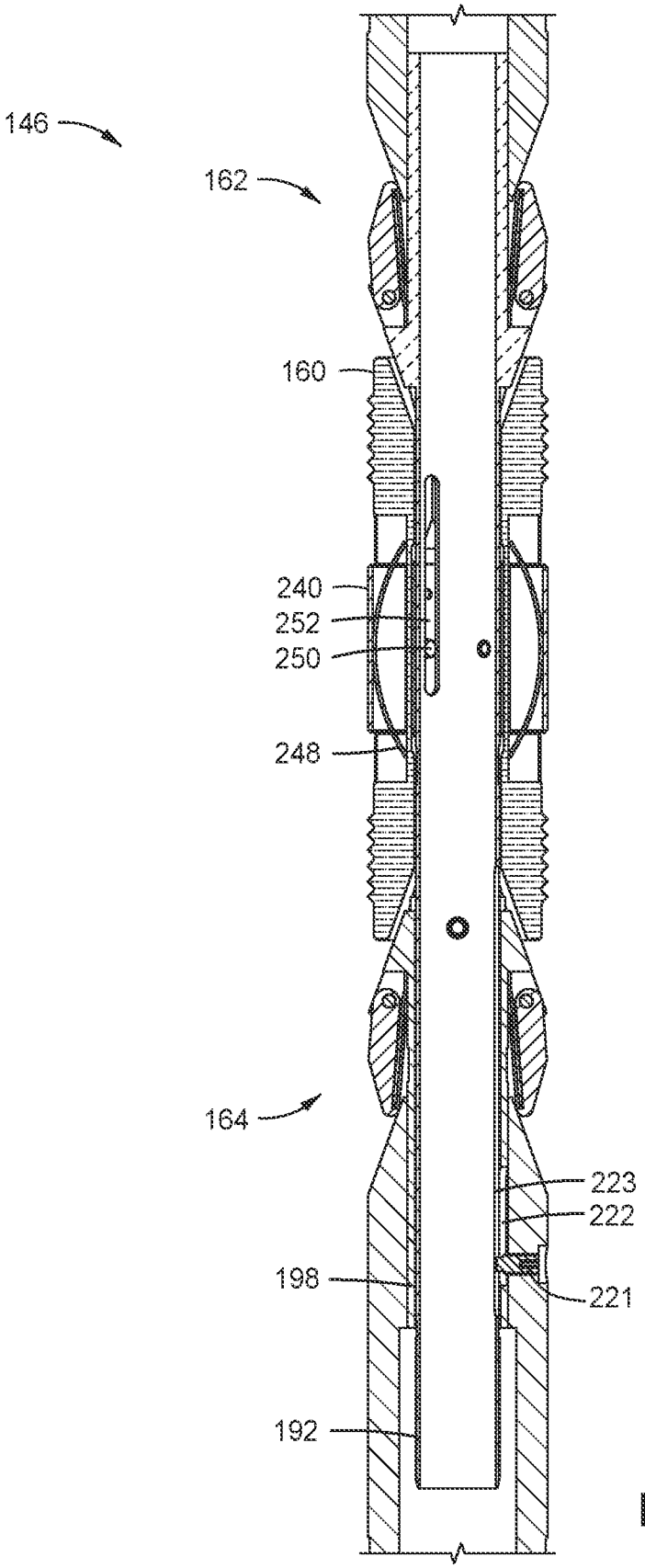
FIG. 4B is a longitudinal cross-sectional view taken through the center of the slip assembly of FIG. 4A showing the slip assembly in a running configuration.
Figure 4C:
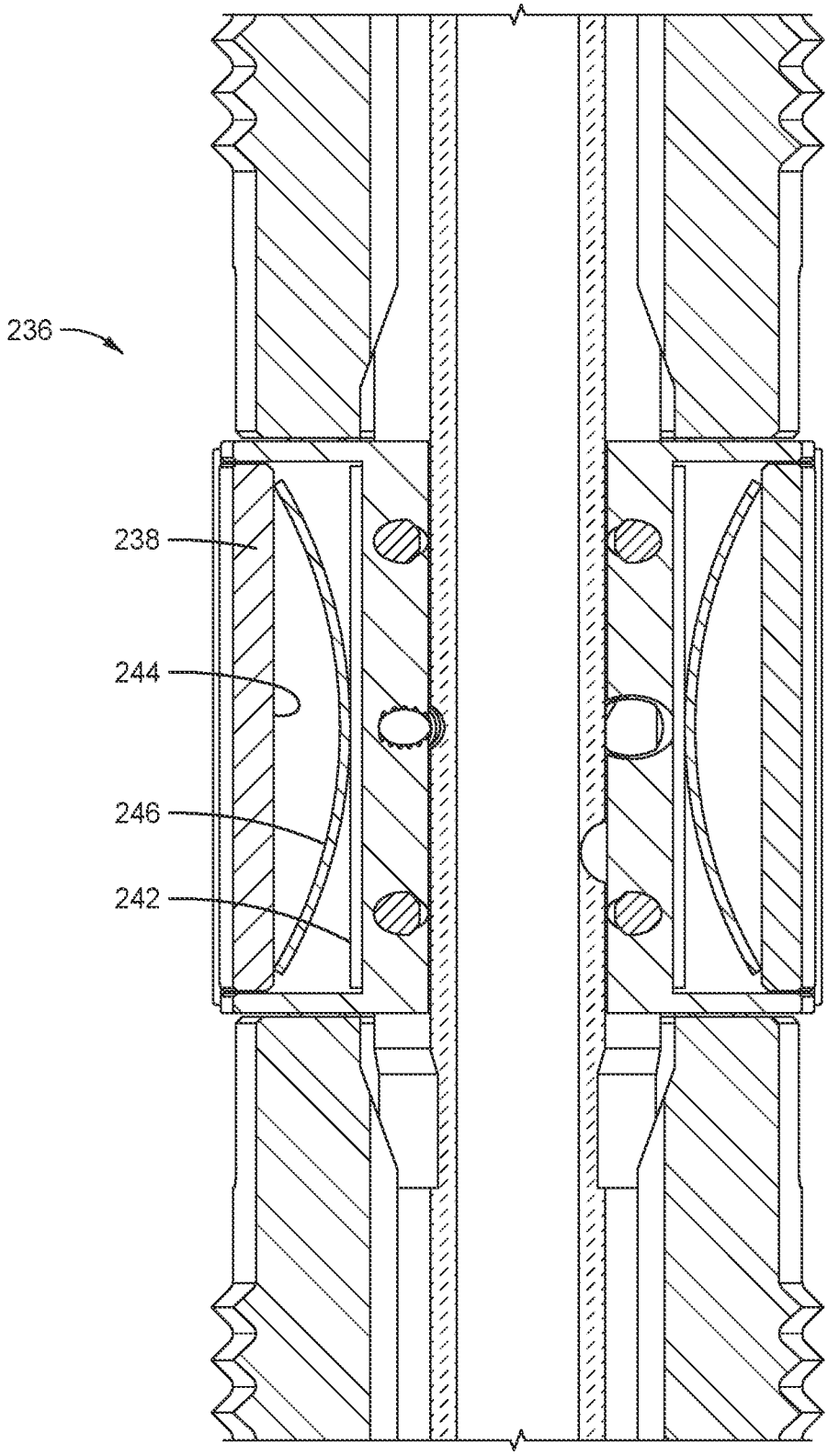
FIG. 4C is a longitudinal cross-sectional view of the slip cage of the slip assembly of FIG. 4A, that is offset from the center of the slip assembly.
Figure 4D:
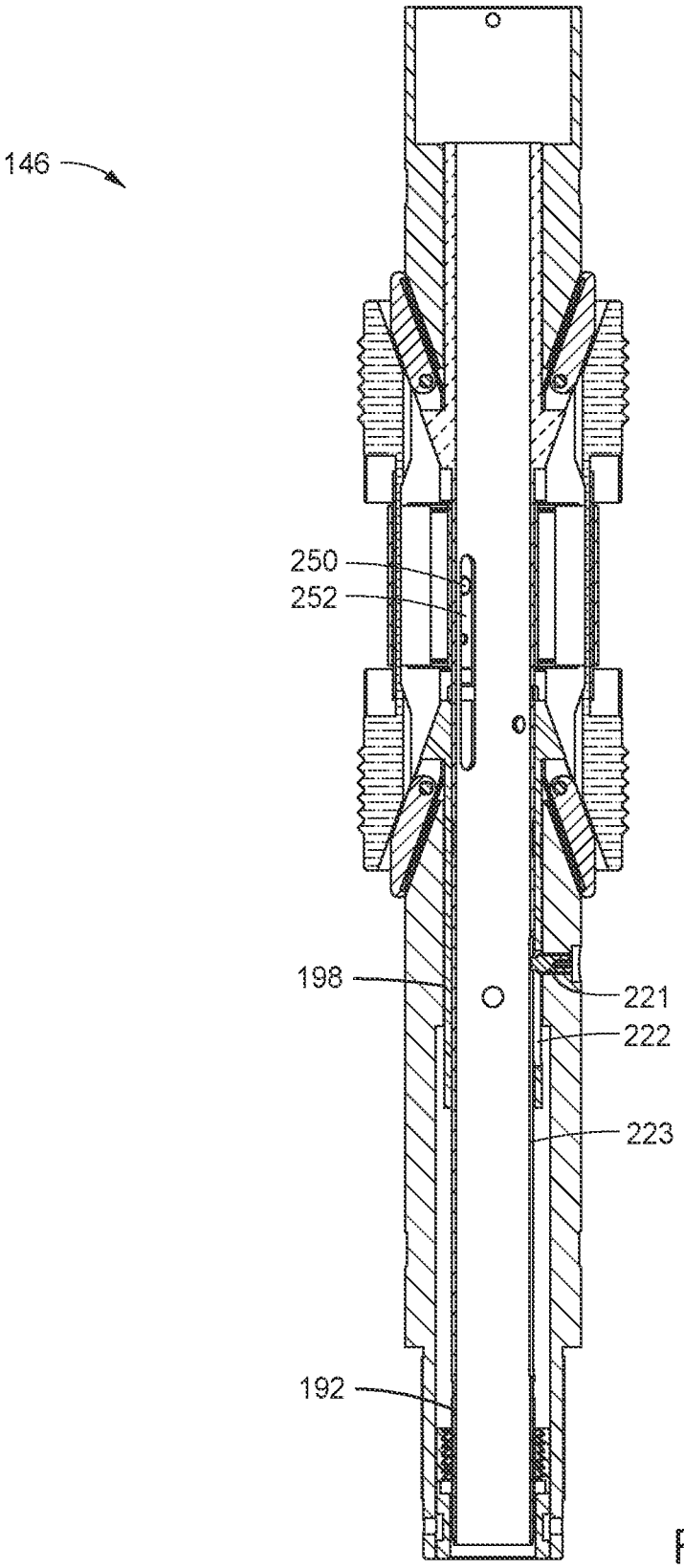
FIG. 4D is a longitudinal cross-sectional view taken through the center of the slip assembly of FIG. 4A showing the slip assembly in a set configuration.
Figure 4E:
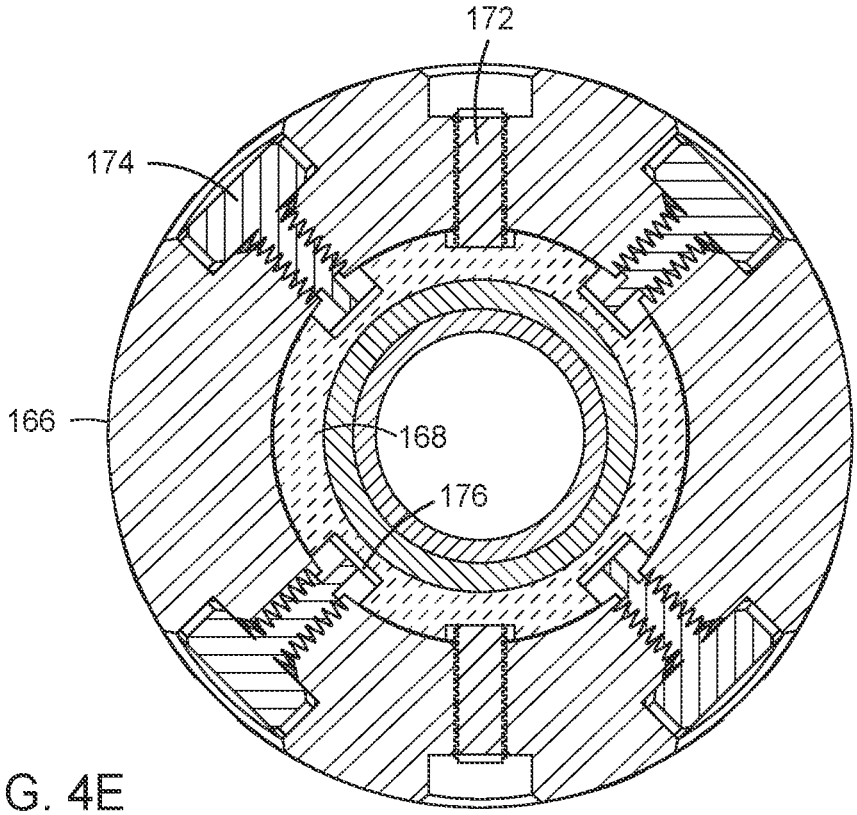
FIGS. 4E to 4G are lateral cross-sectional views of the slip assembly of FIG. 4A.
Figure 4F:
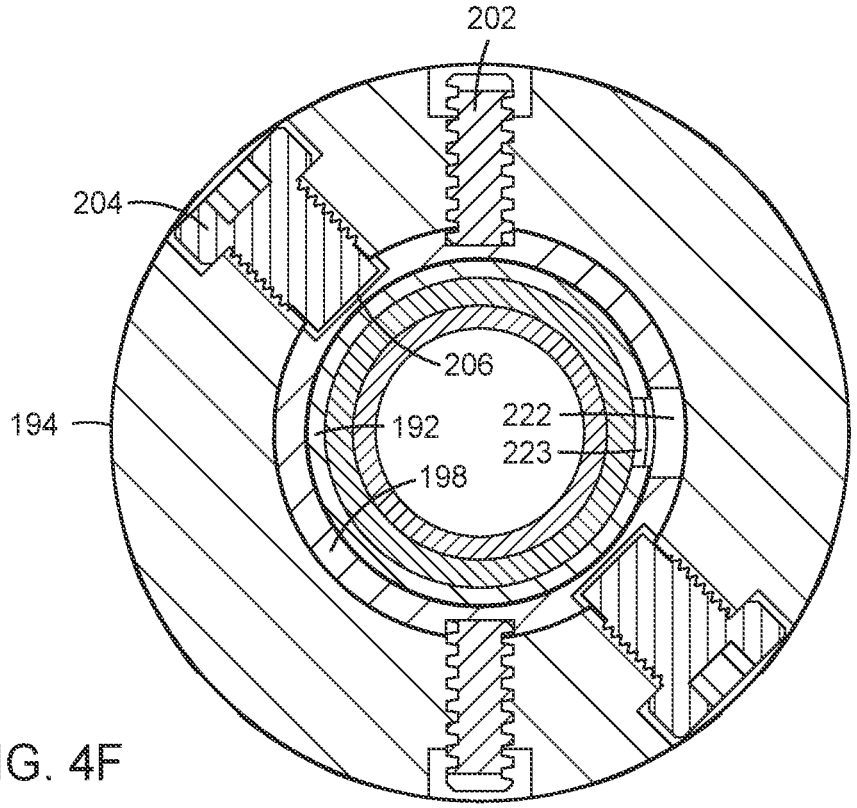

As shown in FIGS. 4B, 4D, and 4F, rotational alignment between the upper cone assembly 162 and the lower cone assembly 164 may be maintained by a key 221 in the lower support cone 194 that rides within a keyway 222 in the lower cone sleeve 198 and a keyway 223 in the slip mandrel 192.

Figure 4G:
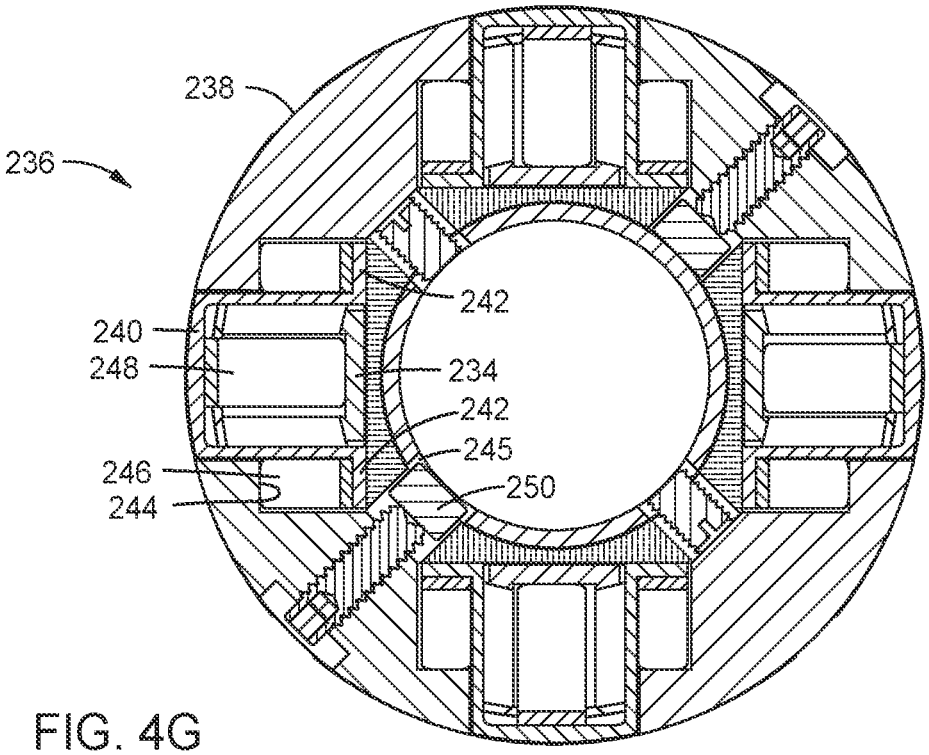
Figure 5A:
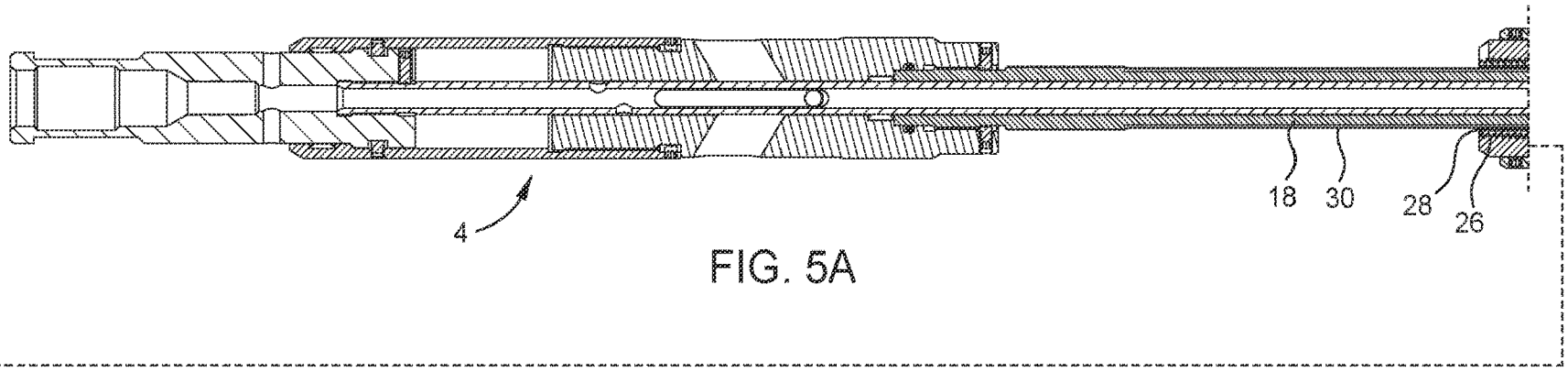
FIGS. 5A to 5F are views of the bridge plug of FIG. 1 after the slips have been set.
Figure 5B:
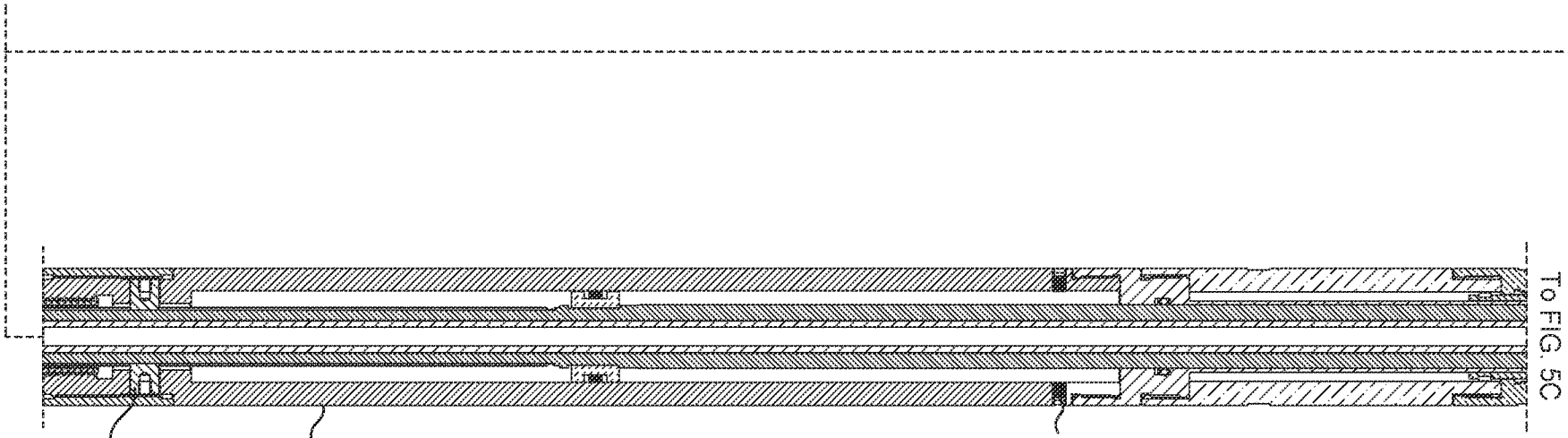
Figure 5C:
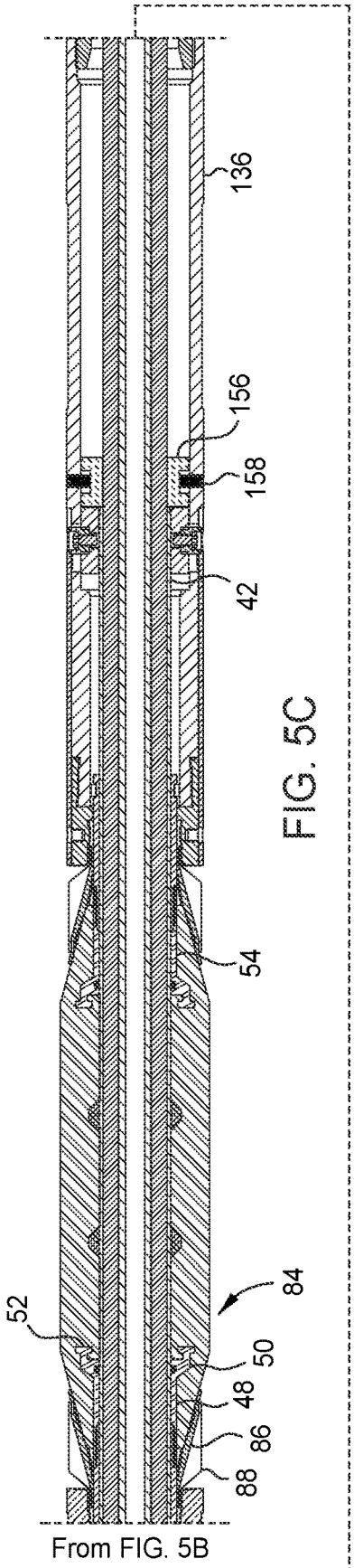
Figure 5D:
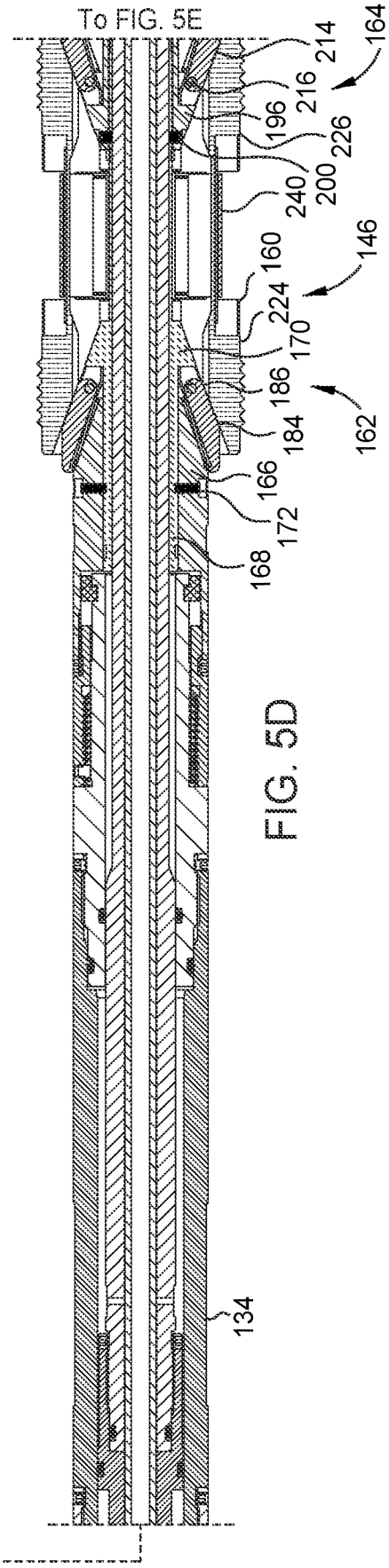
Figure 5E:
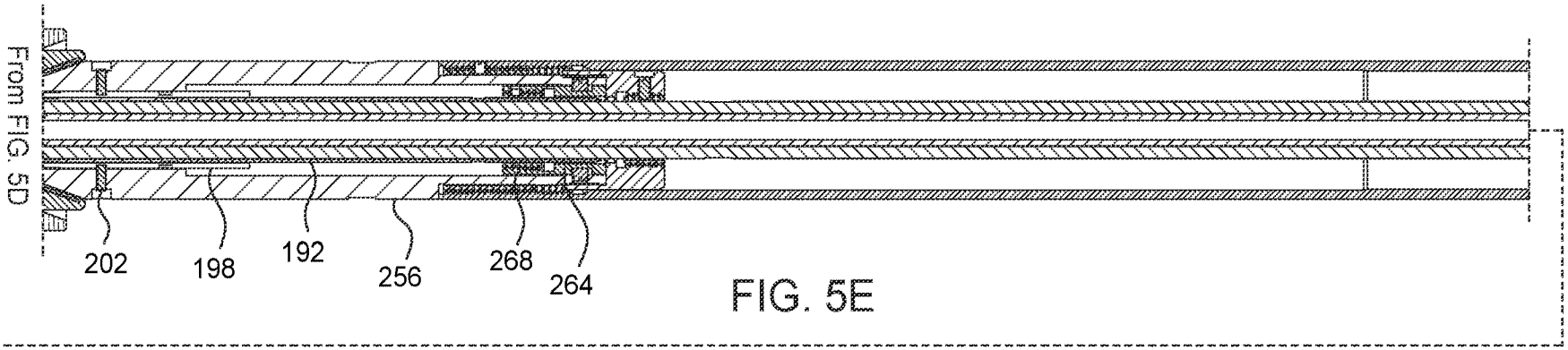
Figure 5F:
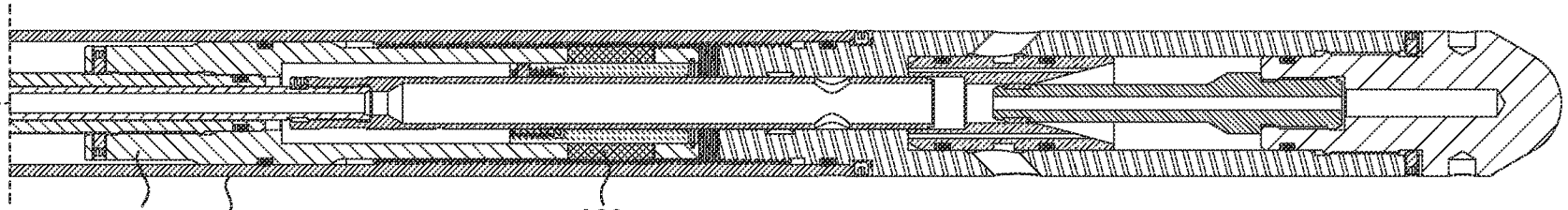

Each slip member 160 may have a shank 234 between the upper gripper 224 and the lower gripper 226. The shank 234 may be at least partially contained within a slip cage 236. The slip cage 236 may include a slip cage body 238. One or more retainer 240 may be disposed in a radial opening in the slip cage body 238. Each retainer 240 may be movable with respect to the slip cage body 238 between retracted and extended positions. As best seen in FIGS. 4A and 4G, each retainer 240 may have a generally "U" shaped profile with one or more flange 242 at the ends of the "U" profile. Each retainer 240 may have a flange 242 at each end of the "U"

profile. Each flange 242 may be disposed within the slip cage body 238, and may be configured to interact with a corresponding shoulder 244 in the slip cage body 238. A biasing member 246, such as a spring or a mass of resilient deformable material, such as an elastomer, may be disposed between each flange 242 and each corresponding shoulder 244. Each retainer 240 may be biased towards the retracted position by the biasing member(s) 246. The shank 234 of each slip member 160 may be disposed between the slip cage body 238 and a corresponding retainer 240. For example, the shank 234 of each slip member 160 may be disposed within the "U" profile of a corresponding retainer 240. A biasing member 248, such as a spring or a mass of resilient deformable material, such as an elastomer, may be disposed between each shank 234 and the base of each "U" profile of a corresponding retainer 240. Each shank 234, and therefore each slip member 160, may be biased towards the retracted position by each biasing member 248.

When the bridge plug 2 transitions from the running configuration to the set configuration, each slip member 160 may move from the retracted position to the extended position and each retainer 240 may move from the retracted position to the extended position. When the bridge plug 2 transitions from the set configuration to the released configuration, each slip member 160 may move from the extended position to the retracted position and each retainer 240 may move from the extended position to the retracted position.

As shown in FIGS. 4B, 4D, and 4G, one or more key 250 may couple the slip cage 236 with the slip mandrel 192. Each key 250 may protrude into a corresponding slot 252 in the slip mandrel 192. The interaction between each key 250 and corresponding slot 252 may inhibit relative rotation between the slip cage 236 and the slip mandrel 192. Thus, rotational alignment between each slip member 160 and each of the upper and lower base cone faces 180, 210 plus the upper and lower extension ramps 184, 214 may be maintained.

Setting/Release Mechanisms

The slip assembly 146 may be coupled to one or more mechanism, such as a setting mechanism and/or a release mechanism. The one or more mechanism may be actuated during transition of the bridge plug 2 from the running configuration to the set configuration. The one or more mechanism may be actuated during the transition of the bridge plug 2 from the set configuration to the released configuration.

Figure 3:
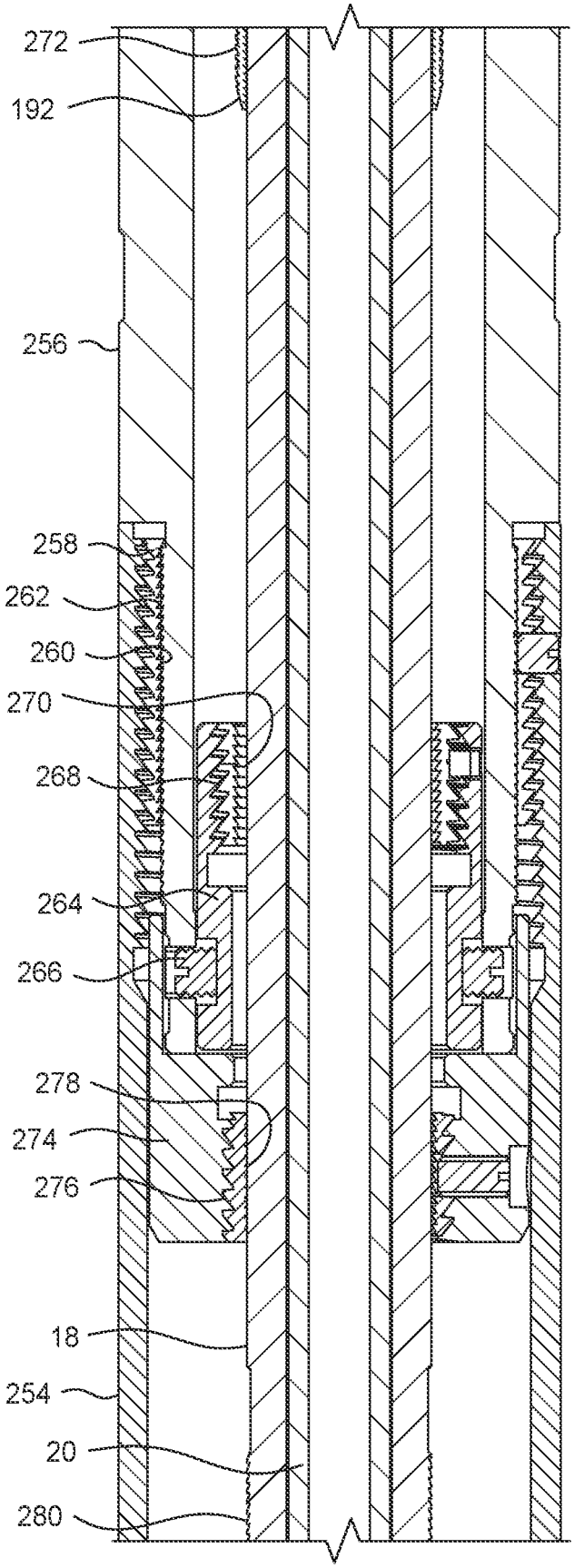
FIG. 3 focuses on a portion of the bridge plug of FIG. 1 as depicted in FIG. 1E.

The slip assembly 146 may be coupled to a release housing 254. The coupling may be between a slip assembly connector 256 and the release housing 254. In some embodiments, the slip assembly connector 256 may be part of the lower support cone 194. In some embodiments, the slip assembly connector 256 may be coupled to the lower support cone 194. With reference to FIG. 3, the coupling between the release housing 254 and the slip assembly connector 256 may include a lock ring 258. The lock ring 258 may include ratchet teeth 260 that are configured to engage with corresponding ratchet teeth 262 on the slip assembly connector 256. The lock ring 258 may be configured to permit the slip assembly connector 256 to move upwards with respect to the release housing 254, but prevent the slip assembly connector 256 from moving downwards with respect to the release housing 254.

Still referring to FIG. 3, the slip assembly connector 256 may be disposed about a shear sub 264. The shear sub 264 may be configured to be a secondary release mechanism that maintains the slip assembly 146 in the set configuration until the packer assembly 40 has transitioned to the released configuration. The shear sub 264 may be coupled to the slip assembly connector 256 by a fastener 266, such as a latch, locking dog, collet, snap ring, shear ring, shear screw, shear pin, or the like. The shear sub 264 may be disposed about the central mandrel 18 such that sufficient space exists for an end of the slip mandrel 192 to move into a position between the shear sub 264 and the central mandrel 18. The shear sub 264 may be configured to couple to the slip mandrel 192 during operation of the bridge plug 2. The coupling between the shear sub 264 and the slip mandrel 192 may include a lock ring 268. The lock ring 268 may include ratchet teeth 270 that are configured to engage with corresponding ratchet teeth 272 on the slip mandrel 192. The lock ring 268 may be configured to permit the slip mandrel 192 to move downwards with respect to the shear sub 264, but prevent the slip mandrel 192 from moving upwards with respect to the shear sub 264.

Continuing with FIG. 3, the slip assembly connector 256 may be coupled to a lower cone retainer 274. The lower cone retainer 274 may be disposed within the release housing 254 and about the central mandrel 18. The lower cone retainer 274 may be configured to couple to the central mandrel 18 during operation of the bridge plug 2. The coupling between the lower cone retainer 274 and the central mandrel 18 may include a lock ring 276. The lock ring 276 may include ratchet teeth 278 that are configured to engage with corresponding ratchet teeth 280 on the central mandrel 18. The lock ring 276 may be configured to permit the central mandrel 18 to move upwards with respect to the lower cone retainer 274, but prevent the central mandrel 18 from moving downwards with respect to the lower cone retainer 274.

Figure 1F:
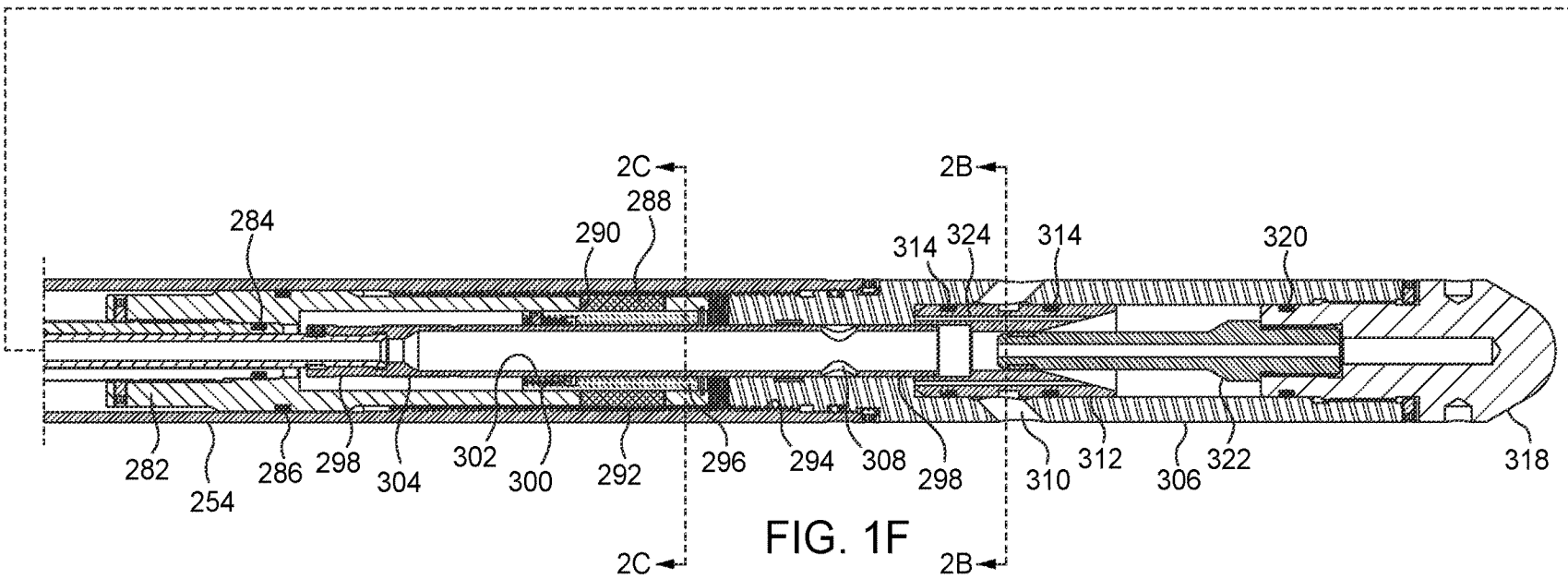

Now referring to FIGS. 1E-1F, the central mandrel 18 may extend into the release housing 254 and be coupled to a release sub 282. The release sub 282 may be contained within the release housing 254. One or more seal member 284 may provide a seal between the central mandrel 18 and the release sub 282. One or more seal member 286 may provide a seal between the release sub 282 and the release housing 254. One or more release lug 288 may be disposed within one or more corresponding slot 290 in the release sub 282. Each release lug 288 may have an external profile 292 that is configured to engage a corresponding internal profile 294 of the release housing 254. The engagement between each release lug 288 and the release housing 254 may inhibit axial movement of the release sub 282 with respect to the release housing 254. The one or more release lug 288 may be maintained in engagement with the release housing 254 by a support ring 296 disposed within the release sub 282. Referring to FIG. 2C, the release sub 282 may be temporarily connected to the support ring 296 by a fastener 297, such as a latch, locking dog, collet, snap ring, shear ring, shear screw, shear pin, or the like. The one or more release lug 288 and the support ring 296 may be configured as a primary release mechanism that maintains the packer assembly 40 in the set configuration until after pressure equalization across the packing element 44 has been facilitated.

The equalization mandrel 20 may extend through the central mandrel 18 into the release sub 282, and may be coupled to a release mandrel 298. The release mandrel 298 may extend through the support ring 296. The support ring 296 may be configured to couple to the release mandrel 298 during operation of the bridge plug 2. The coupling between the support ring 296 and the release mandrel 298 may include a lock ring 300. The lock ring 300 may include ratchet teeth 302 that are configured to engage with corresponding ratchet teeth 304 on the release mandrel 298. The lock ring 300 may be configured to permit the release mandrel 298 to move downwards with respect to the support ring 296, but prevent the release mandrel 298 from moving upwards with respect to the support ring 296.

The lower end of the release housing 254 may be coupled to a ported sub 306. The release mandrel 298 may extend into the ported sub 306, and may have one or more side port 308 at a lower end. The ported sub 306 may have one or more side port 310. As shown in FIGS. 1E-1F, when the bridge plug 2 is in the running configuration, the one or more side port 310 of the ported sub 306 may be obscured by an equalizing sleeve 312. One or more seal member 314 may inhibit fluidic communication through the one or more side port 310 of the ported sub 306 when the equalizing sleeve 312 is in the position as shown in FIGS. 1E-1F. As shown in FIG. 2B, the equalizing sleeve 312 may be temporarily held in the position shown in FIGS. 1E-1F by a fastener 316, such as a latch, locking dog, collet, snap ring, shear ring, shear screw, shear pin, or the like.

The ported sub 306 may be coupled to a bull nose 318. The bull nose 318 may be without any fluid communication ports. One or more seal member 320 may inhibit fluidic communication between the ported sub 306 and the bull nose 318. In some embodiments, instead of a bull nose 318, the ported sub 306 may be coupled to an alternative item of equipment, such as a tubular, a gauge carrier, a logging tool, a perforating gun, etc. As shown in FIGS. 1E-1F, the bull nose 318 may be coupled to a debris mandrel 322 within the ported sub 306. The debris mandrel 322 may extend from the bull nose 318 and into the equalizing sleeve 312. To facilitate axial movement of the equalizing sleeve 312 so as to uncover the one or more side port 310 of the ported sub 306, the equalizing sleeve 312 may have one or more relief bore 324. The relief bore 324 may prevent the occurrence of a pressure lock as the equalizing sleeve 312 moves axially over the debris mandrel 322 toward the bull nose 318.

Bridge Plug Operation

In the following descriptions, any recital of item A moving towards item B is to be interpreted to encompass item A moving towards item B that is itself moving in the same direction as item A, item A moving towards a stationary item B, item B moving towards item A that is itself moving in the same direction as item B, item B moving towards a stationary item A, and both items A and B moving towards each other. Similarly, any recital of item A moving away from item B is to be interpreted to encompass item A moving away from item B that is itself moving in the same direction as item A, item A moving away from a stationary item B, item B moving away from item A that is itself moving in the same direction as item B, item B moving away from a stationary item A, and both items A and B moving away from each other.

Details of the bridge plug 2 in the running configuration are shown in FIGS. 1A to 1F, and are described above. In an exemplary method, a setting tool (not shown) having a setting tool sleeve 6 (FIG. 1) may be coupled to the bridge plug 2. The bridge plug 2 may be inserted into a bore, such as a wellbore, a pipeline, or the like. Activation of the setting tool may involve applying a tensile axial force (that may be considered as a pull force) to the fishing neck 8 while applying a compressive axial force (that may be considered as a push force) to the setting sleeve 24.

Slip Assembly Setting

The following description highlights at least some of the changes to occur in transitioning from the configuration shown in FIGS. 1A to 1F to the configuration shown in FIGS. 5A to 5F. As illustrated, the setting sleeve 24 has moved axially away from the setting tool adaptor 4. Each key 36 has slid within a corresponding slot 38, and the ratchet teeth 28 of the lock ring 26 have moved along, and remain engaged with, the ratchet teeth 30 on the central mandrel 18. The one or more fastener 32 coupling the central mandrel 18 to the setting sleeve 24 has been defeated, such as by shearing.

Axial movement of the setting sleeve 24 has resulted in axial movement of the packer mandrel 42. The lower end of the packer mandrel 42 has engaged the slip setting ring 156. Because the one or more fastener 158 coupling the slip setting ring 156 to the boost housing extension 136 has not been defeated, axial force exerted by the packer mandrel 42 on the slip setting ring 156 has been transferred to the boost housing extension 136 and to the boost housing 134.

The axial force on the boost housing 134 has caused the slip assembly 146 to transition into the set configuration. The one or more fastener 172 coupling the upper support cone 166 to the upper cone sleeve 168 has been defeated, such as by shearing, and the upper support cone 166 has moved towards the upper base cone 170. Each upper extension ramp 184 has ridden along the cone face 178 of the upper support cone 166 from a retracted position to an extended position; each upper extension ramp 184 having pivoted about a respective pin or hinge 186. The one or more fastener 202 coupling the lower support cone 194 to the lower cone sleeve 198 has been defeated, such as by shearing, and the lower support cone 194 has moved towards the lower base cone 196. Each lower extension ramp 214 has ridden along the cone face 208 of the lower support cone 194 from a retracted position to an extended position; each lower extension ramp 214 having pivoted about a respective pin or hinge 216.

Additionally, the one or more fastener 200 coupling the lower base cone 196 to the slip mandrel 192 has been defeated, such as by shearing, and the upper cone assembly 162 has moved towards the lower cone assembly 164. The sloped inner surface 230 of the upper gripper 224 of each slip member 160 has ridden along the cone face 180 of the upper base cone 170 and along a respective upper extension ramp 184. The sloped inner surface 232 of the lower gripper 226 of each slip member 160 has ridden along the cone face 210 of the lower base cone 196 and along a respective lower extension ramp 214. Hence, each slip member 160 has moved radially outwards and into a set position. As illustrated, each retainer 240 has also moved radially outwards to an extended position as a result of each slip member 160 moving radially outwards. Thus, in embodiments in which the bridge plug 2 had been installed in a bore (such as a wellbore or pipeline), the slip assembly 146 is now in a set configuration in the bore, and may provide an anchor against further axial movement of the bridge plug 2.

Because the upper cone assembly 162 has moved towards the lower cone assembly 164, the lower end of the slip mandrel 192 is now engaged with the lock ring 268 of the shear sub 264. The relative movement between the upper cone assembly 162 and the lower cone assembly 164 has been achieved because of the opposing axial tensile and compressive forces applied by the setting tool. The axial tensile force applied to the central mandrel 18 has transferred through the release sub 282, the one or more release lug 288, the release housing 254, the slip assembly connector 256, and to the lower support cone 194. The axial compressive force applied to the setting sleeve 24 has transferred through the packer mandrel 42, the boost housing extension 136, the boost housing 134, and to the upper support cone 166.

Packer Assembly Setting

The following description highlights at least some of the changes to occur in transitioning from the configuration shown in FIGS. 5A to 5F to the configuration shown in FIGS. 6A to 6F. As illustrated, the setting sleeve 24 has moved further axially away from the setting tool adaptor 4. Each key 36 has slid within a corresponding slot 38, and the ratchet teeth 28 of the lock ring 26 have moved along, and remain engaged with, the ratchet teeth 30 on the central mandrel 18.

The lower end of the packer mandrel 42 that had engaged the slip setting ring 156 applied an axial force in one direction, whereas the boost housing extension 136 and boost housing 134 were unable to move in the direction of the axial force because the slip assembly 146 had been set, thereby providing an anchor resisting movement. Thus, the boost housing extension 136 resisted the force applied by the packer mandrel 42 through the slip setting ring 156, resulting in the one or more fastener 158 coupling the slip setting ring 156 to the boost housing extension 136 being defeated, such as by shearing. Hence, the upper backup sleeve 61 has moved towards the lower backup sleeve 63, resulting in the packing element 44 becoming axially compressed.

Figure 6A:
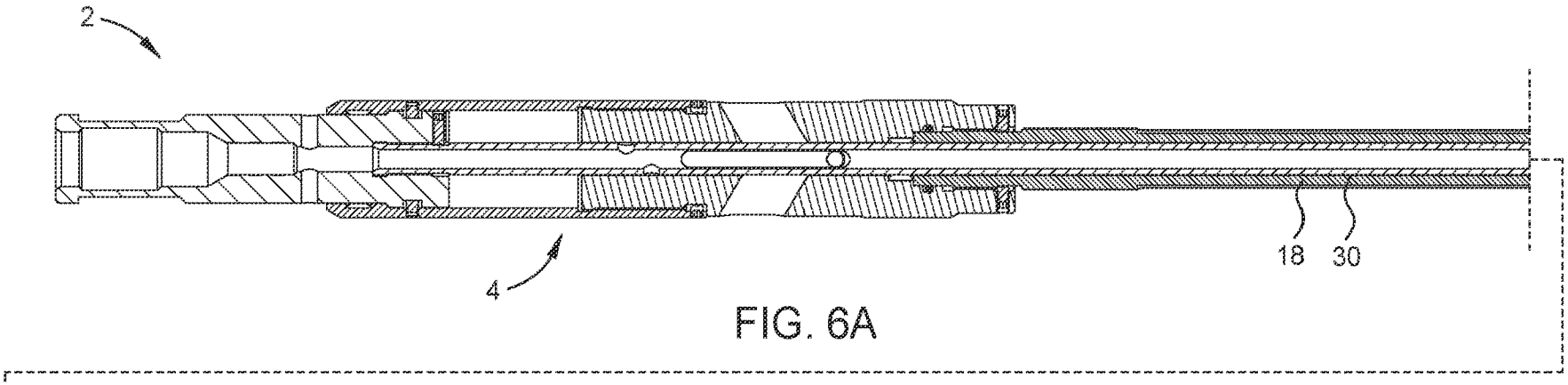
FIGS. 6A to 6F are views of the bridge plug of FIG. 1 after the packing element has been set.
Figure 6B:
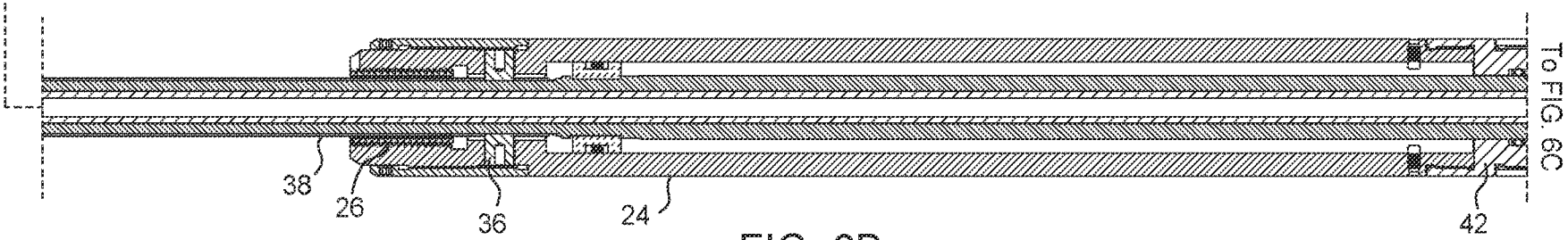
Figure 6C:
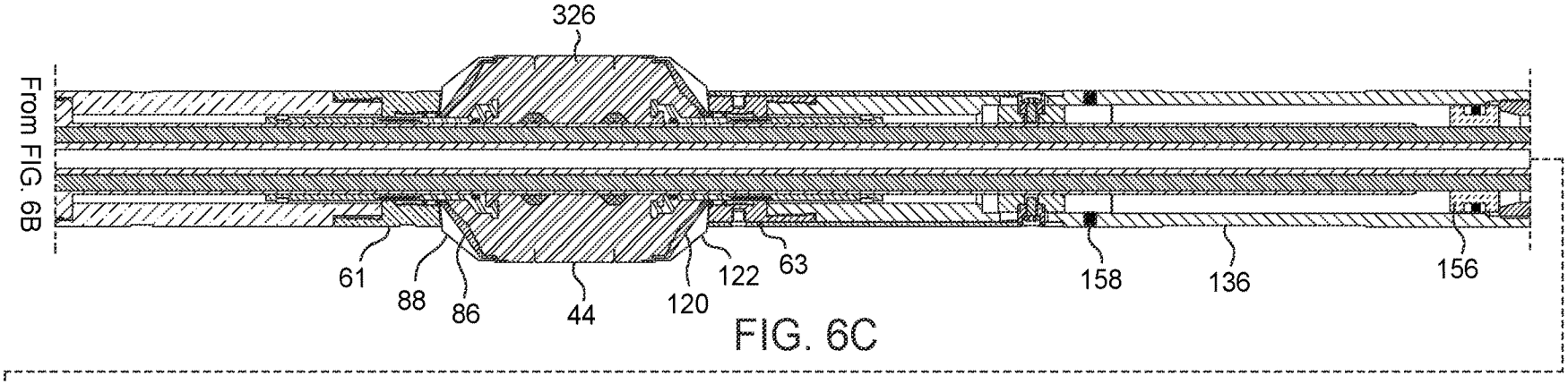
Figure 6D:
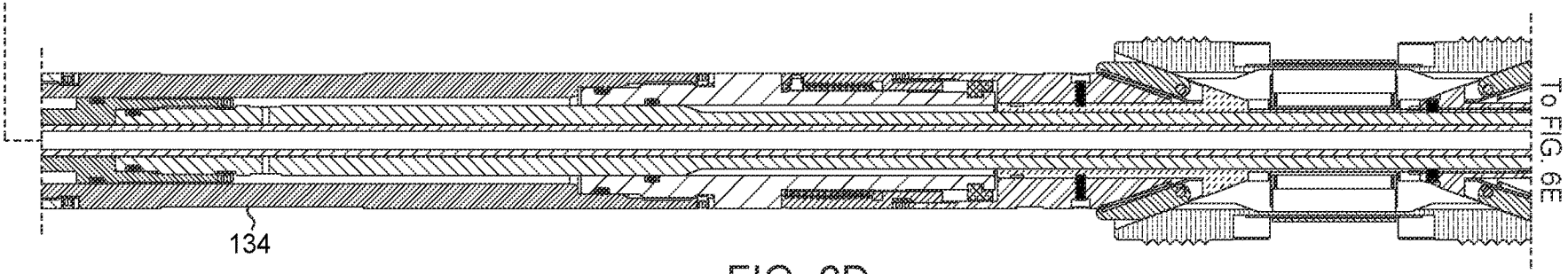
Figure 6E:
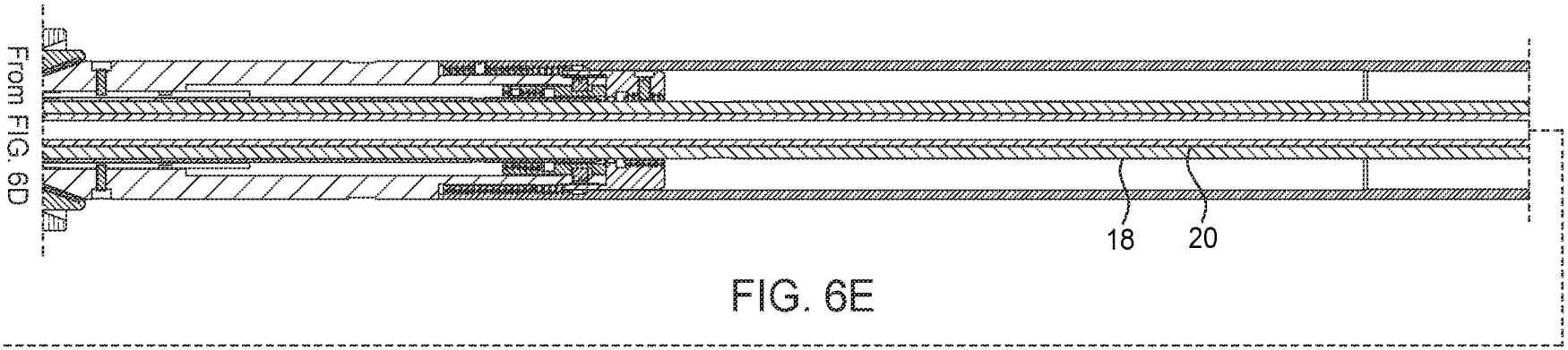
Figure 6F:
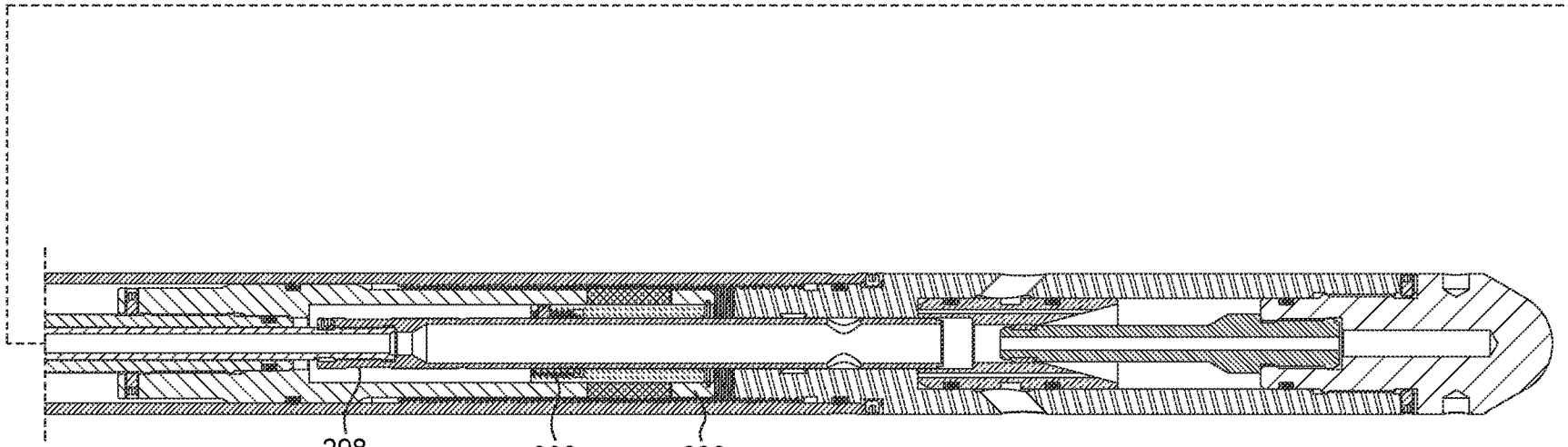
Figure 7A:
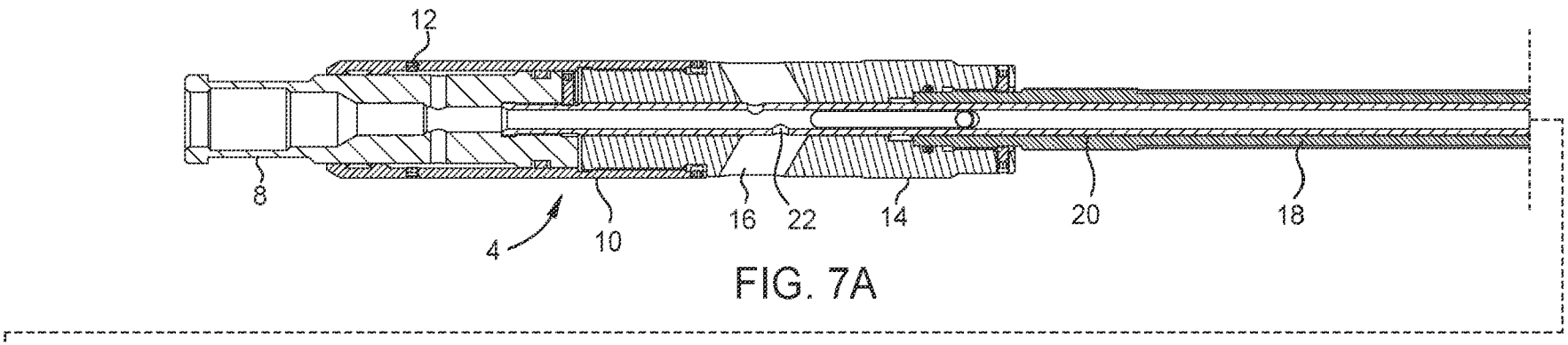
FIGS. 7A to 7F are views of the bridge plug of FIG. 1 in the pressure equalization configuration.
Figure 7B:
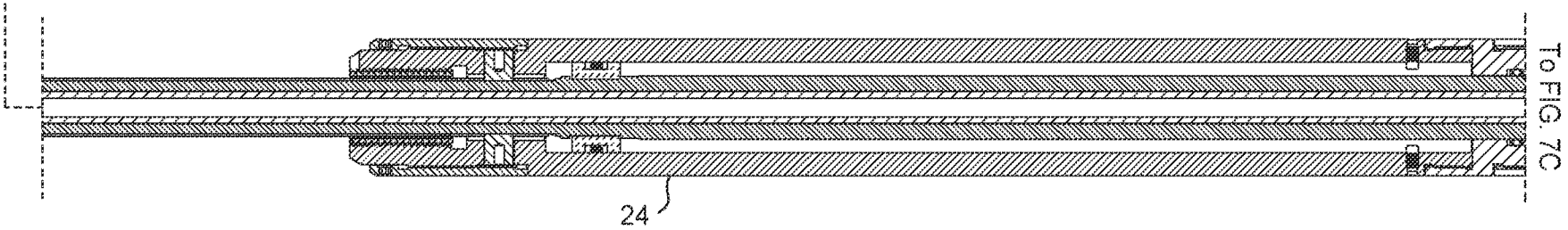
Figure 7C:
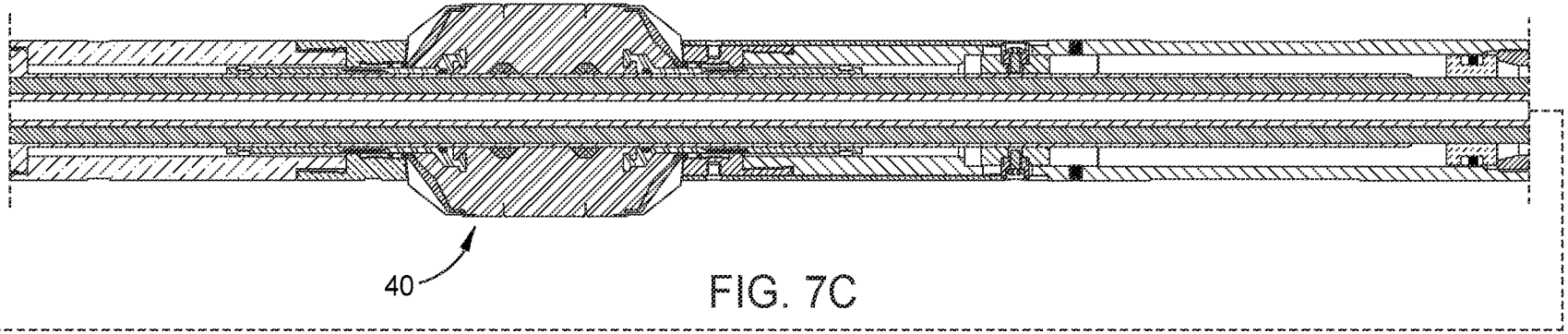
Figure 7D:
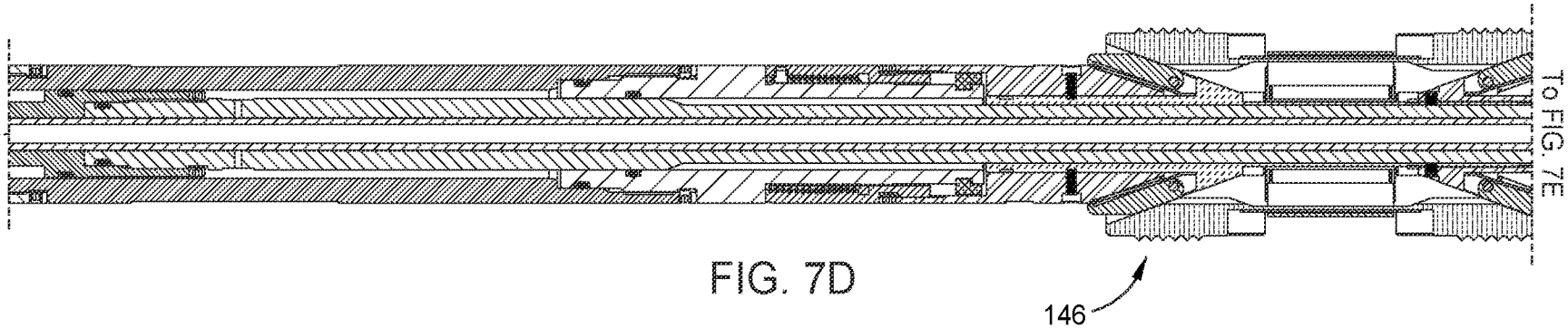
Figure 7E:
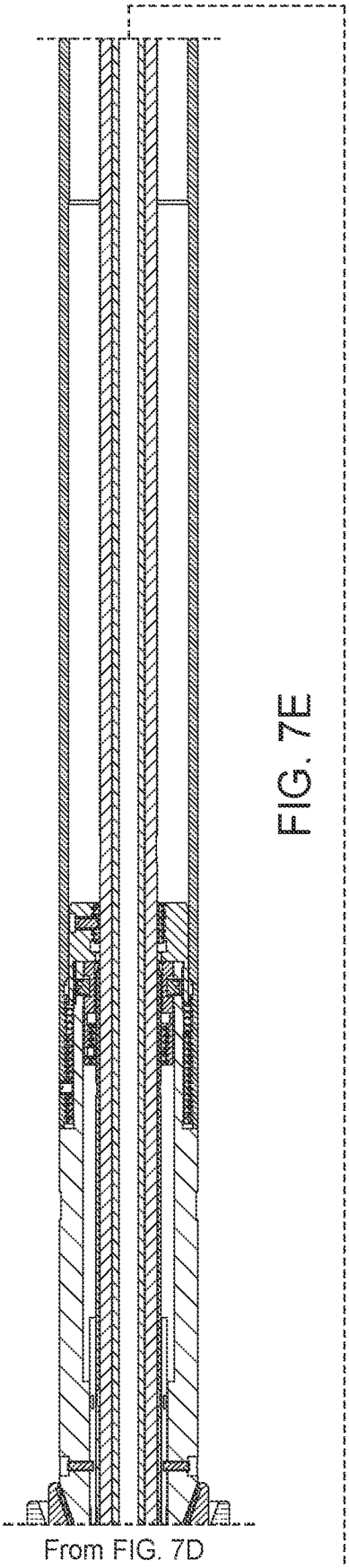
Figure 7F:
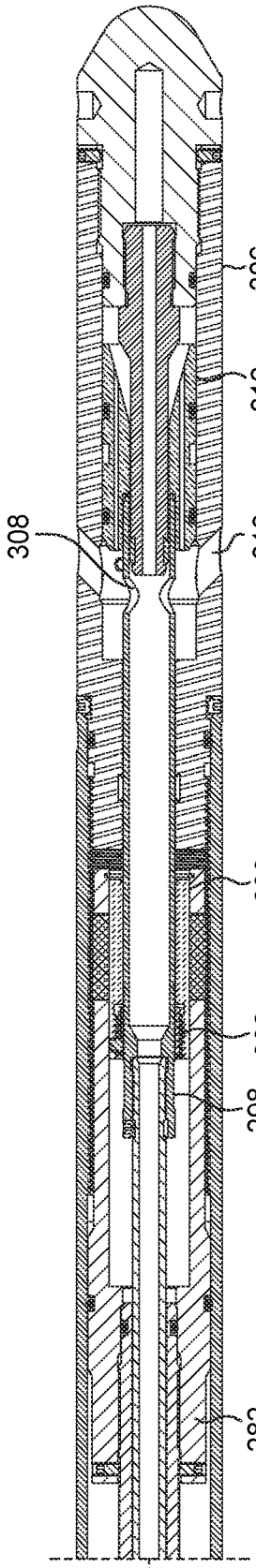
Figure 8A:
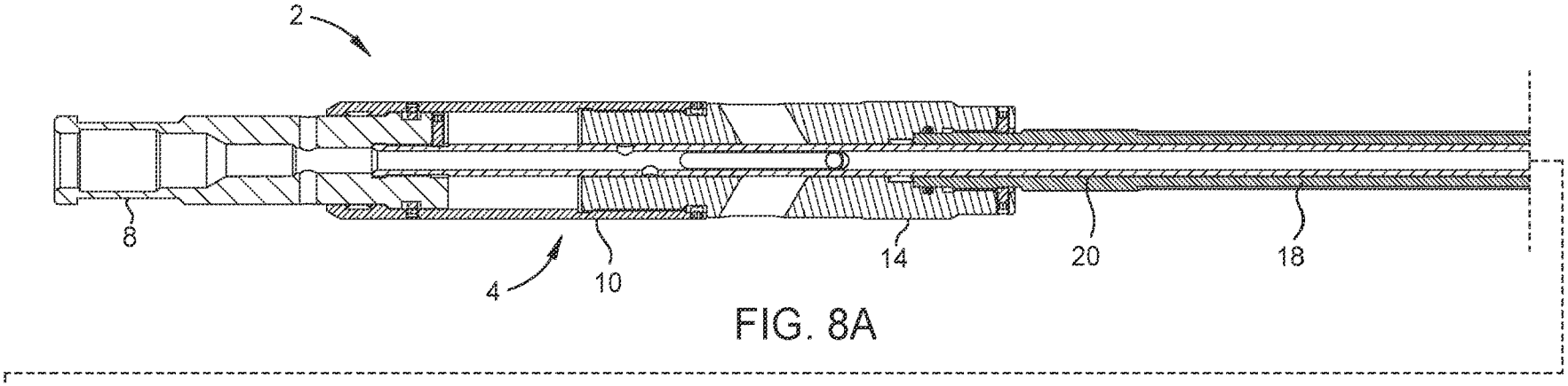
FIGS. 8A to 8F are views of the bridge plug FIG. 1 in an initial stage of release of the bridge plug.
Figure 8B:
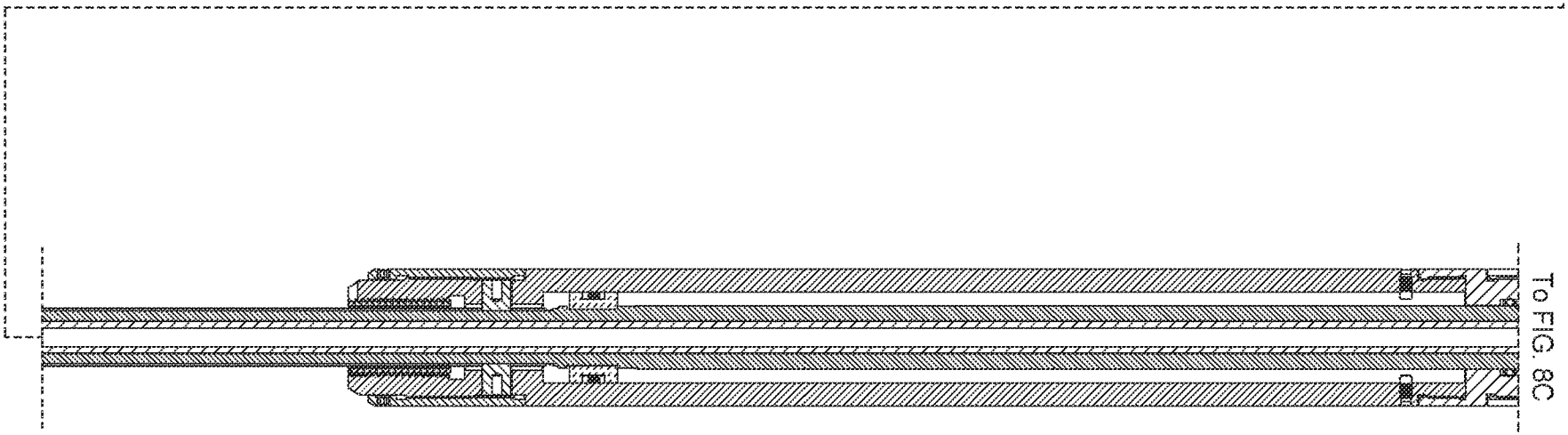
Figure 8C:
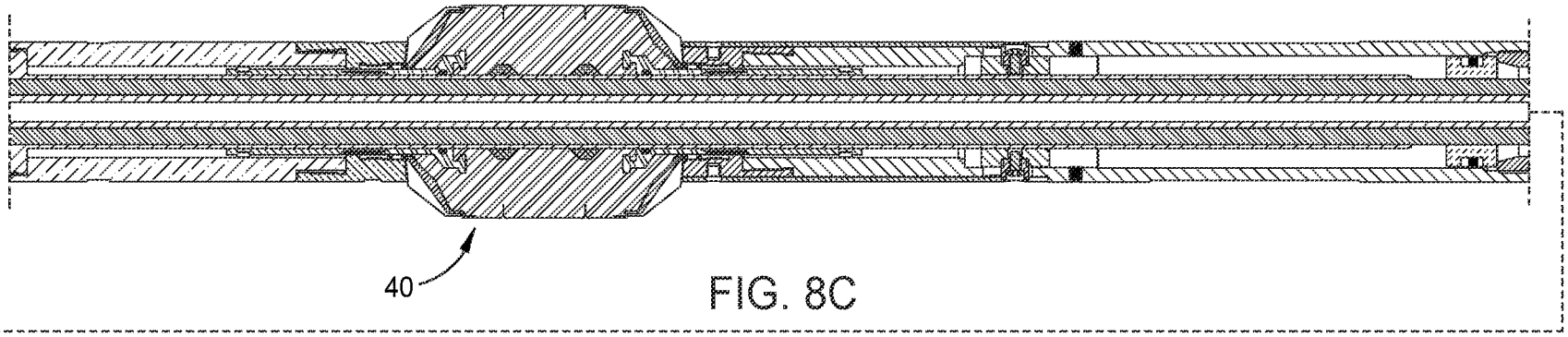
Figure 8D:
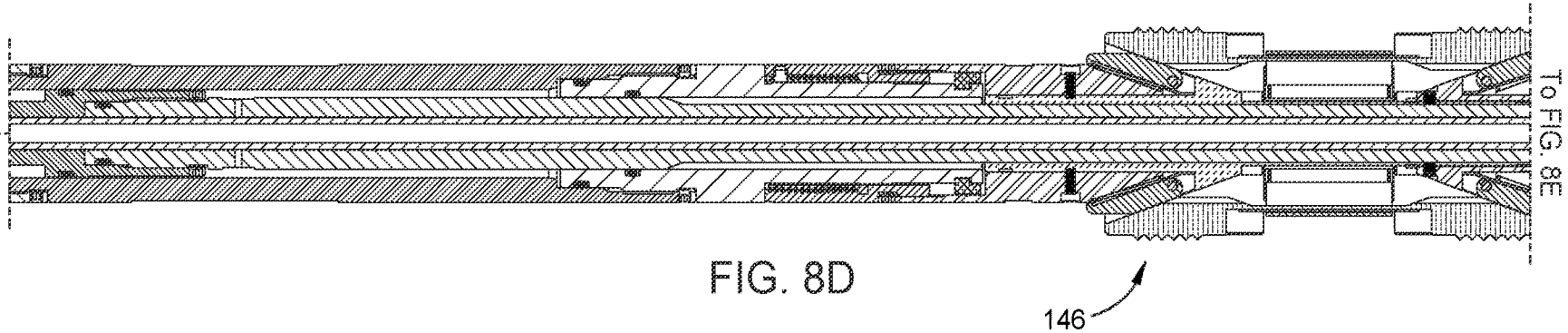
Figure 8E:
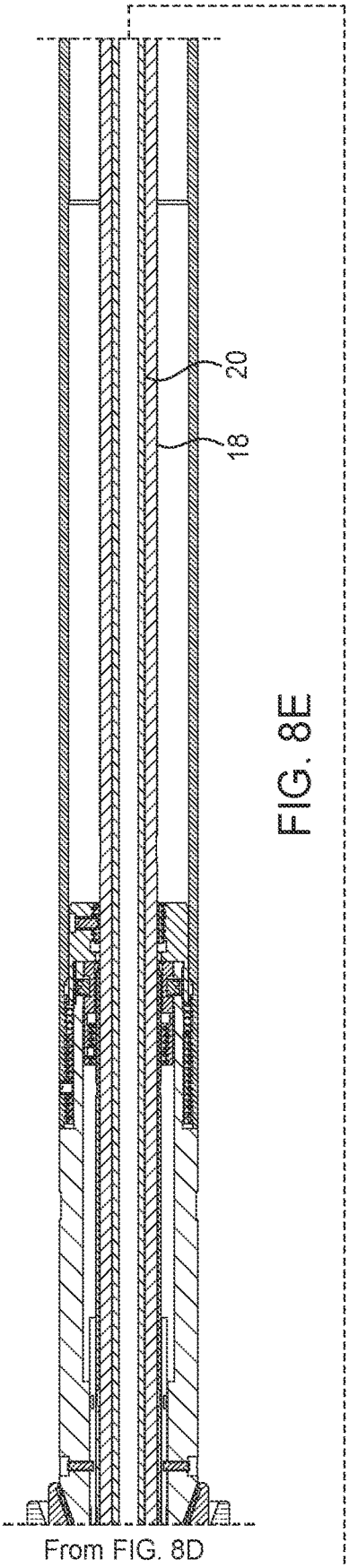
Figure 8F:
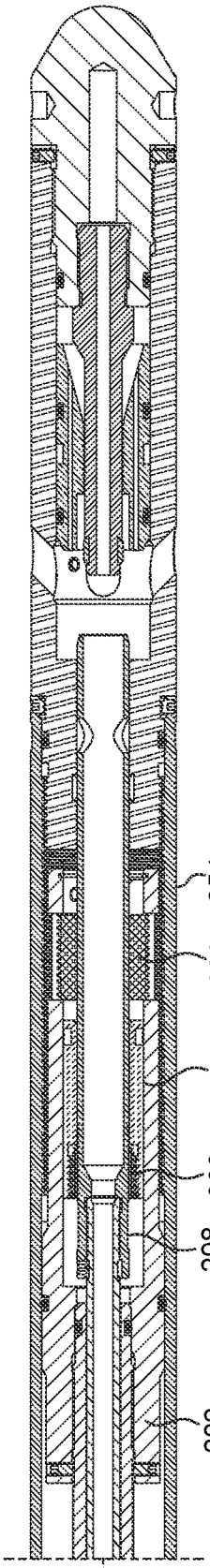
Figure 9A:
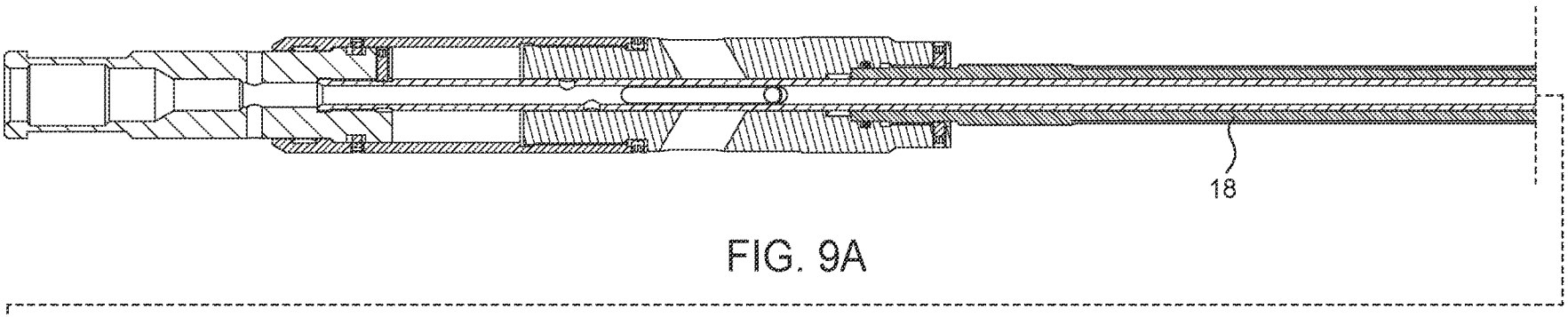
FIGS. 9A to 9F are views of the bridge plug of FIG. 1 in a subsequent stage of release.
Figure 9B:
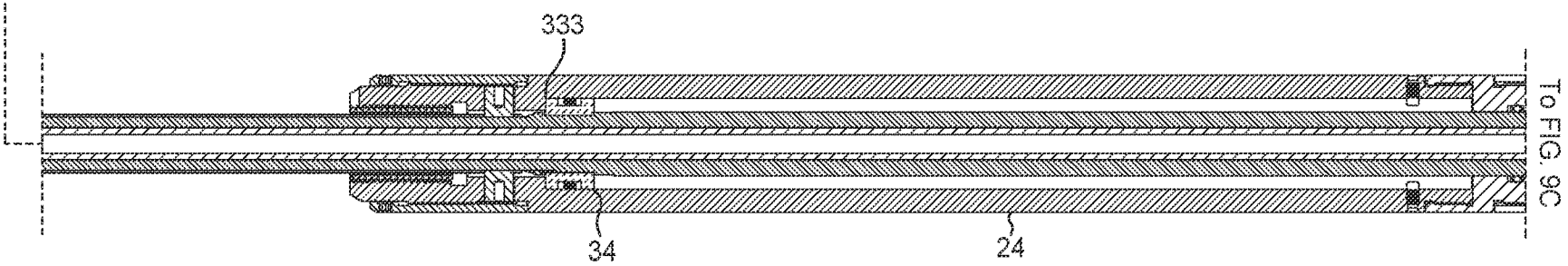
Figure 9C:
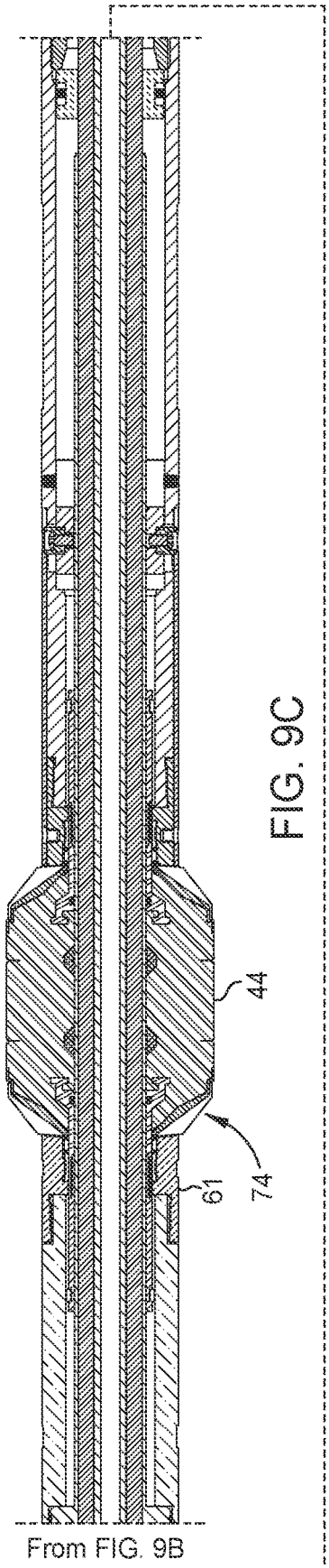
Figure 9D:
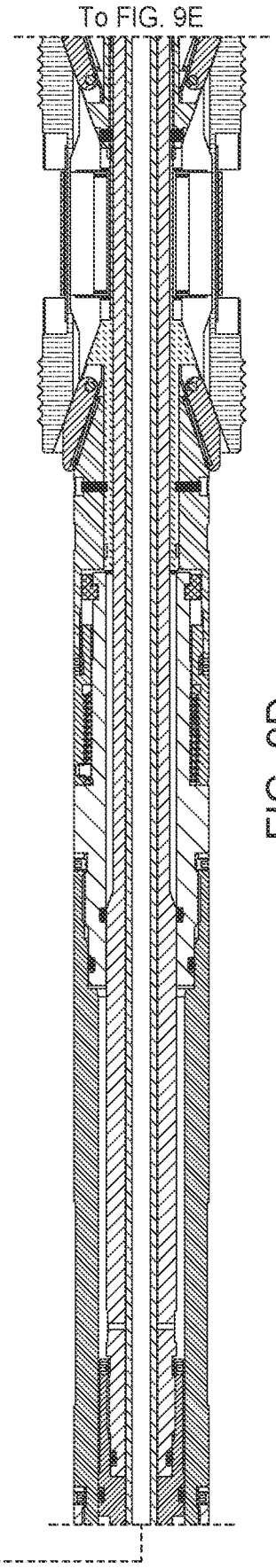
Figure 9E:
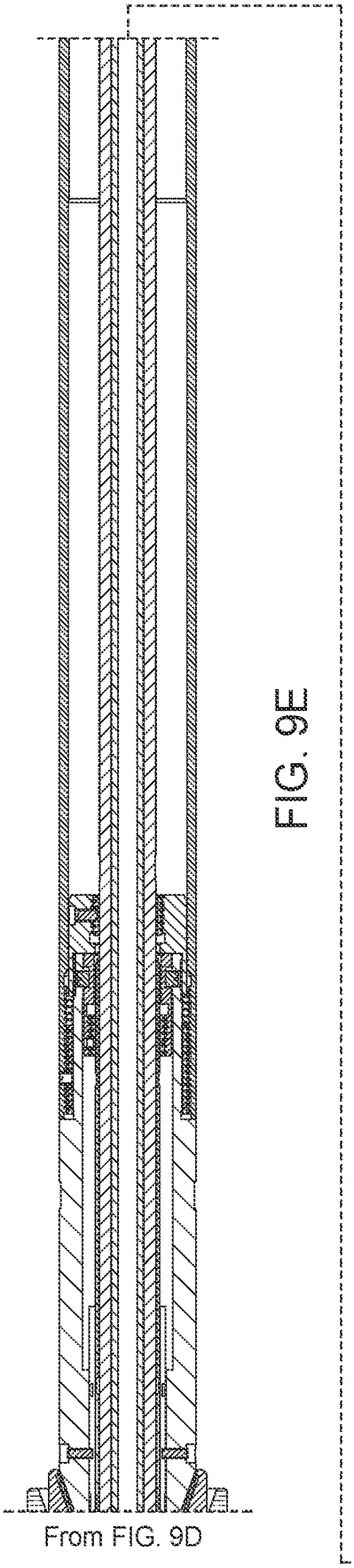
Figure 9F:
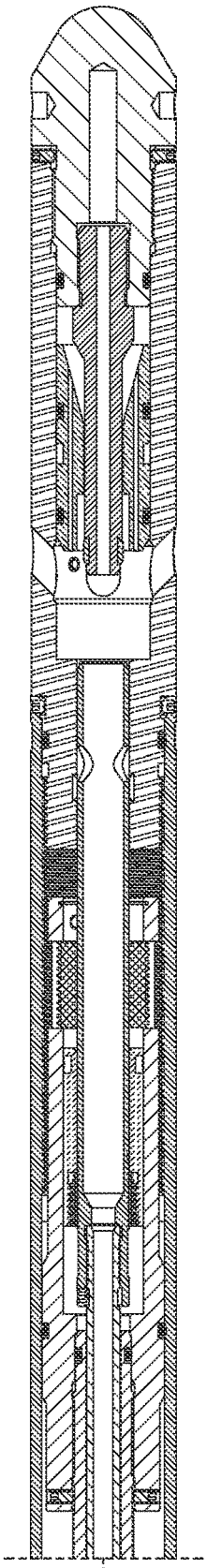
Figure 10A:
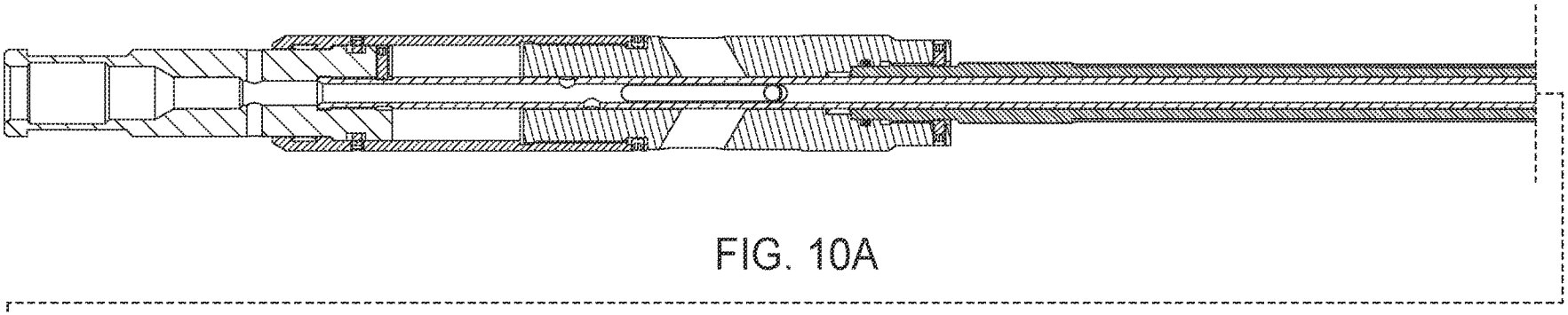
FIGS. 10A to 10F are views of the bridge plug of FIG. 1 in a subsequent stage of release.
Figure 10B:
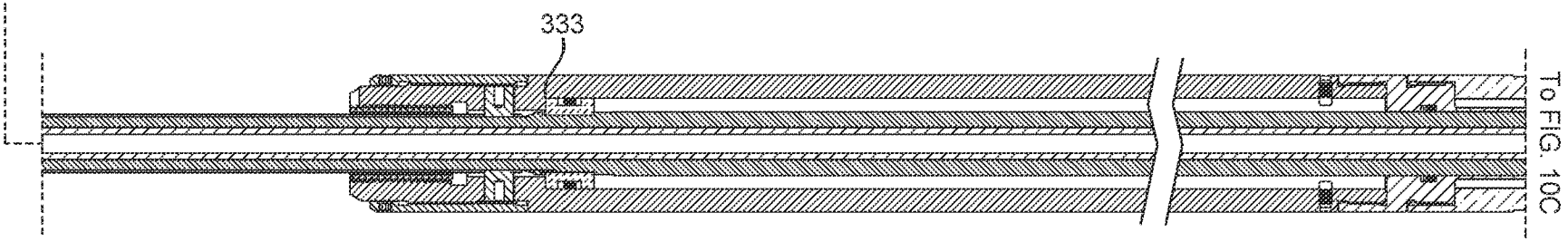
Figure 10C:
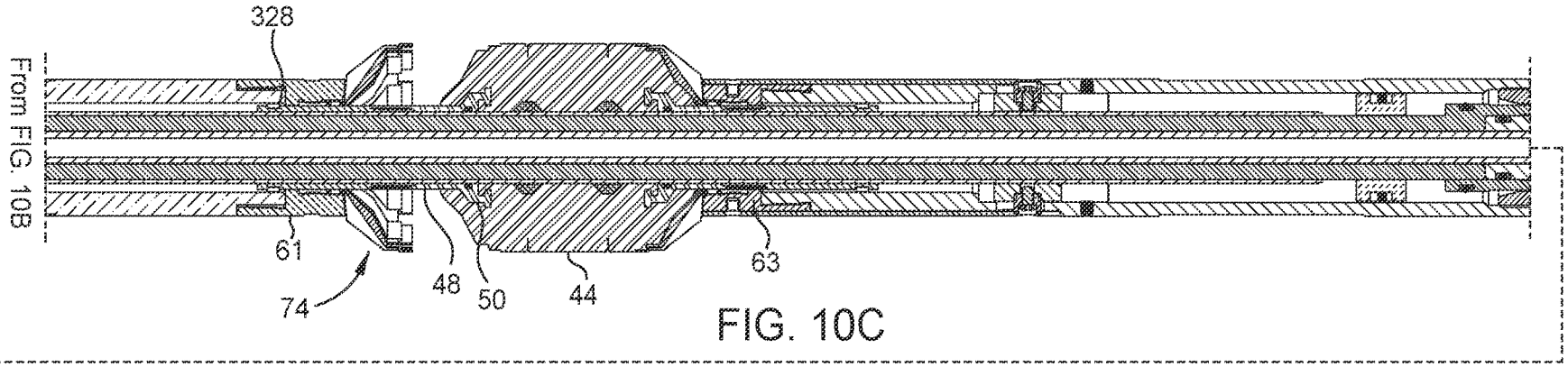
Figure 10D:
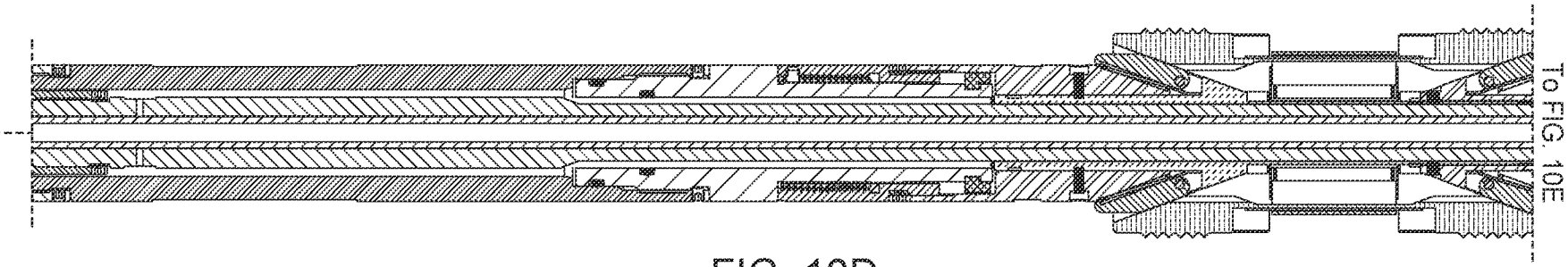
Figure 10E:
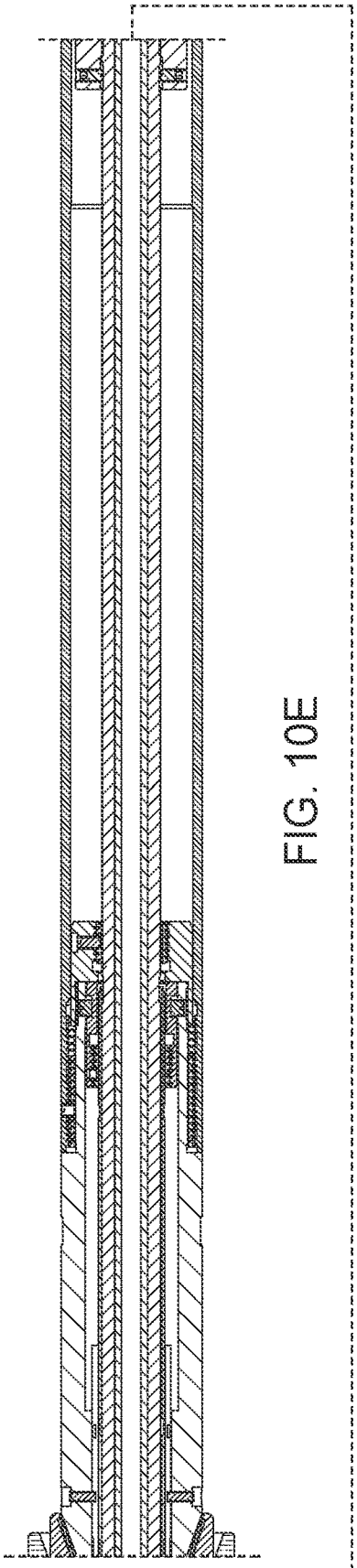
Figure 10F:
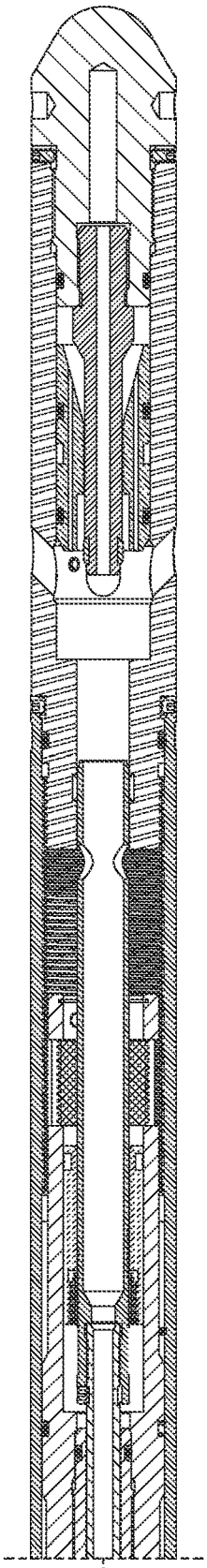
Figure 11A:
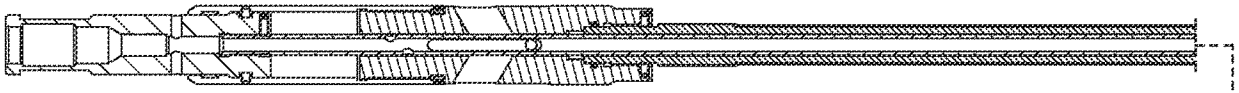
FIGS. 11A to 11D are views of the bridge plug of FIG. 1 in a subsequent stage of release.
Figure 11B:
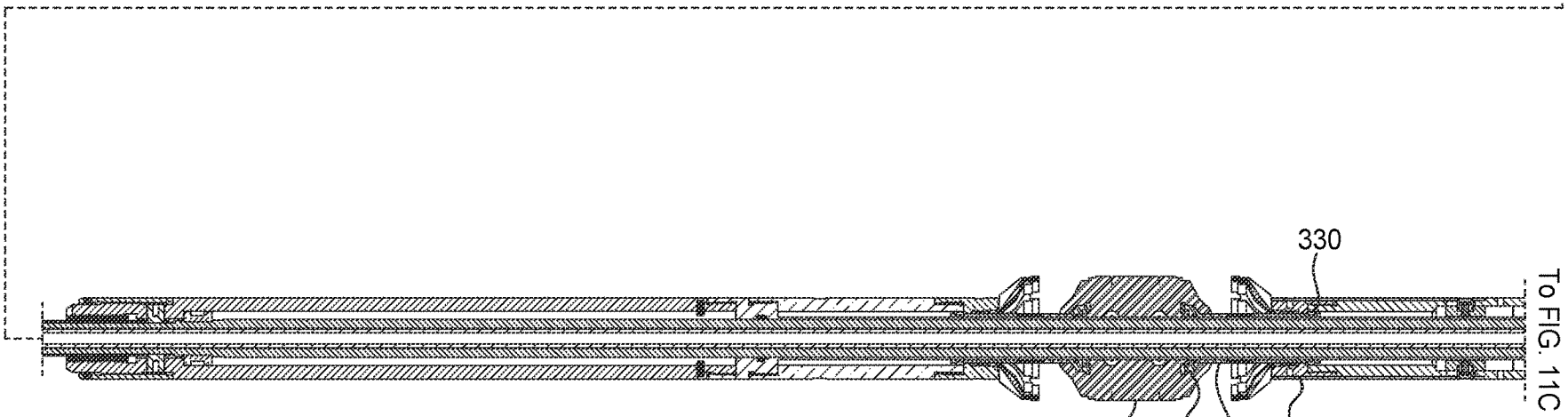
Figure 11C:
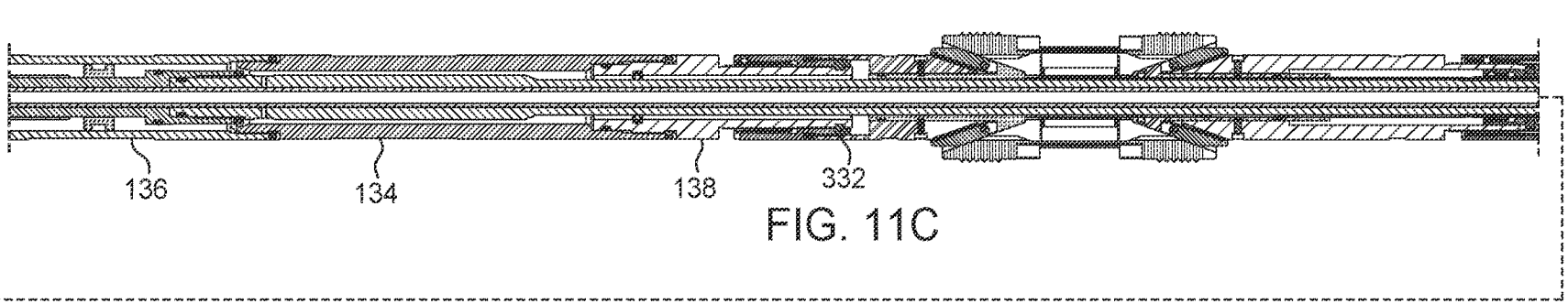
Figure 11D:
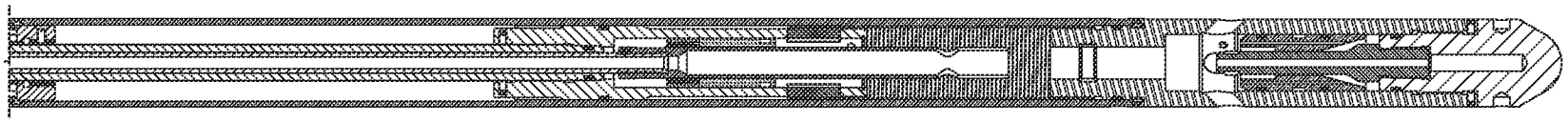
Figure 12A:
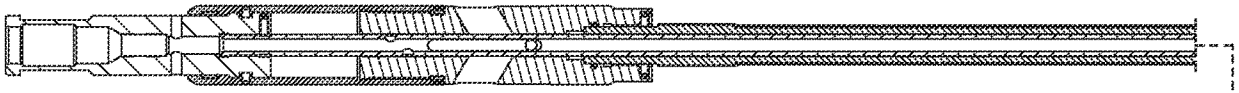
FIGS. 12A to 12D are views of the bridge plug of FIG. 1 in a subsequent stage of release.
Figure 12B:
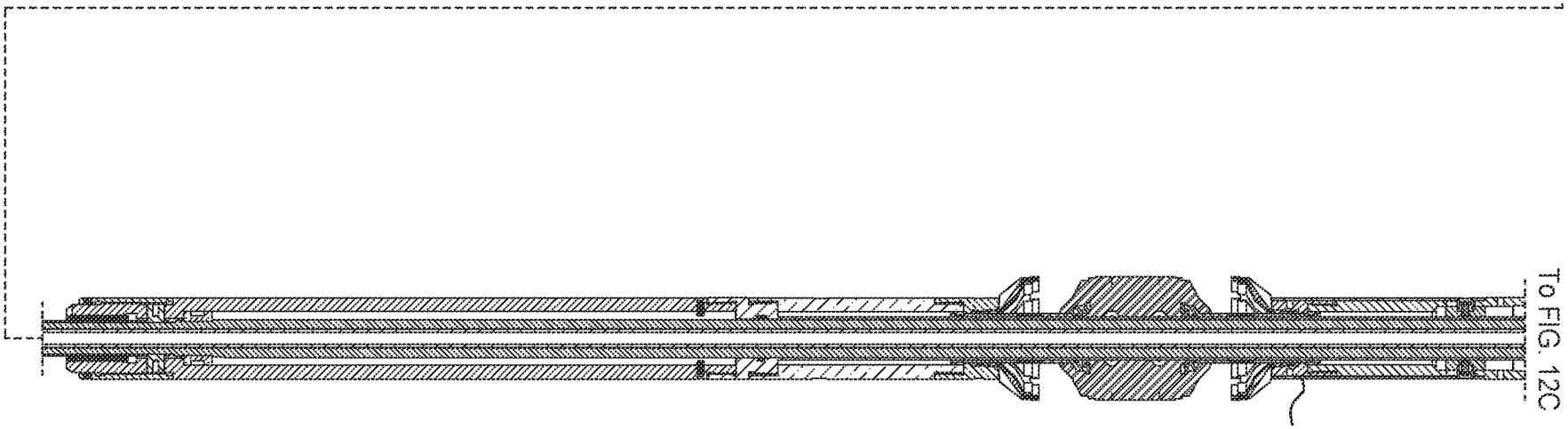
Figure 12C:
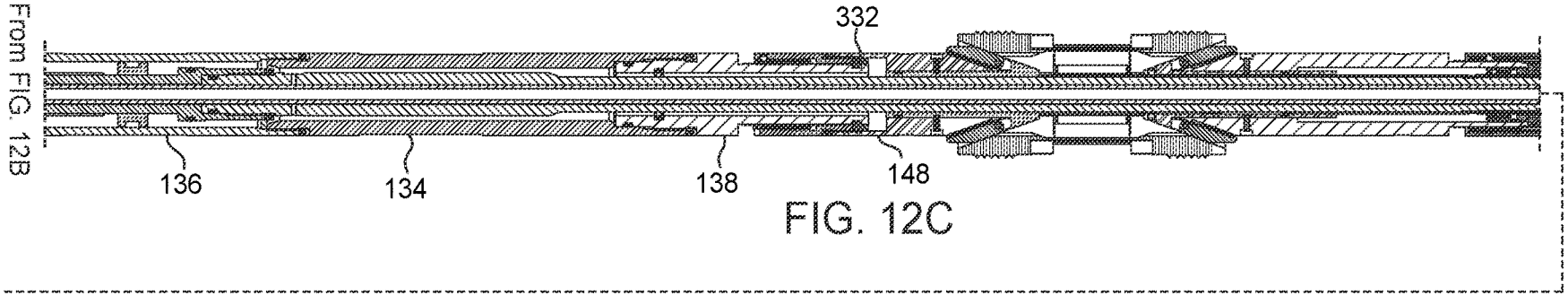
Figure 12D:
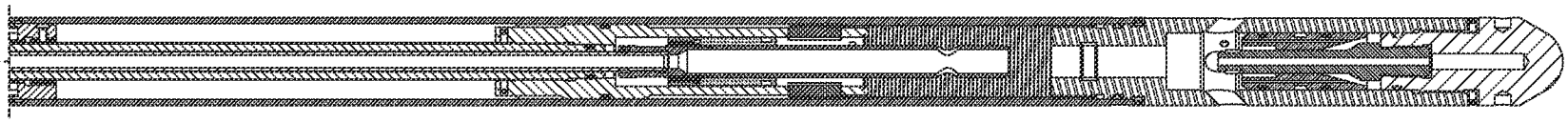
Figure 13A:
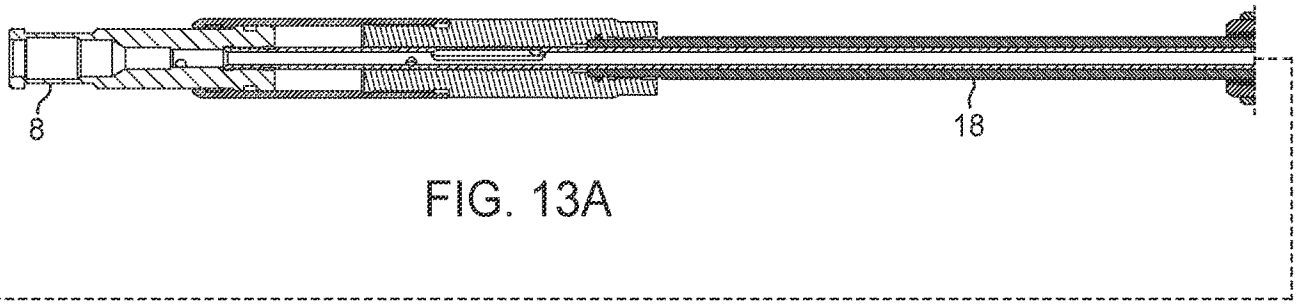
FIGS. 13A to 13D are views of the bridge plug of FIG. 1 in a subsequent stage of release.
Figure 13B:
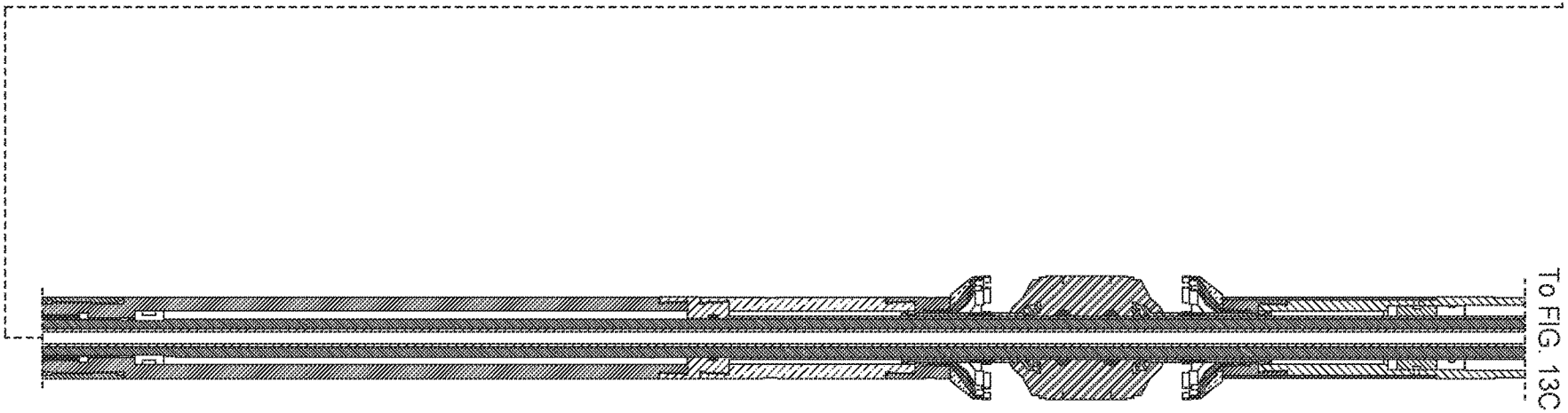
Figure 13C:
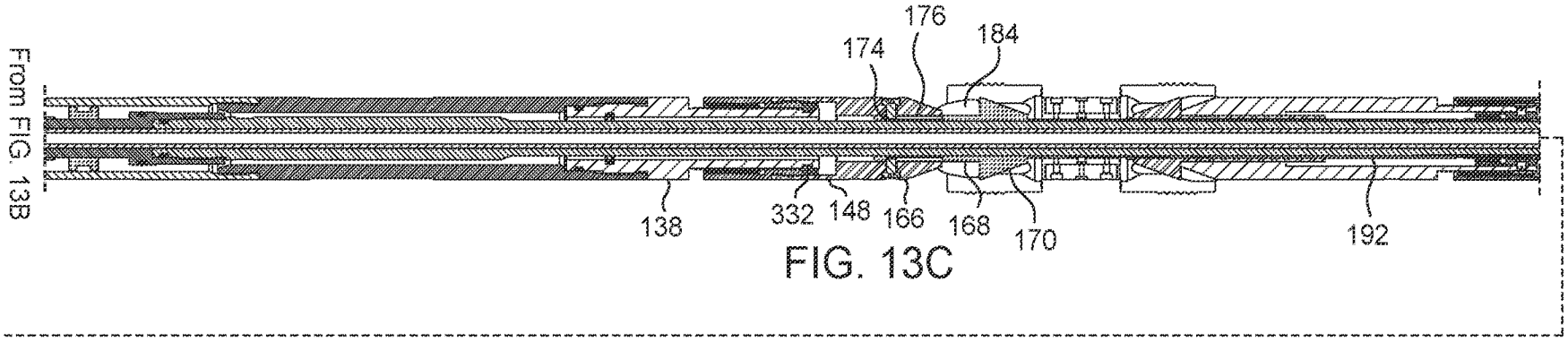
Figure 13D:
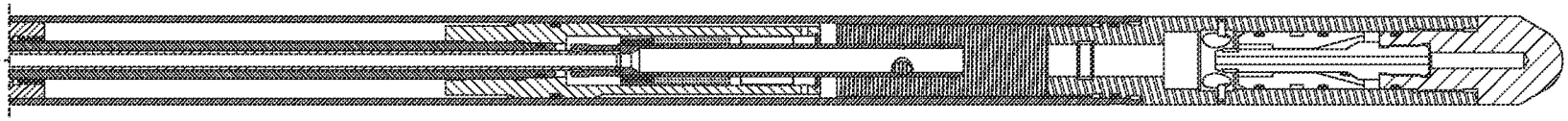
Figure 14A:
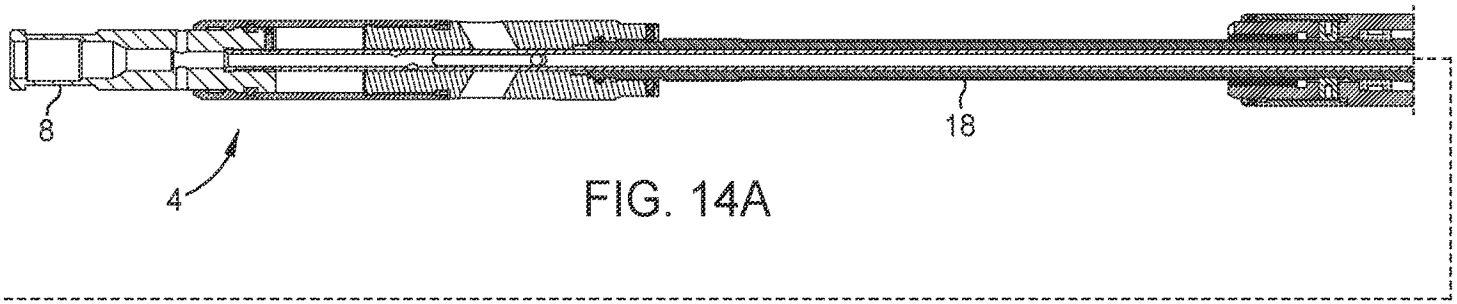
FIGS. 14A to 14D are views of the bridge plug of FIG. 1 in a subsequent stage of release.
Figure 14B:
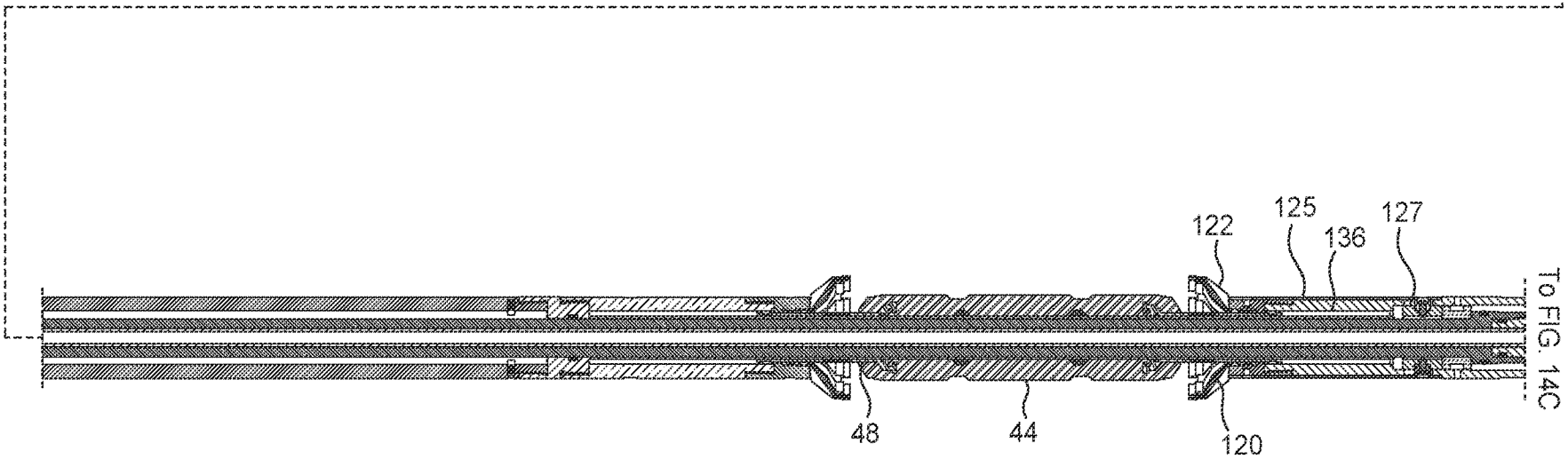
Figure 14C:
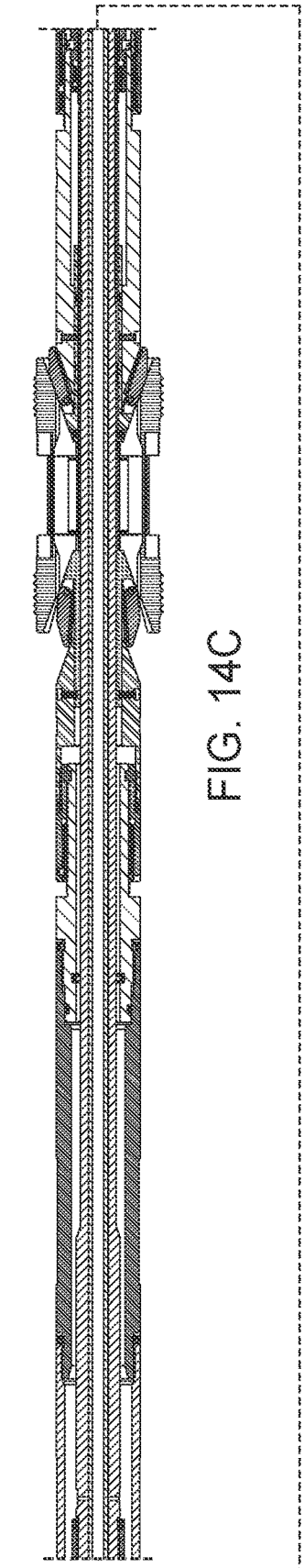
Figure 14D:
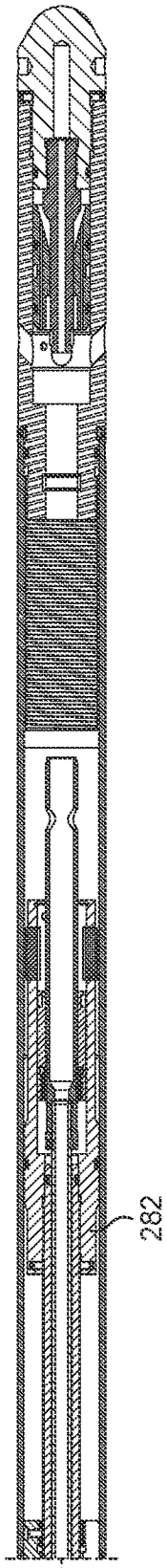
Figure 15A:
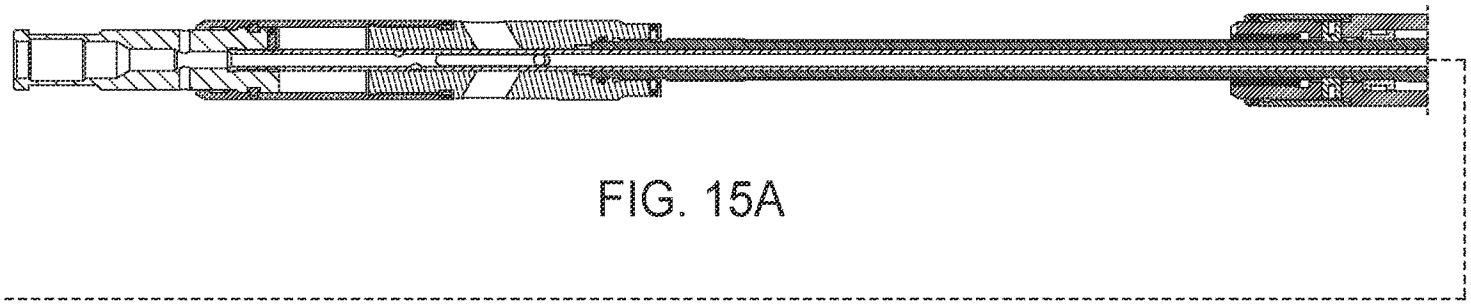
FIGS. 15A to 15D are views of the bridge plug of FIG. 1 in a subsequent stage of release.
Figure 15B:
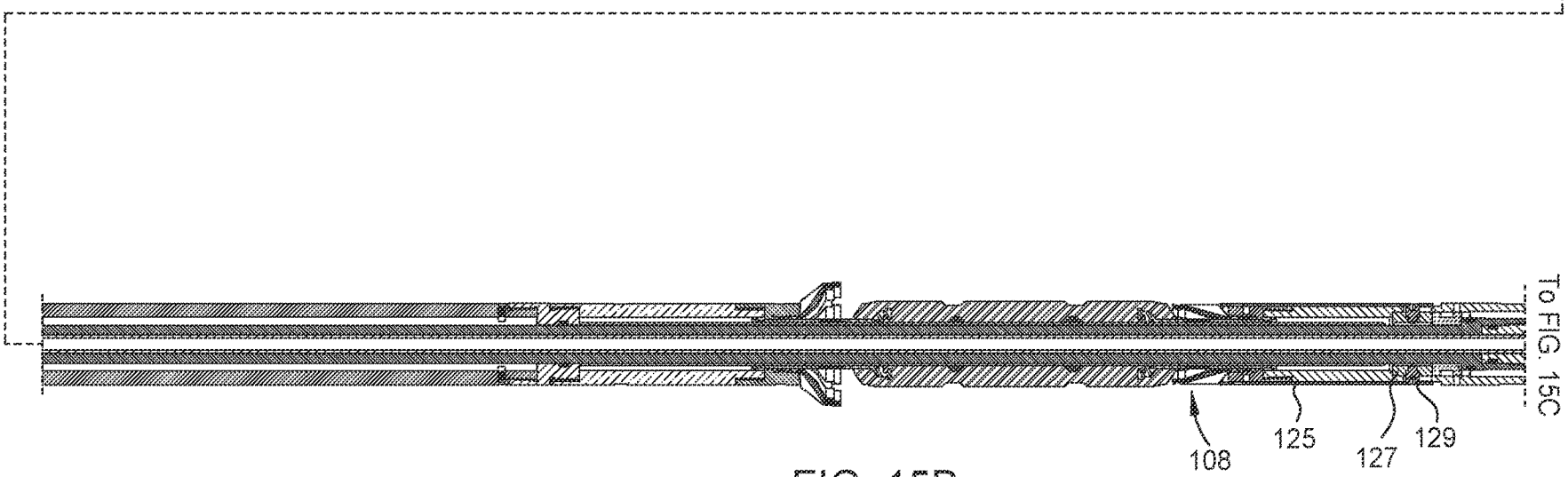
Figure 15C:
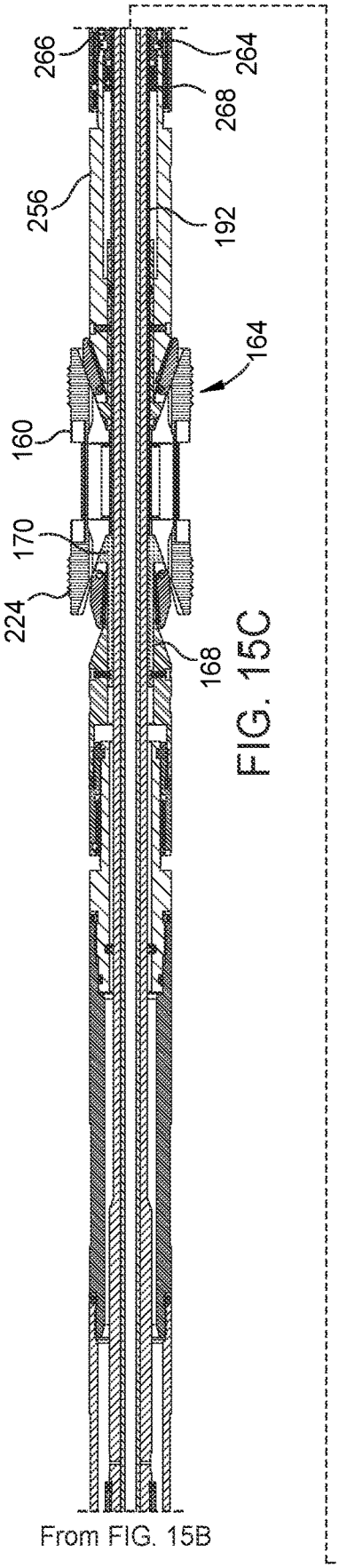
Figure 15D:
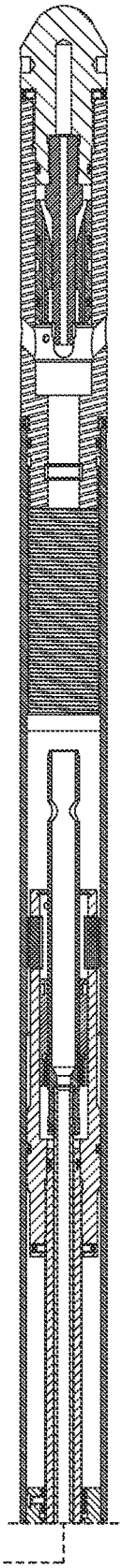
Figure 16A:
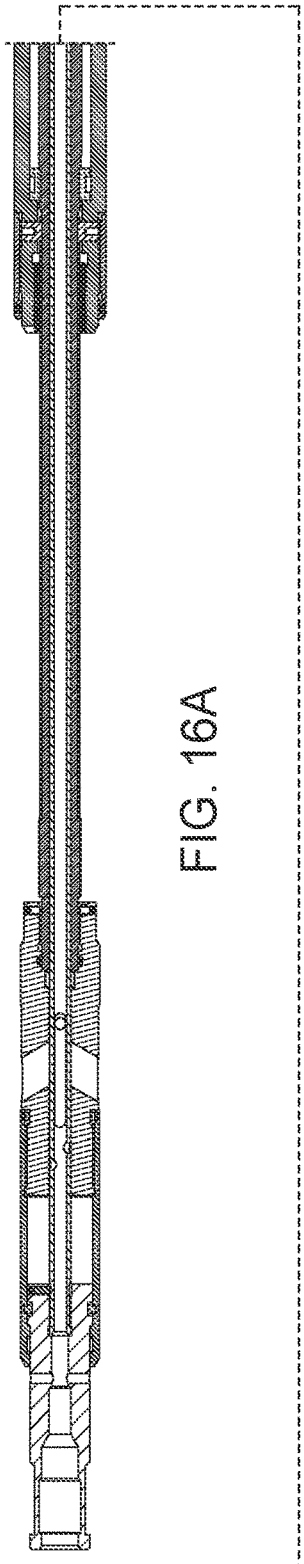
FIGS. 16A to 16D are views of the bridge plug of FIG. 1 in a subsequent stage of release.
Figure 16B:
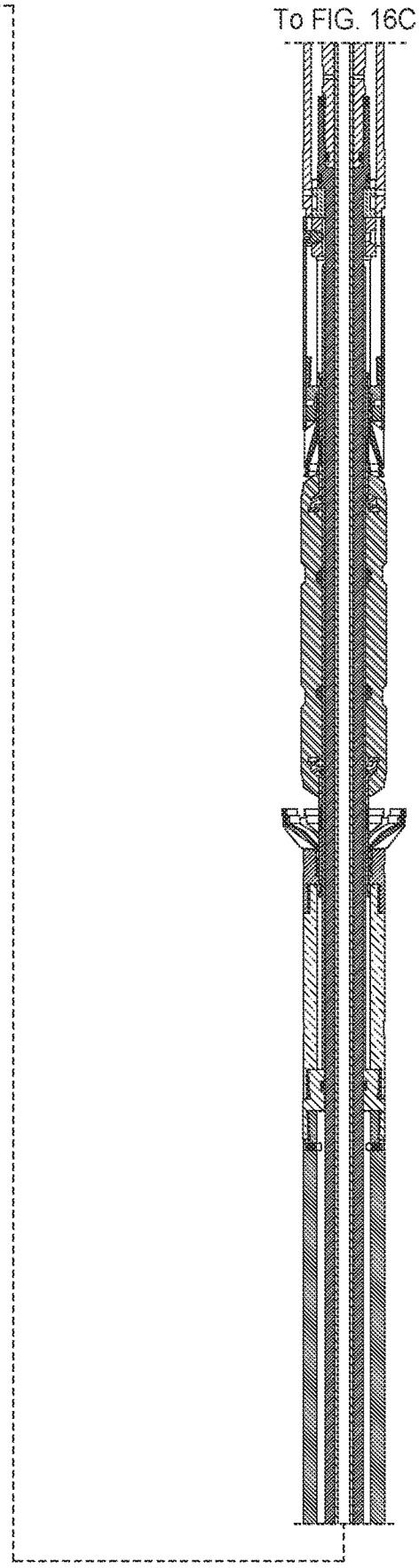
Figure 16C:
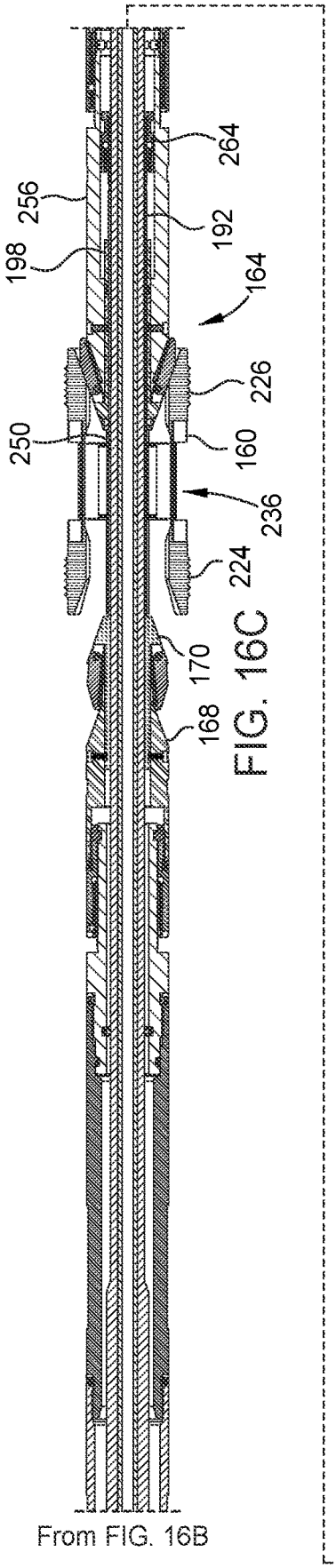
Figure 16D:
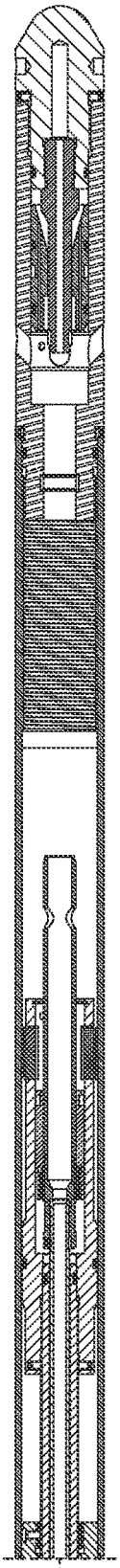
Figure 17A:
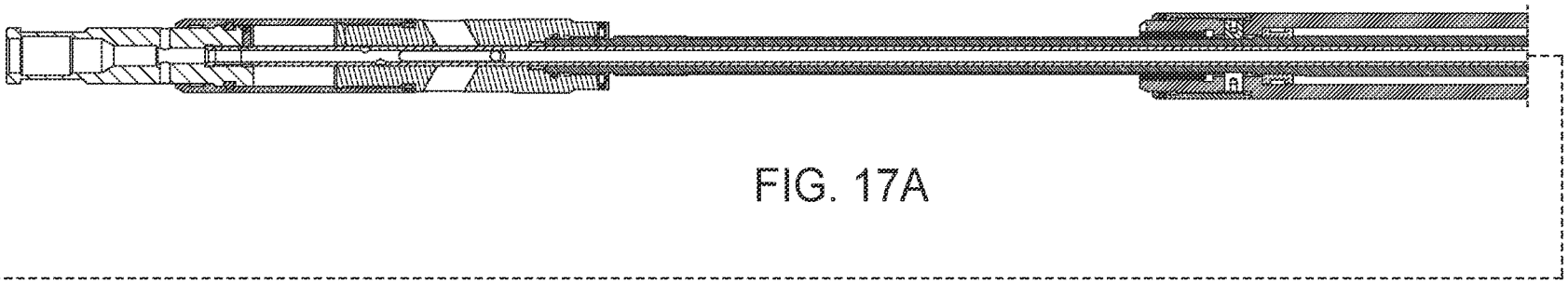
FIGS. 17A to 17D are views of the bridge plug of FIG. 1 in a subsequent stage of release.
Figure 17B:
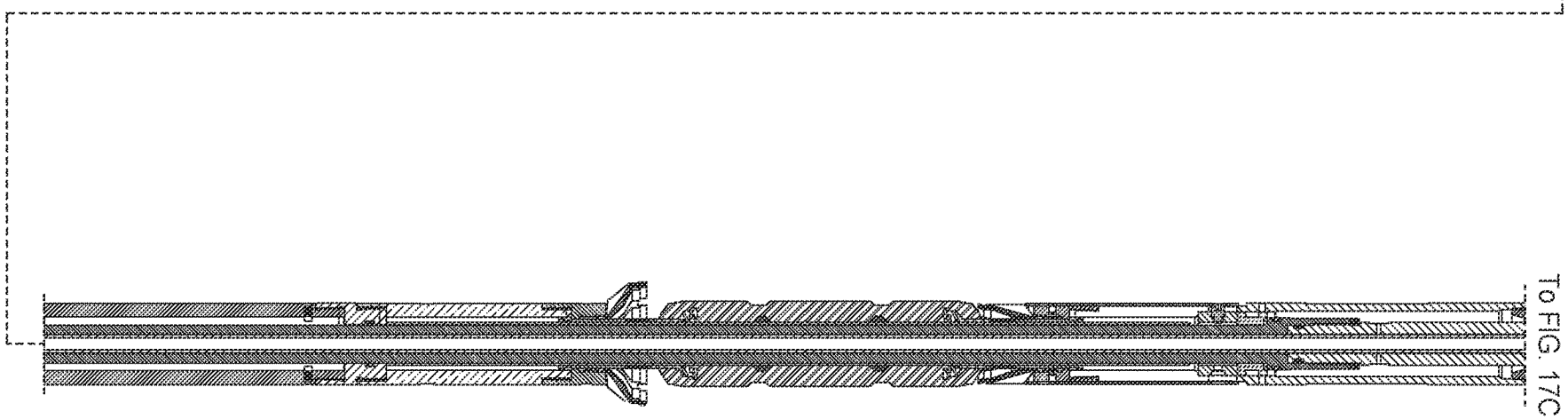
Figure 17C:
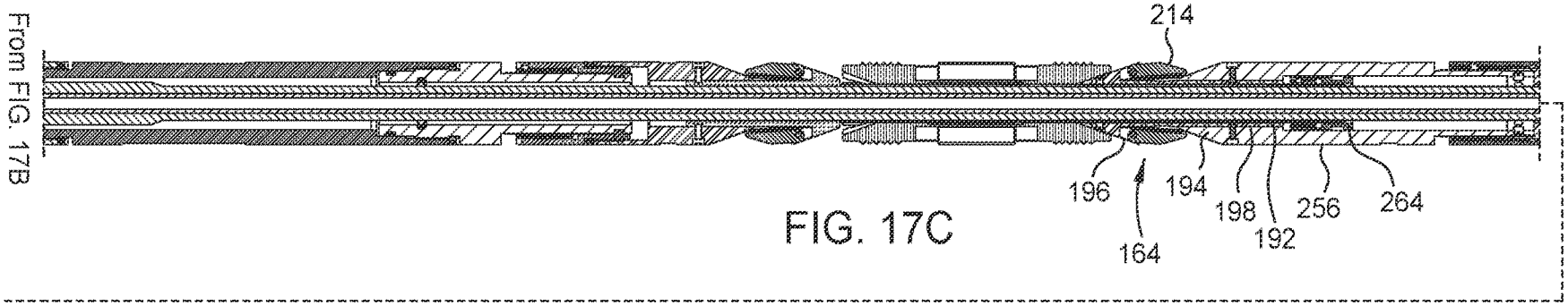
Figure 17D:
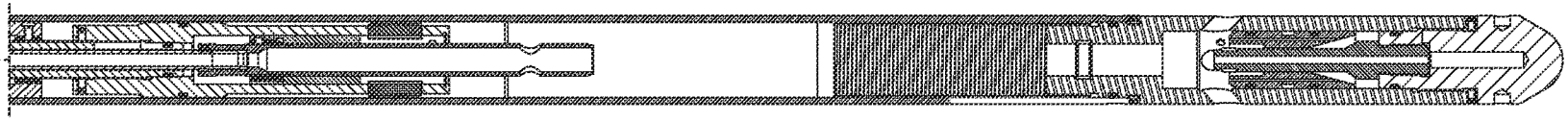

As shown in FIGS. 6B-6C, axial compression of the packing element 44 has caused the packing element 44 to extend radially outwardly. This has caused the inner and outer backup rings 86, 88 of the upper backup ring assembly 74 and the inner and outer backup rings 120, 122 of the lower backup ring assembly 108 to splay outwards. The upper backup sleeve 61 may bear against the outer backup ring 88. The lower backup sleeve 63 may bear against the outer backup ring 122. In some embodiments, particularly those in which the one or more filler ring 132 is bonded to the packing element 44, the packing element 44 may develop one or more external fold 326, as illustrated. In embodiments in which the bridge plug 2 had been installed in a bore (such as a wellbore or pipeline), the packer assembly 40 is now in a set configuration in the bore, and may provide a seal against an internal wall of the bore.

Equalization

The following description highlights at least some of the changes to occur in transitioning from the configuration shown in FIGS. 6A to 6F to the configuration shown in FIGS. 7A to 7F. In order to actuate the pressure equalization feature of the bridge plug 2, the fishing neck 8 of the setting tool adaptor 4 may be engaged by a suitable tool (not shown), such as a setting tool or a retrieval tool. The tool that engages the fishing neck 8 may apply an axial compressive force on the fishing neck 8. The axial compressive force may be sufficient to defeat, such as by shearing, the one or more fastener 12 coupling the fishing neck 8 to the release sleeve 10. As illustrated, the fishing neck 8 has moved down towards the adaptor body 14, which has caused the equalization mandrel 20 to move downwards with respect to the packer assembly 40 and the slip assembly 146.

As illustrated, downward movement of the equalization mandrel 20 has caused downward movement of the release mandrel 298 with respect to the support ring 296. Ratchet teeth 304 on the release mandrel 298 have become engaged with corresponding ratchet teeth 302 of the lock ring 300 in the support ring 296. Additionally, downward axial force applied through the release mandrel 298 has caused the fastener 316 coupling the equalizing sleeve 312 to the ported sub 306 to be defeated, such as by shearing. See also FIG. 2B. Subsequent downward movement of the equalization mandrel 20 has caused downward movement of the equalizing sleeve 312 with respect to the ported sub 306, thereby opening fluid communication through the one or more side port 310.

Thus, fluid in the bore below the packing element 44 may communicate with fluid in the bore above the packing element 44 via the one or more side port 310 in the ported sub 306, the one or more side port 308 in the release mandrel 298, the release mandrel 298, the equalization mandrel 20, the one or more side port 22 in the equalization mandrel 20, and the one or more side port 16 in the adaptor body 14. Hence, pressures in the bore above and below the packing element 44 may become substantially equalized.

Release of the Bridge Plug

The following description highlights at least some of the changes to occur in transitioning from the configuration shown in FIGS. 7A to 7F to the configuration shown in FIGS. 8A to 8F. In order to commence release of the bridge plug 2, a suitable tool (not shown), such as a setting tool or a retrieval tool, may apply an axial tensile force on the fishing neck 8 of the setting tool adaptor 4. As illustrated, the fishing neck 8 has moved upwards away from the adaptor body 14, which has caused the equalization mandrel 20 to move upwards with respect to the packer assembly 40 and the slip assembly 146. A further axial tensile force exerted on the fishing neck 8 has transferred through the release sleeve 10 and the adaptor body 14 to the central mandrel 18.

Additionally, upward movement of the equalization mandrel 20 causes the fastener 297 coupling the release sub 282 to the support ring 296 to be defeated, such as by shearing. See also FIG. 2C. The release mandrel 298 and the support ring 296 move upward because of the engagement between the ratchet teeth 304 on the release mandrel 298 with the ratchet teeth 302 of the lock ring 300 in the support ring 296. Consequently, the radial support for the one or more release lug 288 to be in engagement with the release housing 254 had been removed, and thus upward movement of the central mandrel 18 may cause, as illustrated, upward movement of the release sub 282 such that each release lug 288 becomes disengaged from the release housing 254.

As illustrated in FIGS. 9A to 9F, the central mandrel 18 has moved upwards with respect to the setting sleeve 24. The stop ring 34 on the central mandrel 18 has engaged an inner shoulder 333 of the setting sleeve 24, and further upward movement of the central mandrel 18 has caused the setting sleeve 24 to move upwards. Upward movement of the setting sleeve 24 has caused upward movement of the upper backup sleeve 61, and that has caused the upper backup ring assembly 74 to become disengaged from the packing element 44.

As illustrated in FIGS. 10A to 10F, upward movement of the upper backup sleeve 61 also has caused upward movement of the upper recovery sleeve 48 via engagement with a stop ring 328 on the upper recovery sleeve 48. As illustrated, interaction between the upper recovery profile 50 of the upper recovery sleeve 48 and the packing element 44 may, optionally, cause the packing element 44 to begin to elongate axially and shrink radially. Additionally, or alternatively, interaction between the upper recovery profile 50 of the upper recovery sleeve 48 and the packing element 44 may cause the packing element 44 to begin to move axially upward and away from the lower backup sleeve 63.

As illustrated in FIGS. 11A-11D, upward movement of the packing element 44 may also cause upward movement of the lower recovery sleeve 54 due to interaction between the lower recovery profile 56 of the lower recovery sleeve 54 and the packing element 44. As illustrated, a stop ring 330 on the lower recovery sleeve 54 may transfer an upward force, and upward movement, to the lower backup sleeve 63. As illustrated in FIGS. 12A-12D, upward movement of the lower backup sleeve 63 may be transferred through the boost housing extension 136, the boost housing 134, and the boost mandrel 138 to the slip assembly skirt 148 via a stop ring 332 on the boost mandrel 138. As shown, the stop ring 332 on the boost mandrel 138 has moved upward to engage a shoulder of the slip assembly skirt 148.

As illustrated in FIGS. 13A-13D, upward movement of the slip assembly skirt 148 may cause upward movement of the upper support cone 166 away from the upper base cone 170. Hence, the upper support cone 166 may move away from each upper extension ramp 184. As illustrated, each upper extension ramp 184 may pivot from the extended position towards the retracted position under the influence of each corresponding biasing member 190.

A further axial tensile force applied to the fishing neck 8 of the setting tool adaptor 4 is transferred via the central mandrel 18 and the stop ring 332 on the boost mandrel 138 to the slip assembly skirt 148 and the upper support cone 166. Upward movement of the upper support cone 166 with respect to the upper cone sleeve 168 ceased when at least one key 174 in the upper support cone 166 reached the end of the corresponding slot 176 in the upper cone sleeve 168. See also FIGS. 4A and 4E. Thereafter, further axial tensile force has in turn been transferred to the slip mandrel 192.

A further axial tensile force applied to the fishing neck 8 of the setting tool adaptor 4 is transferred, as described above, via the central mandrel 18 to the upper recovery sleeve 48, thereby causing the packing element 44 to elongate axially and shrink radially, as illustrated in FIGS. 14A-14D. The central mandrel 18 and the release sub 282 have moved further upwards with respect to the slip assembly 146. The tensile force applied is transferred through the retrieval ring 127 to the boost housing extension 136 until the tensile force causes the fastener 139 coupling the boost housing extension 136 to the retrieval ring 127 is defeated, such as by shearing. See also FIG. 2D. The retrieval ring 127 is moved upward relative to the boost housing extension 136, thereby causing the retrieval sleeve 125 to move upward. Upward movement of the retrieval sleeve 125 causes the inner and outer backup rings 120, 122 of the lower backup ring assembly 108 to retract at least partially from their splayed outward position, as illustrated in FIGS. 15A-15D.

As illustrated in FIGS. 15A-15D, a further axial tensile force applied to the fishing neck 8 of the setting tool adaptor 4 is transferred, as described above, via the central mandrel 18 to the slip mandrel 192. Because the slip mandrel 192 is coupled to the shear sub 264 via the lock ring 268, the shear sub 264 has experienced an upward force which, upon reaching a threshold value, has defeated (such as by shearing) the one or more fastener 266 coupling the shear sub 264 to the slip assembly connector 256, thereby releasing the shear sub 264 and permitting the slip mandrel 192 and shear sub 264 to move upwards with respect to the lower cone assembly 164 and to the slip member(s) 160.

As illustrated in FIGS. 16A-16D, further upward movement of the central mandrel 18 has resulted in the upper cone sleeve 168, upper base cone 170, and the slip mandrel 192 moving upwards with respect to the slip member(s) 160. Hence, the upper base cone 170 has moved away from the upper gripper 224 of each slip member 160, and the biasing members 246, 248 were able to commence retracting the slip member(s) 160.

During the transition between FIGS. 15A-15D and FIGS. 16A-16D, a lower end of the slot 252 in the slip mandrel 192 encountered the key 250 of the slip cage 236, and further upward movement of the slip mandrel 192 caused the slip cage 236 to move upwards with respect to the lower cone assembly 164. See also FIG. 4B. Thus, the lower gripper 226 of each slip member 160 became axially separated from the lower cone assembly 164, and the biasing members 246, 248 caused the slip member(s) 160 to retract.

As illustrated in FIGS. 17A-17D, additional upward movement of the slip mandrel 192 with respect to the lower cone assembly 164 caused the shear sub 264 to contact and raise the lower cone sleeve 198 with respect to the lower support cone 194, thereby axially separating the lower base cone 196 from the lower support cone 194. As illustrated, each lower extension ramp 214 has pivoted towards the retracted position under the influence of each corresponding biasing member 220. As shown, the shear sub 264 has moved upward into contact with a shoulder of the slip assembly connector 256.

In some embodiments, the magnitude of axial separation between the lower base cone 196 and the lower support cone 194 may be governed by the interaction between the one or more key 204 that couples the lower support cone 194 with the lower cone sleeve 198 and the corresponding slot 206 in the lower cone sleeve 198. When the end of the corresponding slot 206 in the lower cone sleeve 198 reaches the one or more key 204 in the lower support cone 194, the lower support cone 194, the release housing 254, and the ported sub 306 may be carried by the one or more key 204 in the lower support cone 194.

In some embodiments, the magnitude of axial separation between the lower base cone 196 and the lower support cone 194 may be governed by the shear sub 264 encountering an internal shoulder 334 of the lower support cone 194. The lower support cone 194, the release housing 254, and the ported sub 306 may be carried by the shear sub 264.

Upon the retraction of the slip member(s) 160, the bridge plug 2 is no longer anchored to the bore in which the bridge plug 2 had been installed, and therefore the bridge plug 2 may be retrieved. During retrieval, the upper backup ring assembly 74 is configured to retract upon encountering a restriction in the wellbore. As shown, the lower backup ring assembly 74 is at least partially retracted during retrieval. The packing element 44 is axially fix relative to the upper and lower backup ring assemblies 74, 108 during retrieval out of the bore. In this respect, the packing element 44 will not contact the backup ring assemblies 74, 108, thereby preventing accidental expansion of the packing element 44 during retrieval or run-in.

In summary, a bridge plug of the present disclosure incorporating a packer assembly of the present disclosure and a slip assembly of the present disclosure may be run into a bore, including being run through a restriction in the bore.

The bridge plug may be actuated to a set configuration in which the slip assembly is anchored to a wall of the bore within a portion of the bore that is greater than the size of the restriction and a packing element of the packer assembly seals against the wall of the bore. The bridge plug may be further actuated to disengage from the wall of the portion of the bore, and to transition to a size that may fit through the restriction to enable retrieval from the bore. The bridge plug may be retrieved from the bore, including being retrieved through the restriction in the bore.

Other Embodiments

In some embodiments, the bridge plug 2 may be configured to be transitioned from the set configuration to the released configuration, but the method of use may not involve releasing the bridge plug 2. In such embodiments, the steps that would be performed to achieve release of the bridge plug 2 may be omitted.

In some embodiments, the bridge plug 2 may not be configured to be transitioned from the set configuration to the released configuration. In such embodiments, the components that facilitate the release of the bridge plug 2 may be modified or omitted in order to avoid an inadvertent release of the bridge plug 2.

In some embodiments, the packer assembly 40 of the present disclosure may be utilized with other tools and systems apart from the bridge plug 2. For example, the packer assembly 40 may be used as a sealing system for a downhole/pipeline packer, a liner hanger, a straddle assembly, a whipstock, a pressure test tool, a production test tool (such as a drill stem test tool), a storm packer tool, a casing hanger, or any other downhole or pipeline service tool.

In some embodiments, the various embodiments of the packer assembly 40 of the present disclosure may be configured to be transitioned from the set configuration to the released configuration, but the method of use may not involve releasing the packer assembly 40. In such embodiments, the steps that would be performed to achieve release of the packer assembly 40 may be omitted.

In some embodiments, the packer assembly 40 may not be configured to be transitioned from the set configuration to the released configuration. In such embodiments, the components that facilitate the release of the packer assembly 40 may be modified or omitted in order to avoid an inadvertent release of the packer assembly 40.

In some embodiments, the slip assembly 146 of the present disclosure may be utilized with other tools and systems apart from the bridge plug 2. For example, the slip assembly 146 may be used as an anchoring system for a downhole/pipeline packer, a liner hanger, a straddle assembly, a whipstock, a pressure test tool, a production test tool (such as a drill stem test tool), a storm packer tool, a casing hanger, or any other downhole or pipeline service tool.

In some embodiments, the various embodiments of the slip assembly 146 of the present disclosure may be configured to be transitioned from the set configuration to the released configuration, but the method of use may not involve releasing the slip assembly 146. In such embodiments, the steps that would be performed to achieve release of the slip assembly 146 may be omitted.

In some embodiments, the slip assembly 146 may not be configured to be transitioned from the set configuration to the released configuration. In such embodiments, the components that facilitate the release of the slip assembly 146 may be modified or omitted in order to avoid an inadvertent release of the slip assembly 146.

In one embodiment, a packer assembly includes a packer mandrel and a packing element disposed about the packer mandrel. An upper recovery sleeve is disposed about the packer mandrel and extending between the packer mandrel and an upper end of the packing element, and a lower recovery sleeve is disposed about the packer mandrel and extending between the packer mandrel and a lower end of the packing element. An upper backup assembly is movably disposed about the upper recovery sleeve and adjacent to the upper end of the packing element. A lower backup assembly is movably disposed about the lower recovery sleeve. The lower backup assembly has a lower backup ring assembly configured to enclose an outer surface of the lower end of the packing element. A retrieval sleeve is selectively movable relative to the lower backup ring assembly and configured to at least partially retract the lower backup ring assembly.

In one or more of the embodiments described herein, the packer assembly further comprises a filler ring movably disposed between the packer mandrel and the packing element.

In one or more of the embodiments described herein, the packing element is bonded to the filler ring.

In one or more of the embodiments described herein, the packing element comprises a unitary structure of packing material.

In one or more of the embodiments described herein, the upper recovery sleeve has an upper recovery profile embedded within the packing element and the lower recovery sleeve has a lower recovery profile embedded within the packing element.

In one or more of the embodiments described herein, the upper backup assembly includes an upper backup sleeve; and an upper backup ring assembly coupled to the upper backup sleeve and configured to enclose an outer surface of the upper end of the packing element.

In one or more of the embodiments described herein, the upper backup ring assembly further comprises a first inner backup ring adjacent the outer surface of the upper end of the packing element, and a first outer backup ring adjacent the first inner backup ring; and the upper backup sleeve is configured to abut the first outer backup ring when the packer is in a set configuration.

In one or more of the embodiments described herein, the lower backup assembly includes a lower backup sleeve coupled to the lower backup ring assembly.

In one or more of the embodiments described herein, the lower backup ring assembly further comprises a second inner backup ring adjacent the outer surface of the lower end of the packing element, and a second outer backup ring adjacent the second inner backup ring; and the lower backup sleeve is configured to abut the second outer backup ring when the packer is in a set configuration.

In one or more of the embodiments described herein, the packer assembly includes a boost mechanism configured to apply an upwardly-directed force on the lower backup assembly, wherein the retrieval sleeve is releasably connected to the boost mechanism.

In one embodiment, a method of manipulating a packing element in a bore includes providing an upper recovery sleeve having an upper recovery profile embedded within the packing element and providing a lower recovery sleeve having a lower recovery profile embedded within the packing element. The method also includes moving an upper backup assembly with respect to the upper recovery sleeve toward an upper end of the packing element; and moving a lower backup assembly with respect to the lower recovery sleeve toward a lower end of the packing element. The lower backup assembly has a lower backup ring enclosing an outer surface of the lower end of the packing element. An axial distance between the upper recovery sleeve and the lower recovery sleeve is reduced, thereby axially compressing the packing element. The packing element is deformed into contact with a surrounding wall of the bore and causing the lower backup ring to splay outward along an outer surface of a lower end of the packing element. The packing element is released from the surrounding wall. A retrieval sleeve is moved relative to the lower backup ring to retract the lower backup ring assembly.

In one or more of the embodiments described herein, deforming the packing element into contact with a surrounding wall of the bore includes splaying an upper backup ring of the upper backup assembly outward along an outer surface of an upper end of the packing element.

In one or more of the embodiments described herein, releasing the packer element from the surrounding wall includes increasing an axial distance between the lower backup ring and the lower end of the packing element.

In one or more of the embodiments described herein, the method includes increasing an axial distance between the upper recovery sleeve and the lower recovery sleeve, thereby axially stretching the packing element.

In one or more of the embodiments described herein, increasing the axial distance includes using the upper backup assembly to move the upper recovery sleeve away from the lower recovery sleeve.

In one or more of the embodiments described herein, the method includes retrieving the packing element with the lower backup ring in the at least partially retracted position.

In one or more of the embodiments described herein, the method includes retracting the upper backup ring when the upper backup ring contacts a restriction in the bore during retrieval.

In one or more of the embodiments described herein, the method includes the packing element being axially fixed relative to the lower backup ring and the upper backup ring during retrieval or run-in.

In one embodiment, a downhole tool includes a central mandrel, a slip assembly disposed about the central mandrel, and a packer assembly disposed about the central mandrel. The packer assembly includes a packer mandrel and a packing element disposed about the packer mandrel. An upper recovery sleeve is disposed about the packer mandrel and extending between the packer mandrel and an upper end of the packing element, and a lower recovery sleeve is disposed about the packer mandrel and extending between the packer mandrel and a lower end of the packing element. An upper backup assembly is movably disposed about the upper recovery sleeve and adjacent to the upper end of the packing element. A lower backup assembly is movably disposed about the lower recovery sleeve. The lower backup assembly has a lower backup ring assembly configured to enclose an outer surface of the lower end of the packing element. A retrieval sleeve is selectively movable relative to the lower backup ring assembly and configured to at least partially retract the lower backup ring assembly.

In one more of the embodiments described herein, the slip assembly includes a slip mandrel and a cone assembly coupled to the slip mandrel. The cone assembly includes a base cone and an extension ramp coupled to the base cone, wherein the extension ramp is movable between a radially retracted position and a radially extended position and biased toward the radially retracted position by a biasing member. The slip assembly may also include a slip member disposed adjacent the base cone, wherein the slip member is configured to slide between retracted and extended positions along an outer surface of the base cone and along an outer surface of the extension ramp.

In one or more of the embodiments described herein, the slip assembly is configured to transition from a running configuration to a set configuration prior to the packer assembly transitioning from a running configuration to a set configuration.

In one or more of the embodiments described herein, the packer assembly is configured to transition from the set configuration to a released configuration prior to the slip assembly transitioning from the set configuration to a released configuration.

In one or more of the embodiments described herein, downhole tool includes a primary release mechanism configured to selectively permit the packer assembly to transition from the set configuration to the released configuration; and a secondary release mechanism configured to selectively permit the slip assembly to transition from the set configuration to the released configuration.

While the foregoing is directed to embodiments of the present disclosure, other and further embodiments of the disclosure may be devised without departing from the basic scope thereof, and the scope thereof is determined by the claims that follow.

What is claimed is:

1. A retrievable downhole tool for use in a subterranean wellbore, the downhole tool comprising:

a retrieval member configured for selective attachment to a retrieval tool;

a packer mandrel;

a packing element disposed about the packer mandrel, the packing element movable between a first position and a radially expanded, axially shortened, second position;

an upper recovery sleeve disposed about the packer mandrel and extending between the packer mandrel and an upper end of the packing element;

an upper backup assembly movably disposed about the upper recovery sleeve and adjacent to the upper end of the packing element;

a lower recovery sleeve disposed about the packer mandrel and extending between the packer mandrel and a lower end of the packing element;

a lower backup assembly movably disposed about the lower recovery sleeve, the lower backup assembly having a lower backup ring assembly configured to move from a first position wherein the lower backup ring encloses an outer surface of the lower end of the packing element, to a second position wherein the lower backup ring is splayed outwardly at the lower end of the packing element; and a retrieval sleeve selectively movable relative to the lower backup ring assembly and configured to at least partially retract the lower backup ring assembly from the splayed outward second position.

2. The packer assembly of claim 1, further comprising a filler ring movably disposed between the packer mandrel and the packing element.

3. The packer assembly of claim 2, wherein the packing element is bonded to the filler ring.

4. The packer assembly of claim 1, wherein the packing element comprises a unitary structure of packing material.

5. The packer assembly of claim 1, wherein the upper recovery sleeve has an upper recovery profile embedded within the packing element and the lower recovery sleeve has a lower recovery profile embedded within the packing element.

6. The packer assembly of claim 1, wherein the upper backup assembly comprises:

an upper backup sleeve; and an upper backup ring assembly coupled to the upper backup sleeve and configured to enclose an outer surface of the upper end of the packing element.

7. The packer assembly of claim 6, wherein:

the upper backup ring assembly further comprises a first inner backup ring adjacent the outer surface of the upper end of the packing element, and a first outer backup ring adjacent the first inner backup ring; and the upper backup sleeve is configured to abut the first outer backup ring when the packer is in a set configuration.

8. The packer assembly of claim 6, wherein the lower backup assembly comprises: a lower backup sleeve coupled to the lower backup ring assembly.

9. The packer assembly of claim 8, wherein:

the lower backup ring assembly further comprises a second inner backup ring adjacent the outer surface of the lower end of the packing element, and a second outer backup ring adjacent the second inner backup ring; and the lower backup sleeve is configured to abut the second outer backup ring when the packer is in a set configuration.

10. The packer assembly of claim 8, further comprising a boost mechanism configured to apply an upwardly-directed force on the lower backup assembly, wherein the retrieval sleeve is releasably connected to the boost mechanism.

11. A method of manipulating a packing element in a bore, comprising:

providing an upper recovery sleeve having an upper recovery profile embedded within the packing element;

providing a lower recovery sleeve having a lower recovery profile embedded within the packing element;

moving an upper backup assembly with respect to the upper recovery sleeve toward an upper end of the packing element;

moving a lower backup assembly with respect to the lower recovery sleeve toward a lower end of the packing element, the lower backup assembly having a lower backup ring enclosing an outer surface of the lower end of the packing element;

reducing an axial distance between the upper backup assembly and the lower backup assembly, thereby axially compressing the packing element;

deforming the packing element into contact with a surrounding wall of the bore and causing the lower backup ring to splay outward along the outer surface of a lower end of the packing element; and thereafter increasing the axial distance between the upper recovery sleeve and the lower recovery sleeve, and releasing the packer element from the surrounding wall; and at least partially retracting the splayed outward lower backup ring by moving a retrieval sleeve relative to the lower backup ring.

12. The method of claim 11, wherein deforming the packing element into contact with a surrounding wall of the bore includes: splaying an upper backup ring of the upper backup assembly outward along an outer surface of an upper end of the packing element.

13. The method of claim 12, wherein releasing the packer element from the surrounding wall comprises: increasing an axial distance between the lower backup ring and the lower end of the packing element.

14. The method of claim 13, wherein increasing the axial distance between the upper recovery sleeve and the lower recovery sleeve further comprises axially stretching the packing element by increasing the axial distance between the upper and lower recovery profiles embedded within the packing element.

15. The method of claim 14, wherein increasing the axial distance between the upper recovery sleeve and the lower recovery sleeve comprises using the upper backup assembly to move the upper recovery sleeve away from the lower recovery sleeve.

16. The method of claim 12, further comprising retrieving the packing element with the lower backup ring in the at least partially retracted position.

17. The method of claim 16, further comprising at least partially retracting the upper backup ring when the upper backup ring contacts a restriction in the bore during retrieval.

18. The method of claim 16, wherein the packing element is axially fixed relative to the lower backup ring and the upper backup ring during retrieval.

19. A retrievable downhole tool comprising:

a central mandrel;

a slip assembly disposed about the central mandrel; and a packer assembly disposed about the central mandrel, the packer assembly comprising:

a packer mandrel;

a packing element disposed about the packer mandrel and movable between a first position and a radially expanded, axially shortened, second position;

an upper recovery sleeve disposed about the packer mandrel and extending between the packer mandrel and an upper end of the packing element;

an upper backup assembly movably disposed about the upper recovery sleeve and adjacent to the upper end of the packing element;

a lower recovery sleeve disposed about the packer mandrel and extending between the packer mandrel and a lower end of the packing element;

a lower backup assembly movably disposed about the lower recovery sleeve, the lower backup assembly having a lower backup ring assembly configured to move from a first position wherein the lower backup ring encloses an outer surface of the lower end of the packing element, to a second position wherein the lower backup ring is splayed outwardly at the lower end of the packing element; and a retrieval sleeve selectively movable relative to the lower backup ring assembly and configured to at least partially retract the lower backup ring assembly from the splayed outward second position.

20. The downhole tool of claim 19, wherein the slip assembly further comprises:

a slip mandrel;

a cone assembly coupled to the slip mandrel, the cone assembly comprising:

a base cone, and an extension ramp coupled to the base cone, the extension ramp: movable between a radially retracted position and a radially extended position, and biased toward the radially retracted position by a biasing member; and a slip member disposed adjacent the base cone, the slip member configured to slide between retracted and extended positions along an outer surface of the base cone and along an outer surface of the extension ramp.

* * * * *